US007258959B2

(12) United States Patent
Nakayama et al.

(10) Patent No.: US 7,258,959 B2
(45) Date of Patent: Aug. 21, 2007

(54) TONER FOR ELECTROPHOTOGRAPHY AND IMAGE FORMING APPARATUS

(75) Inventors: Shinya Nakayama, Numazu (JP); Satoshi Mochizuki, Numazu (JP); Yasuaki Iwamoto, Numazu (JP); Yasuo Asahina, Numazu (JP); Kazuhiko Umemura, Shizuoka (JP); Hideki Sugiura, Fuji (JP); Hisashi Nakajima, Numazu (JP); Tomoyuki Ichikawa, Numazu (JP); Tomoko Utsumi, Numazu (JP); Koichi Sakata, Numazu (JP); Akihiro Kotsugai, Numazu (JP); Osamu Uchinokura, Numazu (JP); Masayuki Ishii, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/234,415

(22) Filed: Sep. 26, 2005

(65) Prior Publication Data

US 2006/0068313 A1 Mar. 30, 2006

Related U.S. Application Data

(63) Continuation of application No. PCT/JP2004/004273, filed on Mar. 26, 2004.

(30) Foreign Application Priority Data

Mar. 26, 2003 (JP) ..... 2003-085821
Jun. 20, 2003 (JP) ..... 2003-175895
Sep. 11, 2003 (JP) ..... 2003-319852

(51) Int. Cl.
*G03G 9/00* (2006.01)
*G03G 5/00* (2006.01)

(52) U.S. Cl. ..... 430/109.4; 430/108.6; 430/108.7; 430/137.15; 430/137.17

(58) Field of Classification Search ..... 430/109.4, 430/108.6, 108.7, 137.15, 137.17
See application file for complete search history.

(56) References Cited

U.S. PATENT DOCUMENTS 6,074,795 A 6/2000 Watanabe et al.

(Continued)

FOREIGN PATENT DOCUMENTS

JP 5-107810 4/1993

(Continued)

OTHER PUBLICATIONS

U.S. Appl. No. 11/484,565, filed Jul. 12, 2006, Tanaka et al.

(Continued)

*Primary Examiner*—Mark A. Chapman
(74) *Attorney, Agent, or Firm*—Oblon, Spivak, McClelland, Maier & Neustadt, P.C.

(57) ABSTRACT

The object of the present invention is to provide a developer having a sharp charge amount distribution and bringing out high-quality image without substantially smearing a charging unit, developing units, a photoconductor, and an intermediate transferring member by the developer, namely, a developer capable of providing an appropriate image density and exhibiting extremely little background smear even when used over a long period of time and repeatedly used for a number of sheets of paper as well as to provide an image forming apparatus for electrophotography using the developer.

34 Claims, 7 Drawing Sheets

U.S. PATENT DOCUMENTS

| | | | |
|---|---|---|---|
| 6,201,945 | B1 | 3/2001 | Schlueter, Jr. et al. |
| 6,824,945 | B2 | 11/2004 | Emoto et al. |
| 6,858,365 | B2 | 2/2005 | Sawada et al. |
| 2004/0115550 | A1 | 6/2004 | Sugiura et al. |
| 2004/0229143 | A1 | 11/2004 | Umemura et al. |
| 2005/0089786 | A1 | 4/2005 | Sugiura et al. |
| 2005/0089787 | A1 | 4/2005 | Uchinokura et al. |

FOREIGN PATENT DOCUMENTS

| | | |
|---|---|---|
| JP | 5-341617 | 12/1993 |
| JP | 6-3981 | 1/1994 |
| JP | 6-123995 | 5/1994 |
| JP | 2537503 | 7/1996 |
| JP | 9-43909 | 2/1997 |
| JP | 9-258474 | 10/1997 |
| JP | 11-72950 | 3/1999 |
| JP | 11-133667 | 5/1999 |
| JP | 11-258834 | 9/1999 |
| JP | 2000-292973 | 10/2000 |
| JP | 2000-292978 | 10/2000 |
| JP | 3141783 | 12/2000 |
| JP | 2002-40756 | 2/2002 |
| JP | 2002-278122 | 9/2002 |
| JP | 2002-351128 | 12/2002 |
| WO | WO 2002/056116 | 7/2002 |

OTHER PUBLICATIONS

Takao Ishiyama et al., "Feature Of Evolved Toner Production Process and Possibility", The 4th-Joint Symposium-the Imaging Society of Japan and the Japan Society of Static Electricity, Jul. 29, 2002, pp. 21-28 (with partial English translation).

U.S. Appl. No. 11/519,057 filed Sep. 12, 2006, Nakayama et al.

Takao Ishiyama, et al., "Feature of Evolved Toner Production Process and Possibility", The 4th-Joint Symposium-the imaging Society of Japan and the Japan Society of Static Electricity, Jul. 29, 2002, pp. 21-28 (with partial English translation).

TONER FOR ELECTROPHOTOGRAPHY AND IMAGE FORMING APPARATUS

CROSS-REFERENCE TO RELATED APPLICATIONS

This is a continuation of Application No. PCT/JP2004/004273, filed on Mar. 26, 2004.

BACKGROUND OF THE INVENTION

1. Field of the Invention

The present invention relates to a toner used for developers for developing electrostatic images in electrophotography, electrostatic recording, electrostatic printing, and the like, and also relates to a process cartridge and an image developing unit for electrophotography in which a developer containing the toner is used. More specifically, the present invention relates to a toner for electrophotography and a developer for electrophotography used for copiers, laser printers, plain paper facsimiles, and the like using a direct or indirect electrophotographic developing process, and also relates to a process cartridge and an electrophotographic image developing unit in which the developer for electrophotography is used. The present invention further relates to a toner and a developer used for full-color copiers, full color laser printers, and full color regular paper facsimiles, and the like each of which employs direct or indirect electrographic multi-color image developing process, also relates to a process cartridge and an image forming apparatus for electrophotography in which the developer for electrophotography is used.

2. Description of the Related Art

In electrophotographic apparatuses and electrophotographic recording apparatuses or the like, electric images or magnetic latent images have been developed into images through the use of toners. For example, in an electrophotographic process, a latent electrostatic image or latent image is formed on a photoconductor, and then the latent image is developed by using a toner to form a toner image. Typically, the toner image is transferred onto a transferring material such as paper and then fixed by means of heating or the like. A toner used for a latent electrostatic image is colored particles in which typically colorants, charge controlling agents, and other additives are included in a binder resin. There are two types of method for producing such a toner, namely, crushing method and suspension polymerization method. In the crushing method, colorants, charge controlling agents, anti-offset agents, and the like are melted and mixed to be uniformly dispersed in a thermoplastic resin, and the obtained composition is crushed and classified to thereby produce a toner. According to the crushing method, it is possible to produce a toner having excellent properties to some extent, however, there are limitations on selection of toner materials. For example, a composition produced by melting and mixing toner materials are required to be crushed and classified by using an economically available apparatus. To respond to the request, the melted and mixed component is forced to be made sufficiently brittle. For this reason, when the composition is actually crushed into particles, a wider range of particle size distribution is liable to be formed. When a copied image having excellent resolution and toner properties is expected to be obtained, for example, it surfers from the disadvantages that fine particles each having a particle diameter of 5 μm or less and fine particles each having a particle diameter of 20 μm or more must be eliminated by classifying the toner particles, and the yield is substantially low. In addition, in the crushing method, it is hard to uniformly disperse colorants and charge controlling agents, and the like in a thermoplastic resin. A dispersion liquid in which components are insufficiently dispersed negatively affects flowability of toner, developing property, quality of image, and the like.

In recent years, to overcome these problems involved in the crushing method, toner particles have been produced, for example, by suspension polymerization method (for example, see Japanese Patent Application Laid-Open (JP-A) No. 09-43909). However, toner particles obtained by suspension polymerization method are disadvantages in that such toner particles are poor in cleaning ability, although they are spherical. In developing and transferring an image having a low image area ratio, problems with cleaning failures may not occur because a residual toner remaining after transferring is a small amount, however, in developing and transferring an image having a high image area ratio such as a photographic image, further, a toner with which an untransferred image is formed due to a sheet-feeding failure or the like may occur as residual transferring toner on a photoconductor, causing background smear of image when such a residual transferring toner is accumulated. In addition, it causes smears on charge rollers or the like which contact-charges the photoconductor, which disenables exerting of intrinsic chargeability thereof.

For the above reason, a method for obtaining toner particles formed in indefinite shape by associating resin fine particles obtained by an emulsion polymerization method each other has been disclosed (for example, see Japanese Patent (JP-B) No. 2537503). However, in the toner particles obtained by the emulsion polymerization method, a large amount of surfactants remains not only on the surface of the toner particles but also in the inside of the toner particles even when they have been subjected to a washing treatment, which causes impaired environmental stability, a widen charge amount distribution, and image defective due to smears of the obtained images. There are problems that the remaining surfactants smear the photoconductor, charge rollers, developing rollers, or the like, which disenables exerting of intrinsic chargeability.

On the other hand, in a fixing step according to a contact-heat method in which fixing is performed by means of heating members such as a heat roller, releasing property of toner particles against the heating members, which is hereinafter referred to as anti-offset property, is required. Anti-offset property can be improved by making a releasing agent reside on surfaces of toner particles. In view of this tendency, a method has been disclosed in which anti-offset property is improved by making resin fine particles reside not only in toner particles but also reside on surfaces of the toner particles (for example, Japanese Patent Application Laid-Open (JP-A) Nos. 2000-292973 and 2000-292978). However, this method involves a problem that the lower limit fixing temperature is raised, causing insufficient low-temperature fixing property, i.e. energy-saving fixing property.

In the method in which resin fine particles obtained by emulsion polymerization method are associated each other to thereby obtain a toner formed in indefinite shape, the following problems are caused. In other words, in the case where fine particles of a releasing agent are associated with toner particles in order to improve anti-offset property, the fine particles of the releasing agent are substantially taken into the toner particles, resulting in discouraging improvement in anti-offset property with sufficiency. Since resin fine particles, fine particles of releasing agents, fine particles of colorants or the like are fused and bound to toner particles randomly to thereby form the toner particles, variations arise in the composition or ratio of contents of the components between the obtained toner particles, and in molecular mass of the resin or the like, resulting in different surface properties between the toner particles, and disenabling of forming images steadily over a long period time. Further, in a low-temperature fixing system in which low-temperature fixing property is required, there has been a problem that fixing is inhibited due to resin fine particles which reside on surface of the toner, which disenables ensuring the range of fixing temperatures.

On the other hand, a new production method of a toner called the Emulsion-Aggregation method (EA method) is recently disclosed (for example, see Japanese Patent No. 3141783). In this method, toner particles are granulated from polymers which have been dissolved in an organic solvent or the like, contrary to the suspension polymerization method in which toner particles are formed from monomers. Japanese Patent No. 3141783 discloses some advantages of the emulsion-aggregation method in terms of an expansion of selection range of resins, controllability of polarity, and the like. In addition, it is advantageous in capability of controlling a toner structure, i.e. controlling a core-shell structure of toner particles. The shell structure comprises a layer containing only resins and is aims for reducing the amount of pigments and waxes exposed on surface of toner, and it is disclosed that the toner is not innovative in its surface condition and does not have an innovative structure (for example, see Characteristics of Toner Produced by New Production Method and the Prospects written by Takao Ishiyama and other two members, presented at The 4th-Joint Symposium—the Imaging Society of Japan and the Japan Society of Static Electricity). Thus, a toner produced by the emulsion-aggregation method is formed in a shell-structure, however, the toner surface comprises generally used resins and does not have an innovative structure, and there is a problem that when further lower-temperature fixing is pursued, it is not sufficient in heat resistant storage stability, and environmental charge stability.

In addition, in any of the suspension polymerization method, the emulsion polymerization method, and the emulsion aggregation method, styrene-acrylic resins are typically used, and with the use of polyester resins, it is hard to granulate toner and hard to control particle diameter, particle size distribution, and shape of toner. When further lower-temperature fixing is pursued, there are limitations in fixing property.

Further, aiming for excellent heat resistant storage stability and low-temperature fixing, the use of a polyester modified by urea-bonding has been known (for example, see Japanese Patent Application Laid-Open (JP-A) No. 11-133667), however, the surface of the toner is not particularly contrived, and there is a problem in environmental charge stability under strict conditions.

In the field of electrophotography, obtaining high-quality of image has been studied from various angles. Among these studies, it has been increasingly recognized that making toner in smaller diameter and in a spherical form is extremely effective in obtaining high-quality of image. There seems to be tendencies that with increasingly smaller diameter of toner, transferring property and fixing property are lowered, which leads to poor images. It has been known that transferring property is improved by forming a toner in a spherical shape (for example, see Japanese Patent Application Laid-Open (JP-A) No. 09-258474). In these circumstances, in the fields of color copiers and color printers, further higher-speed image forming is required. To respond to higher-speed image forming, an apparatus employing tandem-type technique is effectively used (for example, Japanese Patent Application Laid-Open (JP-A) No. 05-341617). The tandem-type technique is a technique by which images formed by image forming units are sequentially superimposed and transferred onto a single transferring paper sheet transported by a transferring belt to thereby obtain a full-color image on the transferring paper sheet. A color image forming apparatus based on the tandem-type technique has excellent characteristics of allowing a variety types of transferring paper sheet for use, having high-quality of full-color image, and enabling full-color images at high speeds. In particular, the characteristic which enables obtaining full-color images at high speeds is a characteristic unique to the tandem-type technique. The characteristic is not found in a color image forming apparatus employing other techniques. On the other hand, there have been attempts to achieve high-quality image as well as speeding-up using a toner formed in a spherical shape. To respond to further higher-speeding up, speedy fixing property is required, however, a spherically-shaped toner satisfying excellent fixing property as well as excellent low-temperature fixing property has not yet been realized so far.

In addition, when a toner is stored and delivered after production of the toner high-temperature and high humidity environment, low-temperature and low humidity environment are harsh conditions for the toner. A toner of which toner particles do not flocculate each other during the time of storage, has no degradation or exhibits less degradation in charge property, flowability, transferring property, and fixing property, and excels in storage stability has been required, an effective measure to respond to these requirements, particularly in spherically-shaped toners, has not yet been found so far.

In the mean time, a method is disclosed in which toner particles and inorganic powders such as various types of metallic oxides are mixed for use for the purpose of improving flowability and charge property of toner, and the mixed substance is called as external additives. There have been proposed a method in which treatments are performed with specific silane coupling agents, titanate coupling agents, silicone oil, organic acids, or the like for the purpose of modifying hydrophobic property and charge property of surfaces of the inorganic powders in accordance with the necessity, and a method for coating the inorganic powders with a specific resin. Examples of the inorganic powders known in the art include silicon dioxides (silicas), titanium dioxides (titanias), aluminum oxides, zinc oxides, magnesium oxides, cerium oxides, iron oxides, copper oxides, and tin oxides. Particularly, silica fine particles are frequently used which are obtained by reacting silica and/or titanium oxide fine particles with an organic silicon compound such as dimethyl dichloro silane, hexamethyl disilazan, and silicone oil, then substituting organic groups for silanol groups on surfaces of the silica fine particles and hydrophobizing the surfaces. However, these external additives are embedded in the toner base or liberated from the surface of toner due to mechanical stresses caused in inside of a developing unit with long-term use and when repeatedly used for a number of paper sheets, therefore, flowability and charge property of toner degrades. As a result, it may disenable obtaining proper image density and cause background smear. Thus, giving proper flowability and chargeability to toner base itself becomes an important issue.

SUMMARY OF THE INVENTION

The object of the present invention is, therefore, to provide a developer having a sharp charge amount distribution and bringing out high-quality of image without substantially smearing charging units, developing units, photoconductors, and intermediate transferring members by the developer, namely, a developer capable of providing proper image density and exhibiting extremely little background smear even when used over a long period of time and repeatedly used for a number of sheets of paper, as well as to provide an image forming apparatus for electrophotography using the developer.

In addition, the object of the present invention is to provide a developer which is excellent in flowability and reproductivity against any of transferring media, and enables forming stable images without image blurs, dust, and transferring omissions as well as to provide an image forming apparatus for electrophotography using the developer.

Further, the object of the present invention is to provide a toner capable of keeping cleaning ability, responding to low-temperature fixing systems, and having excellent anti-offset property without smearing fixing units and images.

As a result of keen examinations provided by the inventors of the present invention to solve these problems, it is found that it is possible to obtain toner base particles which is excellent in flowability and charge property hand has a sharp particle size distribution and a sharp charge amount distribution by dispersing at least one or more types of organic fine particles within a toner obtained by dissolving or dispersing a toner composition containing a binder resin which comprises a modified polyester resin capable of reacting with a compound having at least an active hydrogen group in an organic solvent, further dispersing the toner composition or the dispersion liquid in an aqueous medium containing resin fine particles as well as subjecting to an elongation reaction or a cross-linking reaction, then removing the organic solvent from the obtained dispersion liquid, and washing and drying the dispersion liquid.

Measures for solving the above-noted problems are as follows:

<1> A toner for electrophotography produced by dissolving and/or dispersing at least a modified polyester resin capable of reacting with an active hydrogen group-containing compound and colorants in an organic solvent, further dispersing the solution or the dispersion liquid in an aqueous medium to subject the modified polyester resin capable of reacting with the active hydrogen group-containing compound to an elongation and/or a cross-linking reaction, and removing the organic solvent from the obtained dispersion liquid to thereby obtain toner base particles which comprises one or more inorganic fine particles.

<2> The toner for electrophotography according to the item <1>, wherein the solution or the dispersion liquid is dispersed in the presence of a releasing agent in the aqueous medium which comprises resin fine particles.

<3> The toner for electrophotography according to the item <1>, wherein the solution or the dispersion liquid comprises the one or more inorganic fine particles.

<4> The toner for electrophotography according to the item <1>, wherein the one or more inorganic fine particles are added to the aqueous medium.

<5> The toner for electrophotography according to the item <1>, wherein the total amount of the inorganic fine particles obtained by fluorescent x-ray spectroscopy to the toner base particles is 0.1% by mass to 50% by mass.

<6> The toner for electrophotography according to the item <1>, wherein the element concentration derived from the inorganic fine particles on the surfaces of the toner base particles obtained by x-ray photoelectron spectroscopy is 0.1 atomic % to 15 atomic %.

<7> The toner for electrophotography according to the item <1>, wherein the average particle diameter of the primary particles of the inorganic fine particles is 5 nm to 200 nm.

<8> The toner for electrophotography according to the item <1>, wherein the inorganic fine particles comprises a silicon element-containing compound and a metallic element-containing compound.

<9> The toner for electrophotography according to the item <8>, wherein the inorganic fine particles comprises the silicon element-containing compound and a titanium element-containing compound.

<10> The toner for electrophotography according to the item <1>, wherein the inorganic fine particles comprises a silica and/or a titanium oxide.

<11> The toner for electrophotography according to the item <1>, wherein the dielectric constant of the inorganic fine particles is 0.2 to 7.5.

<12> The toner for electrophotography according to the item <1>, wherein the volume average particle diameter Dv of the toner particles is 2 μm to 7 μm, and the ratio Dv/Dn of the volume average particle diameter Dv to the number average particle diameter Dn is 1.25 or less.

<13> The toner for electrophotography according to the item <1>, wherein the average circularity of the toner particles is 0.950 to 0.990 being formed in a substantially spherical shape.

<14> The toner for electrophotography according to the item <1>, wherein the toner base particles are obtained by removing the organic solvent from the obtained dispersion liquid and further subjecting the dispersion liquid to a surface treatment using a fluorine-containing compound.

<15> The toner for electrophotography according to the item <14>, wherein the content of fluorine atoms derived from the fluorine-containing compound in the toner base particles obtained by x-ray photoelectron spectroscopy is 2 atomic % to 30 atomic %.

<16> The toner for electrophotography according to the item <15>, wherein the total amount of the inorganic fine particles in the toner base particles obtained by fluorescent x-ray spectroscopy to the toner base particles is 0.1% by mass to 50% by mass.

<17> The toner for electrophotography according to the item <15>, wherein the element concentration derived from the inorganic fine particles on the surfaces of the toner base particles obtained by x-ray photoelectron spectroscopy is 0.1 atomic % to 15 atomic %.

<18> The toner for electrophotography according to the item <14>, wherein the fluorine-containing compound is represented by the following general formula (1):

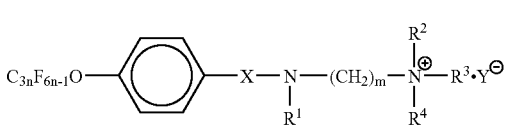

(1)

where X represents —$SO_2$— or —CO—, $R^1$, $R^2$, $R^3$, and $R^4$ independently represent one selected from the group consisting of a hydrogen atom, an alkyl group having 1 to 10 carbon atoms, and aryl groups, Y represents an iodine atom, a bromine atom, or a chlorine atom, and m and n respectively represent an integer of 1 to 10.

<19> The toner for electrophotography according to the item <14>, wherein the content of the resin fine particles to the toner is 0.5% by mass to 5.0% by mass.

<20> The toner for electrophotography according to the item <14>, wherein the mass average molecular mass of the resin fine particles is 9,000 to 200,000.

<21> The toner for electrophotography according to the item <14>, wherein the glass transition temperature Tg of the resin fine particles is 40° C. to 100° C.

<22> The toner for electrophotography according to the item <14>, wherein the resin fine particles comprise one selected from vinyl resins, polyurethane resins, epoxy resins, and polyester resins or in combination with two or more thereof <23> The toner for electrophotography according to the item <14>, wherein the average particle diameter of the resin fine particles is 5 nm to 500 nm.

<24> The toner for electrophotography according to the item <14>, wherein the volume average particle diameter of the toner particles is 3 μm to 8 μm.

<25> The toner for electrophotography according to the item <14>, wherein the ratio Dv/Dn of the volume average particle diameter Dv to the number average particle diameter of the toner particles is 1.25 or less.

<26> The toner for electrophotography according to the item <14>, wherein the average circularity of the toner particles is 0.900 to 0.980.

<27> The toner for electrophotography according to the item <1>, wherein a non-reactive polyester is dispersed together with the modified polyester resin capable of reacting with the active hydrogen group-containing compound in the organic solvent, and the mass ratio of the functional group-containing polyester resin to the non-reactive polyester is 5/95 to 75/25.

<28> A two-component developer comprises a toner for electrophotography, and a carrier comprising magnetic particles, wherein the toner for electrophotography was produced by dissolving and/or dispersing at least a modified polyester resin capable of reacting with an active hydrogen group-containing compound and colorants in an organic solvent, further dispersing the solution or the dispersion liquid in an aqueous medium to subject the modified polyester resin capable of reacting with the active hydrogen group-containing compound to an elongation and/or a cross-linking reaction, and removing the organic solvent from the obtained dispersion liquid to thereby obtain toner base particles which comprises one or more inorganic fine particles.

<29> An image forming apparatus comprises a latent electrostatic image bearing member, a charging unit configured to charge the latent electrostatic image bearing member, a developing unit configured to develop a latent electrostatic image on the electrostatic image bearing member using a developer to form a toner image, and a transferring unit configured to electrostatically transfer the toner image on a transferring material by making the transferring unit contact with the surface of the latent electrostatic image bearing member through the transferring material, wherein the developer comprises a carrier which comprises magnetic particles and a toner for electrophotography, and the toner for electrophotography is produced by dissolving and/or dispersing at least a modified polyester resin capable of reacting with an active hydrogen group-containing compound and colorants in an organic solvent, further dispersing the solution or the dispersion liquid in an aqueous medium to subject the modified polyester resin capable of reacting with the active hydrogen group-containing compound to an elongation and/or a cross-linking reaction, and removing the organic solvent from the obtained dispersion liquid to thereby obtain toner base particles which comprises one or more inorganic fine particles.

<30> The image forming apparatus according to the item <29> further comprises a charging unit by which the charge member is contacted with the latent electrostatic image bearing member so as to apply a voltage to the charge member.

<31> The image forming apparatus according to the item <29> wherein the electrostatic image bearing member is an amorphous silicon electrostatic image bearing member.

<32> The image forming apparatus according to the item <29> further comprising a fixing unit which comprises a heater having a heating element, a film making contact with the heater, and a pressurizing member brought into pressure contact with the heater through the film, in which a recording material with an unfixed image formed thereon is passed through between the film and the pressurizing member to thereby heat and fix the image.

<33> The image forming apparatus according the item <29> wherein the developing unit comprises an electric field applying unit configured to apply an alternate electric field to the latent electrostatic image bearing member.

<34> A process cartridge comprises a latent electrostatic image bearing member, and one or more units selected from a charging unit configured to charge the latent electrostatic image bearing member, a developing unit configured to develop a latent electrostatic image on the latent electrostatic image bearing member using a developer loaded on the developing unit to form a toner image, and a cleaning unit configured to remove a residual toner on the surface of the latent electrostatic image bearing member after transferring, are integrally supported so as to be detachably mounted on an image forming apparatus, wherein the toner is produced by dissolving and/or dispersing at least a modified polyester resin capable of reacting with an active hydrogen group-containing compound and colorants in an organic solvent, further dispersing the solution or the dispersion liquid in an aqueous medium to subject the modified polyester resin capable of reacting with the active hydrogen group-containing compound to an elongation and/or a cross-linking reaction, and removing the organic solvent from the obtained dispersion liquid to thereby obtain toner base particles which comprises one or more inorganic fine particles.

DESCRIPTION OF THE PREFERRED EMBODIMENTS

<Inorganic Fine Particles>

Figure 1:
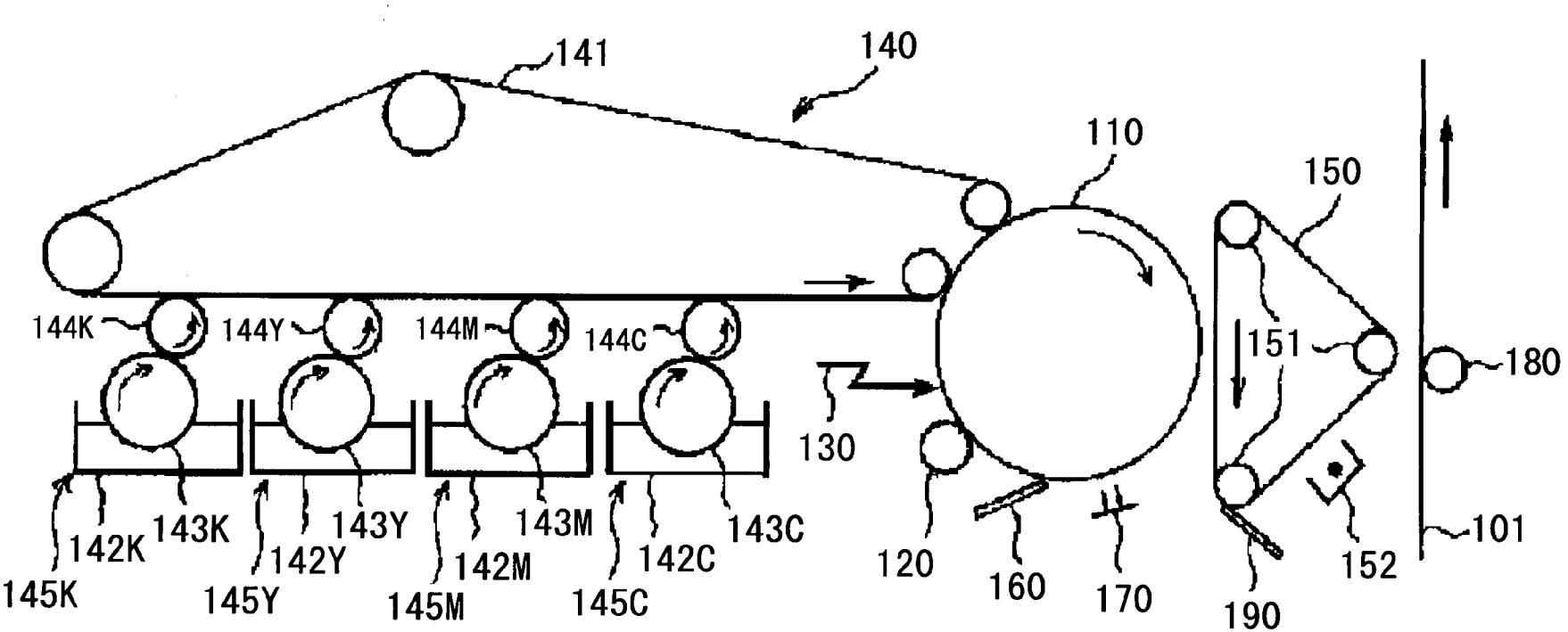
FIG. 1 is a block diagram schematically showing an example of the image forming apparatus of the present invention.

Hereinafter, materials used for producing a toner according to the present invention will be described.

The inorganic fine particles used in the present invention enables stabilizing charge property of toner base particles and restraining reduction in chargeability due to agitation of toner in long period of time in an image developing unit.

The inorganic fine particles exposed on the surfaces of the toner base particles not only prevent external additives from being embedded in the toner base particles but also serve as a lubricant as well as exert excellent flowability.

Examples of the organic fine particles of the present invention include silicas, aluminas, titanium oxides, barium titanates, magnesium titanates, calcium titanates, strontium titanates, zinc oxides, tin oxides, silica sand, clay, mica, wallastonite, silious earth, chrome oxides, cerium oxides, colcothar, antimony trioxides, magnesium oxides, zirconium oxides, barium sulfides, barium carbonates, calcium carbonates, silicon carbides, and silicon nitrides. Among these organic fine particles, silicas and titanium dioxides are particularly preferable.

In addition, as an element for forming organic fine particles, it is possible to preferably use inorganic fine particles which comprise the following metallic elements (dope compounds) included in accordance with the necessity in addition to silicon elements constituting a silicon compound such as a silica. The above stated metallic elements belong to the second group, the third group, and the fourth group of the periodic law, and more preferably, compounds and oxides each of which comprise elements having periodic cycle 3 or more are used. Typically, it is possible to use elements of Mg, Ca, Ba, Al, Ti, V, Sr, Zr, Si, Sn, Zn, Ga, Ge, Cr, Mn, Fe, Co, Ni, Cu, and the like, of which Ti and Zn are more preferably used, and Ti is particularly preferable.

For the inorganic fine particles, those subjected to a surface treatment using a hydrophobizing agent may be used. Preferred examples of the hydrophobizing agent serving as a surface treatment agent include silane coupling agents, silyl agents, silane coupling agents containing an alkyl fluoride, organic titanate coupling agents, and aluminum coupling agents.

In addition, a sufficient effect can be obtained with the inorganic fine particles in which a silicone oil is used as a hydrophobizing agent.

The dielectric constant of the inorganic fine particles is preferably 0.2 to 7.5, more preferably 1.3 to 3.5, and still more preferably 1.7 to 2.5. With the inorganic fine particles having a dielectric constant within the range, it is possible to keep the accumulated amount of charge appropriately and to obtain an effect of restraining excessive increases in charge property under low-temperature and low-humidity conditions. In this way, stable images can be provided.

In the measurements of dielectric constants of inorganic fine particles used in the present invention, the inorganic fine particles are included in a cylindrical cell having an inner diameter of 18 mm with an electrode applied thereto and then measured in a condition where the inorganic fine particles are pressed and solidified in a discotic shape with a thickness of 0.65 mm and a diameter of 18 mm, in the cell using a dielectric loss measuring instrument (TR-10C, manufactured by Ando Electric Co., Ltd.). The frequency of the dielectric loss measuring instrument was 1 KHz, and the frequency ratio was $11\times10^{-9}$.

The inorganic fine particles can be easily included into the toner by adding the inorganic fine particles to a toner composition solution or a dispersion liquid prepared in the course of the toner production of the present invention.

It is also possible to include inorganic fine particles into the toner by adding the inorganic fine particles to an aqueous medium which comprises resin fine particles prepared in the course of the toner production method of the present invention, however, in this case, it is preferred to use inorganic fine particles which are subjected to the above-noted hydrophobization treatment.

The content of the inorganic fine particles in the toner base particles is 0.1% by mass to 50% by mass to the toner, preferably 0.5% by mass to 10% by mass. Within the ranges of the content, it is possible to exert more of the effect of the present invention.

With a content of the inorganic fine particles within the above range, it is possible to make the toner base particles have excellent charge property, and there is an effect of preventing reduction in chargeability due to varied and liberated external additives when the toner is strongly agitated and then deteriorated. Further, inorganic fine particles exposed on surface of the toner enables satisfactorily exerting an effect as a lubricant and making the toner have excellent flowability.

When the content of the inorganic fine particles in the toner base particles is smaller than 0.1% by mass, it is hard to sufficiently exert chargeability and flowability. On the other hand, when the content is greater than 50% by mass, it is not preferable because the amount of the inorganic fine particles exposed on surface of the toner increases, resulting in not only degraded in circularity of toner particles but also causing the problems that the inorganic fine particles exposed on surface of the toner work as a fixing inhibitor to raise the lower limit of fixing temperature and impair low-temperature fixing property.

The content of the inorganic fine particles in the toner base particles was measured by the fluorescent x-ray spectroscopy. An analytical curve was preliminarily prepared by the fluorescent x-ray spectroscopy through the use of the toner base particles of which the content of the inorganic fine particles had been clarified. By using the analytical curve, the content of the inorganic fine particles in the toner base particles was calculated.

The measurements were enabled using a fluorescent x-ray spectrometer, ZSX-100E (manufactured by RIGAKU Corporation). When two or more types of inorganic fine particles were used, the total of the analyzed values of the content of respective types of the inorganic fine particles were measured as the content of inorganic fine particles in the toner base particles.

The inorganic fine particles with a certain amount thereof residing in the vicinity of surfaces of toner base particles enable imparting an effect in charge stability and flowability of the toner and preventing external additives being embedded in the toner base particles. The amount of inorganic fine particles residing on surfaces of the toner base particles was measured as follows.

The XPS (x-ray photoelectron spectroscopy) was used in the measurements. In the present invention, specifically, the area of approx. several nanometers from the surface of the toner was measured. The measurement method, the type of measurement instrument, conditions, or the like are not particularly limited, provided that the same results can be obtained under the same conditions, however, the following conditions are preferably used:

Measuring instrument: x-ray photoelectron spectrometer 1600S, manufactured by Philips Electronics N.V.

X-ray source: MgKα (400 W)

Analyzed area: 0.8×2.0 mm

Pretreatment: A sample was placed into an aluminum tray and then bound to a sample holder with a carbon sheet for measurement.

Calculation of surface atomic density: Relative sensitivity coefficients provided by Philips Electronics N.V. were used.

The results of the measurements were represented by atomic %.

When two or more types of inorganic fine particles were used, the total of densities of the elements originating in respective inorganic fine particles were measured and taken as the analyzed value.

According to the analyzed results in accordance with the above-noted method, in toner base particles, the effect of the present invention can be further effectively exerted when the density of the elements originating in the inorganic fine particles obtained by x-ray photoelectron spectroscopy is 0.1 atomic % to 15 atomic %, and more preferably 0.5 atomic % to 5 atomic %.

When the density of the elements is less than 0.1 atomic %, it is hard to exert an effect in charge stability, flowability of the toner, and restraining embedding of external additives in toner particles. On the other hand, when the element density is more than 15 atomic %, it is unfavorable because the lower limit of fixing temperature is raised, and the low-temperature fixing property is impaired.

The average particle diameter of the primary particles of the inorganic fine particles is preferably 5 nm to 200 nm, and more preferably 10 nm to 180 nm. By controlling a particle diameter within the range, the spacer effect which is a capability of preventing flocculation of toner can be sufficiently exerted, and the toner can effectively prevent external additives from being embedded in toner particles when stored at high temperatures or strongly agitated and deteriorated.

When the average particle diameter of the primary particles of the inorganic fine particles is smaller than 5 nm, the toner is easily flocculated and the external additives are easily embedded into the toner particles. When the average particle diameter of the primary particles of the inorganic fine particles is greater than 200 nm, it is unfavorable because not only circularity of the toner particles degrades, but also the lower limit of fixing temperature is raised, and low-temperature fixing property is impaired.

When those two or more inorganic fine particles are used in a toner for electrostatic developing, each of these inorganic fine particles may be used alone or in combination with two or more.

The average particles diameter herein means the number average particle diameter. The particle diameter of the inorganic fine particles used in the present invention can be measured by a particle size distribution measurement instrument utilizing dynamic light scattering, for example, DLS-700 manufactured by OTSUKA ELECTRONICS CO., LTD. and Coulter N4 manufactured by Coulter Electronics Ltd. However, since it is difficult to dissociate secondarily flocculated particles after treatment using silicone oil, it is preferred to directly obtain the particle diameter of the inorganic fine particles using pictures obtained by a scanning electron microscope or a transmission electron microscope. In this case, at least 100 pieces of inorganic fine particles should be observed to obtain the average value of the particle diameters.

<Aqueous Medium>

In the present invention, for the aqueous medium in which hereinafter described resin particles are dispersed to form an aqueous medium phase, water may be used alone or a solvent capable of being miscible in water may be used. Examples of the water-miscible solvents include alcohols such as methanol, isopropanol, and ethylene glycol; dimethylformamide; tetrahydrofuran; and Cellosolves; and lower ketones such as acetone, methyl ethyl ketone. Each of these solvents may be used alone or in combination with two or more.

<Resin Fine Particles>

The resin fine particles used in the present invention are absorbed to surfaces of oil droplets of the toner composition solution or the dispersion liquid in the aqueous medium, and the resin fine particles are used for controlling the toner shape including circularity and particle size distribution of the toner. The inorganic fine particles are considered, as hereinafter described, that when an organic solvent phase and an active hydrogen group-containing compound (amines) are dispersed in the aqueous medium and organic substance-dispersed particles are formed, surface area of the organic substance-dispersed particles are bound each other to thereby yield the inorganic fine particles. For this reason, as is the case with hereinafter described external additives, it is considered that the inorganic fine particles primarily reside on surface areas of the toner base particles to be obtained.

In the present invention, the amount of the resin fine particles contained in the toner particles after treatment with the obtained external additives must be set in 0.5% by mass to 5.0% by mass, and it is important. When the content is less than 0.5% by mass, storage stability of the toner degrades, and blocking occurs in the image developing unit during the storage. When the residual amount of the resin fine particles in the toner particles is more than 0.5% by mass, the resin fine particles inhibit exudation of wax, and effect of releasing property of the wax cannot be obtained, and offset occurs.

The resin fine particles used in the present invention make it a condition that the glass transition temperature (Tg) is 40° C. to 100° C. When the glass transition temperature (Tg) is less than 40° C., storage stability of the toner degrades, and blocking occurs in the image developing unit during the storage. When the glass transition temperature (Tg) is more than 100° C., resin fine particles inhibit adhesion property to a fixing paper sheet, and the lower limit of fixing temperature is raised. The glass transition temperature (Tg) of the resin fine particles is preferably 40° C. to 100° C., and more preferably 50° C. to 70° C.

The average mass molecular mass is preferably 200,000 or less, and more preferably 50,000 or less. The lower limit value of the average mass molecular mass is typically 4,000, and preferably 9,000. When the average mass molecular mass is 200,000 or more, adhesion property between the resin fine particles and a fixing paper sheet is inhibited.

For the resin fine particles, resins known in the art may be used, provided that the resin can form an aqueous dispersion product, and thermoplastic resins and thermosetting resins may be used. Examples of the resin fine particles include vinyl resins, polyurethane resins, epoxy resins, polyester resins, polyamide resins, polyimide resins, silicon resins, phenol resins, polycarbonate resins, melamine resins, urea resins, aniline resins, ionomer resins, and polycarbonate resins. Each of these resins may be used alone or in combination of two or more.

Of these resins, vinyl resins, polyurethane resins, epoxy resins, polyester resins, or resins combined thereof are preferably used from the perspective that an aqueous dispersion product of resin particles formed in a microscopically spherical shape is easily obtained. Examples of the vinyl resins include polymers of monopolymerized vinyl monomers or copolymerized vinyl monomers such as styrene-(meth)acrylic ester resins, styrene-butadiene copolymers, (meth)acrylic acid-acrylic ester polymers, styrene-acrylonitrile copolymers, styrene-maleic anhydride copolymers, and styrene-(meth)acrylic acid copolymers. In the resin fine particles, the average particle diameter of the resin is preferably 5 nm to 200 nm, and preferably 20 nm to 300 nm.

<Organic Solvent>

The organic solvent used in producing the toner of the present invention is not particularly limited, provided that the organic solvent can dissolve and/or disperse the toner composition.

The organic solvent is preferred to be volatile organic solvent having melting point of 150° C. or less, from the perspective of easy removal of the solvent.

Specific examples of materials used for the organic solvent include toluene, xylene, benzene, carbon tetrachloride, methylene chloride, 1,2-dichloroethane, 1,1,2-trichloroethane, trichloroethylene, chloroform, monochlorobenzene, methylacetate, ethylacetate, methyl ethyl ketone, acetone, tetrahydrofuran. Each of them may be used alone or in combination with two or more.

The amount of the use of the organic solvent relative to 100 parts of the toner composition is typically 40 parts to 300 parts, preferably 60 parts to 140 parts, and more preferably 80 parts to 120 parts.

<Modified Polyester Capable of Reacting with an Active Hydrogen Group-containing Compound>

Next, the modified polyester capable of reacting with an active hydrogen group-containing compound will be described.

Examples of the modified polyester resin capable of reacting with an active hydrogen group-containing compound (RMPE), hereinafter, polyester resin may be referred to as polyester, simply, include polyester prepolymers having a functional group reacting with an active hydrogen such as isocyanate group.

The polyester prepolymer which is preferably used in the present invention is an isocyanate-group containing polyester prepolymer (A). The isocyanate-group containing polyester prepolymer (A) is a polycondensation product between polyol (PO) and polycarboxylic acid (PC) and produced by reacting polyisocyanate (PIC) with an active hydrogen-containing polyester.

Examples of the active hydrogen group included in the polyester include hydroxyl group such as alcoholic hydroxyl group and phenolic hydroxyl group, amino group, carboxyl group, and mercapto group, of which alcoholic hydroxyl group is preferable.

Examples of the polyol include diol (DIO), and trivalent or more polyols (TO), and diol (DIO) used alone, or a mixture of diol (DIO) with a small amount of trivalent or more polyols (TO) are preferably used.

Examples of the diol (DIO) include alkylene glycols such as ethylene glycol, 1,2-propylene glycol, 1,3-propylene glycol, 1,4-butandiol, and 1,6-hexanediol; alkylene ether glycols such as diethylene glycol, triethylene glycol, dipropylene glycol, polyethylene glycol, polypropylene glycol, and polytetramethylene ether glycol; alicyclic diols such as 1,4-cyclohexane dimethanol, and hydrogenated bisphenol A; bisphenols such as bisphenol A, bisphenol F, and bisphenol S; alkylene oxide adducts of the alicyclic diols such as ethylene oxides, propylene oxides, butylene oxides; and alkylene oxide adduct of the bisphenols such as ethylene oxides, propylene oxides, and butylene oxides.

Among the above mentioned, alkylene glycols having 2 to 12 carbon atoms and alkylene oxide adducts of bisphenols are preferable, and alkylene oxide adducts of bisphenols and mixtures of the alkylene oxide adducts of bisphenols with alkylene glycols having 2 to 12 carbon atoms are particularly preferable.

Examples of the trivalent or more polyols (TO) include trivalent to octavalent or more polyaliphatic alcohols such as glycerine, trimethylol ethane, trimethylol propane, pentaerythritol, and sorbitol; trivalent or more polyphenols such as trisphenol PA, phenol novolac, and cresol novolac; and alkylene oxide adducts of the trivalent or more polyphenols.

Examples of the polycarboxylic acid (PC) include dicarboxylic acids (DIC), and trivalent or more polycarboxylic acids (TC), and DIC alone or a mixture of dicarboxylic acids (DIC) and a small amount of the trivalent or more polycarboxylic acid are preferably used.

Examples of the dicarboxylic acids include alkylene dicarboxylic acids such as succinic acids, adipic acids, and sebacic acids; alkenylen dicarboxylic acids such as maleic acids, and fumaric acids; and aromatic dicarboxylic acids such as phthalic acids, isophthalic acids, terephthalic acids, and naphthalene dicarboxylic acids. Among them, alkenylen dicarboxylic acids having 4 to 20 carbon atoms and aromatic dicarboxylic acids having 8 to 20 carbon atoms are preferable.

Examples of the trivalent or more polycarboxylic acids (TO) are aromatic polycarboxylic acids having 9 to 20 carbon atoms such as trimellitic acids, and pyromellitic acids. For the polycarboxylic acids (PC), acid anhydrides selected from those above mentioned or lower alkyl esters such as methyl esters, ethyl esters, and isopropyl esters may be used to react with the polyol (PO).

The mixture ratio between the polyols (PO) and the polycarboxylic acids (PC) represented as the equivalent ratio [OH]/[COOH] of hydroxy group [OH] content in the polyols (PO) to carboxyl group [COOH] content in the polycarboxylic acids (PC) is typically 2/1 to 1/1, preferably 1.5/1 to 1/1, and more preferably 1.3/1 to 1.02/1.

Examples of the polyisocyanate (PIC) used for preparing the modified polyester (polyester prepolymer) capable of reacting an active hydrogen group-containing compound include aliphatic polyisocyanates such as tetramethylen diisocyanate, hexamethylene diisocyanate, and 2,6-diisocyanato methyl caproate; alicyclic polyisocyanates such as isophorone diisocyanate, and cyclohexyl methane diisocyanate; aromatic diisocyanates such as tolylene diisocyanate, and diphenylmethane diisocyanate; aromatic aliphatic diisocyanates such as α,α,α',α'-tetramethyl xylylene diisocyanate; isocyanurates; polyisocyanates of which the above-noted isocyanates are blocked with phenol derivatives, oximes, and caprolactams; and polyisocyanates of which each of the above-noted used in combination with two or more.

For the mixture ratio of the polyisocyanate, for example, the equivalent ratio [NCO]/[OH] of isocyanate group [NCO] content in the polyisocyanate (PIC) to hydroxy group [OH] content in the hydroxy-containing polyester is typically 5/1 to 1/1, preferably 4/1 to 1.2/1, and more preferably 3/1 to 1.5/1.

When the ratio [NCO]/[OH] is more than 5, low-temperature fixing property degrades, and when the molar ratio of [NCO] is less than 1, anti-offset property degrades due to reduced urea content in the modified polyester. The content of polyisocyanate (PIC) component in the isocyanate-terminated prepolymer (A) is typically 0.5% by mass to 40% by mass, preferably 1% by mass to 30% by mass, and more preferably 2% by mass to 20% by mass.

When the content is less than 0.5% by mass, anti-hot-offset property degrades, and it is disadvantageous in coping with both heat resistant storage stability and low-temperature fixing property. When the content is more than 40% by mass, low-temperature fixing property tends to degrade.

The number of isocyanate group contained in per molecule in the isocyanate-group containing polyester prepolymer (A) is typically one or more, preferably 1.5 to 3 on average, and more preferably 1.8 to 2.5 on average. When the number of isocyanate group per molecule is less than 1, the molecular mass of urea-modified polyester decreases, resulting in degraded anti-hot-offset property.

<Active Hydrogen Group-containing Compound>

It is possible to obtain a urea-modified polyester resin (UMPE) by reacting the isocyanate-group containing polyester prepolymer (A) with amines (B). The urea-modified polyester resin efficiently functions as a toner binder.

Examples the amines (B) include diamines (B1), trivalent or more polyamines (B2), aminoalcohols (B3), aminomercaptans (B4), amino acids (B5), and compounds (B6) in which any of the amino groups B1 to B5 is blocked. Examples of the diamine (B1) include aromatic diamines such as phenylene diamine, diethyl toluene diamine, and 4,4'-diamino diphenyl methane; alicyclic diamines such as 4,4'-diamino-3,3'-dimethyl dicyclohexyl methane, diamine cyclohexane, and isophorone diamine, and aliphatic diamines such as ethylene diamine, tetramethylene diamine, and hexamethylene diamine.

Examples of the trivalent or more polyamines (B2) include diethylene triamine, and triethylene tetramine.

Examples of the aminoalcohols (B3) include ethanol amine, and hydroxyethylaniline. Examples of the amino mercaptans (B4) include aminoethyl mercaptan, and aminopropyl mercaptan. Examples of the amino acids (B5) include aminopropionic acids, aminocaproic acids.

Examples of the compounds (B6) in which the amino groups B1 to B5 are blocked include ketimine compounds which are obtained from any of the above-noted amines B1 to B5 and ketones such as acetones, methyl ethyl ketones, and methyl isobutyl ketones, and oxazolidone compounds. Of these amines (B), (B1) alone and mixtures of (B1) and a small amount of (B2) are preferable.

Further, in accordance with the necessity, the molecular mass of the modified polyester such as urea-modified polyester can be adjusted by using an elongation stopper.

Examples of the elongation stopper include monoamines such as diethylamines, dibutylamines, butylamines, and lauryl amines or compounds in which any of these monoamines are blocked or ketimine compounds.

For the mixture ratio of the amines (B) to the isocyanate-group containing polyester prepolymer (A), the equivalent ratio [NCO]/[NHx] of the isocyanate group [NCO] in the isocyanate-group containing polyester prepolymer (A) to the amino group [NHx] in the amines (B) is typically 1/2 to 2/1, preferably 1.5/1 to 1/1.5, and more preferably 1.2/1 to 1/1.2.

When the equivalent ratio [NCO]/[NHx] is more than 2 or less than ½, the molecular mass of the urea-modified polyester is reduced, resulting in degraded anti-hot-offset property. In the present invention, urethane-binding may be contained with urea-binding in the urea-modified polyester.

The molar ratio of the urea-binding content to the urethane-binding content in the urea-modified polyester is typically 100/0 to 10/90, preferably 80/20 to 20/80, and more preferably 60/40 to 30/70. The molar ratio of the urea-binding content is less than 10%, anti-hot-offset property degrades.

The urea-modified polyester used in the present invention is produced by one-shot method or prepolymer method.

The average mass molecular mass of the modified polyester such as a urea modified polyester is preferably 10,000 or more, more preferably 20,000 to 10,000,000, and more preferably 30,000 to 1,000,000. When the average mass molecular mass is less than 10,000, anti-hot-offset property degrades.

The number average molecular mass of urea-modified polyester or the like is not particularly limited when hereinafter described unmodified polyester is used, and it may be the number average molecular mass of the urea-modified polyester with which the above-noted mass average molecular mass is easily obtained.

When a modified polyester such as urea-modified polyester is used alone, the number average molecular mass is typically 20,000 or less, preferably 1,000 to 10,000, and more preferably 2,000 to 8,000. When the number average molecular mass is more than 20,000, low-temperature fixing property of the toner and glossiness of the toner when used in a full-color apparatus tend to degrade.

<Unmodified Polyester>

In the present invention, it is possible to use not only a modified polyester (MPE) such as the polyester modified by urea binding alone but also to use an unmodified polyester (PE) as a toner binder component together with the modified polyester (MPE).

By using an unmodified polyester (PE) in combination with a modified polyester (MPE), low-temperature fixing property of the toner and glossiness of the toner when used in a full-color unit are improved, and combination use of PE and MPE is preferable to being used alone.

Examples of the unmodified polyester (PE) include polycondensation products between polyols and polycarboxylic acids, which are same as those of polyester components of the modified polyester (MPE). Preferred unmodified polyesters are also same as those of the modified polyester (MPE).

The unmodified polyester (PE) may include not only unmodified polyesters but also polyesters modified by chemical binding other than urea-binding, for example, it may be polyesters modified by urethane-binding.

It is preferred that the modified polyester (MPE) be partially compatible with the unmodified polyester (PE) from the perspective of low-temperature fixing property and anti-hot-offset property. Thus, it is preferred that the composition of the modified polyester (MPE) components be similar to that of the unmodified polyester (PE) components.

The mass ratio of the modified polyester (MPE) and the unmodified polyester (PE) when PE is used in combination with MPE is typically 5/95 to 80/20, preferably 5/95 to 30/70, more preferably 5/95 to 25/75, and still more preferably 7/93 to 20/80.

When the mass ratio of the modified polyester (MPE) is less than 5%, anti-hot-offset property may degrade, and it may be disadvantageous in obtaining satisfactory heat resistant storage stability and low-temperature fixing property.

The peak molecular mass of the unmodified polyester (PE) measured by gel permeation chromatography (GPC) is typically 1,000 to 30,000, preferably 1,500 to 10,000, and more preferably 2,000 to 8,000. When the peak molecular mass is less than 1,000, heat resistant storage stability degrades, and when the peak molecular mass is more than 30,000, low-temperature fixing property degrades. The hydroxy group value of the unmodified polyester (PE) is preferably 5 or more, more preferably 10 to 120, and still more preferably 20 to 80.

When the hydroxy group value of the unmodified polyester (PE) is less than 5, it is disadvantageous in obtaining satisfactory heat resistant storage stability and low-temperature fixing property. The acid value of the unmodified polyester (PE) is typically 1 to 30, and preferably 5 to 20. By making the unmodified polyester (PE) have an acid value, the toner tends to have negative electric charge. A toner which contains an unmodified polyester (PE) having an acid value more than 30 is liable to be affected by the environments under high-temperature and high-humidity conditions and low-temperature and low-humidity conditions and easily cause degradation of images.

<Characteristics of Toner Binder>

In the present invention, the glass transition temperature (Tg) of a binder (toner binder) in the toner is typically 40° C. to 70° C., preferably 50° C. to 70° C., and more preferably 55° C. to 65° C. In a toner in which the toner particle surfaces are treated with a fluorine-containing compound, the glass transition temperature (Tg) of the toner binder is preferably 45° C. to 55° C.

When the glass transition temperature (Tg) is less than 40° C., heat resistant storage stability of the toner degrades, and when the glass transition temperature (Tg) is more than 70° C., low-temperature fixing property of the toner is insufficient.

In a dry toner of the present invention, by making a modified polyester such as a urea-modified polyester exist together with an unmodified polyester, the toner shows excellent tendency of heat resistant storage stability even when the glass transition temperature is low, compared to polyester toners known in the art.

For the storage elastic modulus of the toner binder, the temperature (TG') at which the storage elastic modulus of the toner binder at a measurement frequency of 20 Hz is 10,000 dyne/cm$^2$ is typically 100° C. or more, and preferably 110° C. to 200° C.

When the temperature (TG') of the toner binder is less than 100° C., anti-hot-offset property degrades. For the viscosity of the toner binder, the temperature (Tη) of the toner binder at which the viscosity of the toner binder at a measurement frequency of 20 Hz is 1,000 poise is typically 180° C. or less, and preferably 90° C. to 160° C. When the temperature (Tη) of the toner binder is more than 180(Tη) of the toner binder, low-temperature fixing property degrades.

Thus, from the perspective of obtaining satisfactory low-temperature fixing property and anti-hot-offset property, the temperature (TG') is preferably higher than the temperature (Tη). In other words, the difference in temperature between TG' and Tη (TG'−Tη) is preferably 0° C. or more, more preferably 10° C. or more, and still more preferably 20° C. or more. The upper limit of the difference in temperature between TG' and Tη (TG'−Tη) is not particularly limited.

Further, from the perspective of coping with both heat resistant storage stability and low-temperature fixing property, the difference in temperature between TG' and Tη (TG'−Tη) is preferably 0° C. to 100° C., more preferably 10° C. to 90° C., and still more preferably 20° C. to 80° C.

For the colorants used in the present invention, dyes and pigments known in the art can be used, and examples thereof include carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, lithopone, and mixtures thereof.

The content of colorants to the toner is typically 1% by mass to 15% by mass, and preferably 3% by mass to 10% by mass.

The colorants used in the present invention may be used as a complex masterbatch compound with resins.

Example of binder resins kneaded in the course of production of the masterbatch or kneaded together with the masterbatch include, besides the above-mentioned modified polyester resins and unmodified polyester resins, styrenes such as styrene polystyrenes, poly-p-chlorostyrenes, and polyvinyl toluenes or polymers of derivative substitution thereof; styrene copolymers such as styrene-p-chlorostyrene copolymers, styrene-propylene copolymers, styrene-vinyltoluene copolymers, styrene-vinylnahthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymer, styrene-acrylonitrile copolymers, styrene-vinylmethyl-keton copolymers, styrene-butadiene copolymers, styrene-isoprene copolymers, styrene-acrylonitrile-indene copolymers, styrene-maleic acid copolymers, and styrene-ester maleate copolymers; polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic resins, rosins, modified rosins, terpene resins, aliphatic or alicyclic hydrocarbon resins, aromatic petroleum resins, chlorinated paraffins, and paraffin waxes. Each of these binder resins may be used alone or in combination with two or more.

The masterbatch may be produced by applying a high shearing force to the resins for the masterbatch and the colorants and mixing or kneading the components.

Here, to improve the interaction between the colorants and the resins, an organic solvent may be added thereto.

Besides, a so-called flashing process is preferably employed, because in the flashing process, a wet cake of colorants can be directly used without the necessity of drying. In the flashing process, a colorant-water-paste containing water is mixed and kneaded with resins and an organic solvent to transfer the colorants to the resins and then to remove the moisture and the organic solvent components.

For the mixing and kneading, a high shearing dispersion unit such as a triple roll mill is preferably used. The colorants or the masterbatch can be dissolved or dispersed in the above-noted organic solvent phase, however, the timing of the dissolution and dispersion is not limited thereto.

<Releasing Agents>

To the toner of the present invention, releasing agents as typified by waxes may be included together with the toner binder and the colorants.

Waxes known in the art may be used in the toner, and examples thereof include polyolefin waxes such as polyethylene waxes, and polypropylene waxes; long-chain hydrocarbons such as paraffin waxes, and sazol waxes; and carbonyl group-containing waxes. Among them, carbonyl group-containing waxes are preferably used. Examples of the carbonyl group-containing waxes include polyalkanoic acid esters such as carnauba waxes, montan waxes, trimethylolpropane tribehenate, pentaerythritol tetrabehenate, pentaerythritol diacetate dibehenate, glycerin behenate, and 1,18-octadecandiol distearate; polyalkanol esters such as tristearyl trimellitate, and distearyl maleate; polyalkanoicamides such as ethylene diamine dibehenylamides; polyalkylamides such as tristearylamide trimellitate; and dialkylketones such as distearylketone.

Of these carbonyl group-containing waxes, polyalkanoic acid esters are preferably used.

The melting point of the wax used in the present invention is typically 40° C. to 160° C., preferably 50° C. to 120° C., and more preferably 60° C. to 90° C. A wax having a melting point less than 40° C. is liable to negatively affect heat resistant storage stability, and a wax having a melting point more than 160° C. is liable to cause cold offset in fixing at low temperatures.

The melting viscosity of the wax is preferably 5 cps to 1,000 cps as a measurement value at a temperature 20° C. higher than the melting point, and more preferably 10 cps to 100 cps. A wax having a melting viscosity more than 1,000 cps is ineffective in enhancing the effects of anti-hot-offset property and low-temperature fixing property.

The content of the wax in the toner is typically 0% by mass to 40% by mass, and preferably 3% by mass to 30% by mass.

<Charge Controlling Agent>

In the toner of the present invention, a charge controlling agent can be included in accordance with the necessity. For the charge controlling agent, those known in the art can be used, and examples thereof include nigrosine dyes, triphenylmethane dyes, chrome-containing metallic complex dyes, molybdic acid chelate pigments, rhodamine dyes, alkoxy amines, quaternary ammonium salts such as fluorine-modified quaternary ammonium salts; alkylamides, phosphoric simple substance or compounds thereof, tungsten simple substance or compounds thereof, fluorine activator, salicylic acid metallic salts, and salicylic acid derivative metallic salts. Specifically, examples of the controlling agents include Bontron 03 being a nigrosine dye, Bontron P-51 being a quaternary ammonium salt, Bontron S-34 being a metal-containing azo dyes, Bontron E-82 being an oxynaphthoic acid metal complex, Bontron E-84 being a salicylic acid metal complex, and Bontron E-89 being a phenol condensate (manufactured by Orient Chemical Industries, Ltd.); TP-302 and TP-415 being a quaternary ammonium salt molybdenum metal complex (by Hodogaya Chemical Co.); Copy Charge PSY VP2038 being a quaternary ammonium salt, Copy Blue PR being a triphenylmethane derivative, and Copy Charge NEG VP2036 and Copy Charge NX VP434 being a quaternary ammonium salt (by Hoechst Ltd.); LRA-901, and LR-147 being a boron metal complex (by Japan Carlit Co., Ltd.); copper phthalocyanine, perylene, quinacridone, azo pigments, and other high-molecular mass compounds having a functional group such as sulfonic acid group, carboxyl group, and quaternary ammonium salt.

The amount of the charge controlling agent used in the present invention is determined depending on the type of the binder resin, presence or absence of additives used in accordance with the necessity, and the toner production method including the dispersion process and is not limited uniformly, however, preferably, relative to 100 parts by mass of the binder resin, the charge controlling agent is used in the range from 0.1 parts by mass to 10 parts by mass, and more preferably in the range from 0.2 parts by mass to 5 parts by mass.

When the usage amount of the charge controlling agent is more than 10 parts by mass, charge property of the toner is exceedingly large, which reduces the effect of the primarily used charge controlling agent, and electrostatic suction force increases to developing rollers, resulting in lessened flowability of the developer and reduced image density.

The charge controlling agent may be dissolved and dispersed in the toner material after kneading the masterbatch and resins. The charge controlling agent may also be directly added to the organic solvent at the time of dissolving and dispersing the toner material. In addition, the charge controlling agent may be added and fixed onto surfaces of toner particles after producing the toner particles.

<External Additives>

The toner particles used in the present invention are preferably toner particles with external additives adhered on the surfaces thereon in order to supplement flowability, developing property, and charge property of the toner.

As the external additive, inorganic fine particles are preferably used.

The primary particle diameter of inorganic fine particles used for the external additives is preferably 5 nm to 2 μm, and inorganic fine particles having a primary particle diameter of 5 nm to 500 nm are particularly preferable.

The specific surface area according to the BET method is preferably 20 $m^2/g$ to 500 $m^2/g$.

The amount of the inorganic fine particles for the external additives used in the toner is preferably 0.01% by mass to 5% by mass, and more preferably 0.01% by mass to 2.0% by mass.

Specific examples of the inorganic fine particles include silicas, aluminas, titanium oxides, barium titanates, magnesium titanates, calcium titanates, strontium titanates, zinc oxides, tin oxides, silica sand, clay, mica, wallastonite, silious earth, chrome oxides, cerium oxides, colcothar, antimony trioxides, magnesium oxides, zirconium oxides, barium sulfates, barium carbonates, calcium carbonates, silicon carbides, and silicon nitrides.

Examples of external additives other than the above-mentioned include polymeric fine particles, for example, polystyrenes, and methacrylic acid esters obtained by soap-free emulsion polymerization, suspension polymerization, and dispersion polymerization; acrylic acid ester copolymers; and polymer particles based on polycondensation resins and thermosetting resins such as silicones, benzoguanamines, and nylons.

By subjecting the external additives stated above to a surface treatment to enhance hydrophobic property thereof, it is possible to prevent degradation of flowability and charge property of the toner even under high-humidity conditions.

Preferred examples of surface treatment agents include silane coupling agents, silyl agents, silane coupling agents having a fluoro-alkyl group, organic titanate coupling agents, aluminum coupling agents, silicone oils, and modified silicone oils.

In addition, to remove a residual developer remaining on a photoconductor and a primary transferring medium after image transfer, cleaning ability improvers may be added as external additives.

Examples of the cleaning ability improvers include metallic salts of fatty acids such as zinc stearates, calcium stearates, and stearic acids; and polymer fine particles produced by means of soap-free emulsion polymerization such as polymethyl methacrylate fine particles, and polystyrene fine particles.

Polymer fine particles having a relatively narrow particle size diameter and an average volume particle diameter of 0.01 μm to 1 μm are preferably used.

<Preparation of Toner Binder>

Next, the toner binder production method will be described.

A polyol and a polycarboxylic acid were heated at temperatures from 150° C. to 280° C. in the presence of an esterification catalyst known in the art such as tetrabutoxytitanate and dibutyltin oxides with reducing pressure in accordance with the necessity to remove produced water to thereby obtain a hydroxyl group-containing polyester. The hydroxyl group-containing polyester was reacted with polyisocyanate at temperatures from 40° C. to 140° C. to obtain an isocyanate-containing prepolymer (A).

Further, the isocyanate-containing prepolymer (A) was reacted with amines (B) at temperatures from 0° C. to 140° C. to obtain a polyester modified by urea-binding. When reacting the polyisocyanate and when reacting the isocyanate group-containing prepolymer (A) with amines (B), a solvent can also be used in accordance with the necessity.

Examples of usable solvents in the reaction include inactive substances to polyisocyanate (PIC) such as aromatic solvents (toluene, and xylene); ketones (acetone, methyl ethyl ketone, and methyl isobutyl ketone); esters (ethyl acetate); amides (dimethylformamide, dimethylacetoamide); and ethers (tetrahydrofuran).

When a polyester unmodified by urea-binding (PE) was used with the urea-modified polyester, the polyester unmodified by urea-binding (PE) was produced in the same manner as in the hydroxyl group-containing polyester and then dissolved in and mixed with the reactant solution of which a reaction of the urea-modified polyester had been completed.

<Preparation of Toner Particles>

In elongation and/or cross-linking reactions used in producing the toner of the present invention, by reacting an active hydrogen group-containing compound (for example, amino-containing diamine compound) with a modified polyester resin capable of reacting with the active hydrogen group-containing compound (for example, isocyanate-containing polyester resin), the resin behaves to at least any one of elongation or cross-linking.

The following paragraph will describe on the detailed production method of the toner of the present invention using the elongation and/or cross-linking reactions in an aqueous medium, however, it will be understood that the present invention is not construed as being limited thereto.

The aqueous medium may be water alone, however, a water-miscible solvent may also be used at the same time. Examples of the water-miscible solvent include alcohols such as methanol, isopropanol, and ethylene glycol; dimethylformamide, tetrahydrofuran, Cellosolves such as methyl cellosolve; and lower ketones such as acetone, and methyl ethyl ketone.

The toner particles can be formed by reacting a dispersion which comprises an isocyanate group-containing prepolymer (A) with amines (B) in an aqueous medium.

For the method for stably forming a dispersion which comprises the urea-modified polyester and the isocyanate group-containing prepolymer (A), for example, there is a method in which a composition of toner initial materials containing the urea-modified polyester and the isocyanate group-containing prepolymer (A) is added to an aqueous medium and dispersed by applying a shearing force thereto.

The isocyanate group-containing prepolymer (A) and other components of the toner composition (hereinafter, referred to as toner initial material) such as colorants, colorants masterbatch, releasing agents, charge controlling agents, and an unmodified polyester resin may be mixed at the same time when the dispersion is formed in the aqueous medium, however, it is preferable that the toner initial material be preliminarily mixed and then the mixture be added to the aqueous medium.

In the present invention, other toner initial materials such as colorants, releasing agents, and charge controlling agents are not necessarily mixed when forming toner particles in the aqueous medium, and they may be added to the aqueous medium after toner particles have been formed in the aqueous medium. For example, toner particles with no colorants included therein are initially formed and then colorants may be added thereto by means of a dyeing method known in the art.

The dispersion method is not particularly limited, and the conventional dispersing units may be used. Examples of the dispersing units include a low-speed-shear dispersing unit, a high-speed-shear dispersing unit, a friction dispersing unit, a high-pressure-jet dispersing unit, an ultrasonic dispersing unit. Among them, a high-speed-shear dispersing unit is preferable in terms of the capability of controlling particle diameter of the dispersion from 2 μm to 20 μm.

When a high-speed-shear dispersing unit is used, the rotation speed is not particularly limited, however, it is typically 1,000 rpm to 30,000 rpm, and preferably 5,000 rpm to 20,000 rpm.

The dispersion time is not particularly limited, and when a batch method is employed, it is typically 0.1 minute to 5 minutes. The dispersion temperature is typically 0° C. to 150° C. under pressures, and preferably 40° C. to 98° C.

The dispersion temperature is preferable to be higher because the viscosity of the dispersion which comprises the urea-modified polyester and the isocyanate group-containing prepolymer (A) lowers, and the dispersion is easily dispersed.

The amount of the aqueous medium to be used relative to 100 parts of the toner composition containing the urea-modified polyester and the isocyanate group-containing prepolymer (A) is typically 50 parts by mass to 2,000 parts by mass, and preferably 100 parts by mass to 1,000 parts by mass. When the usage amount of the aqueous medium is less than 50 parts by mass, dispersed conditions of the toner composition is poor, and toner particles having a predetermined particle diameter cannot be obtained. When the usage amount is more than 2,000 parts by mass, it is costly.

In addition, a dispersant can be preferably used in accordance with the necessity in order to sharpen the particle size distribution of the dispersed particles and to stabilize the dispersed particles.

In the course of synthesis from the isocyanate group-containing prepolymer (A) to the urea-modified polyester, amines (B) may be added to the aqueous medium to be reacted, and then the toner composition be dispersed in the aqueous medium. Alternatively, the toner composition may be dispersed in the aqueous medium, and then amines (B) be added to the aqueous medium to be reacted on particle interface.

In this case, a urea-modified polyester is formed preferentially on the surface of produced toner to enable generating a concentration gradient inside of toner particles.

For dispersants used for emulsifying and dispersing an oil-based phase in which the toner composition is dispersed into a water-containing liquid, there are, for example, anionic surfactants such as alkylbenzene sulphonates, α-olefin sulphonates, and phosphoric esters; cationic surfactants of amine salts such as alkyl amine salts, aminoalcohol fatty acid derivatives, polyamine fatty acid derivatives, and imidazolines, and cationic surfactants of quaternary ammonium salts such as alkyltrimethyl ammonium salts, dialkyldimethyl ammonium salts, alkyldimethyl benzyl ammonium salts, pyridinium salts, alkyl isoquinolinium salts, and benzethonium chlorides; nonionic surfactants such as fatty amide derivatives, and polyvalent alcohol derivatives; for example, alanine, dedecyldi(aminoethyl)glycine, di(octylaminoethyl) glycine; and amphoteric surfactants such as N-alkyl-N,N-dimethyl ammonium betaine.

Further, by using a surfactant having a fluoroalkyl group, it is possible to emulsify and disperse the oil-based phase into the dispersion liquid with an extremely small amount thereof.

Preferred examples of the anionic surfactant having a fluoroalkyl group include fluoroalkyl carboxylic acid having 2 to 10 carbon atoms or metallic salts thereof, disodium perfluorooctanesulfonylglutamate, sodium-3-{omega-fluoroalkyl ($C_6$ to $C_{11}$)oxy}-1-alkyl($C_3$ to $C_4$) sulfonate, sodium-3-{omega-fluoroalkanoyl($C_6$ to $C_8$)-N-ethylamino}-1-propanesulfonate, fluoroalkyl($C_{11}$ to $C_{20}$) carboxylic acid or metallic salts thereof, perfluoroalkyl($C_7$ to $C_{13}$) carboxylic acid or metallic salts thereof, perfluoroalkyl($C_4$ to $C_{12}$) sulfonic acid or metallic salts thereof, perfluorooctanesulfonic acid diethanol amide, N-propyl-N-(2-hydroxyethyl) perfluorooctane sulfone amide, perfluoroalkyl($C_6$ to $C_{10}$) sulfone amide propyltrimethylammonium salts, a salt of perfluoroalkyl ($C_6$ to $C_{10}$)-N-ethylsulfonyl glycine, monoperfluoroalkyl($C_6$ to $C_{16}$)ethylphosphate.

Examples of the commercially available surfactants having a fluoroalkyl group are Surflon S-111, S-112 and S-113 (manufactured by Asahi Glass Co.); Frorard FC-93, FC-95, FC-98 and FC-129 (manufactured by Sumitomo 3M Ltd.); Unidyne DS-101 and DS-102 (manufactured by Daikin Industries, Ltd.); Megafac F-110, F-120, F-113, F-191, F-812 and F-833 (manufactured by Dainippon Ink and Chemicals, Inc.); ECTOP EF-102, 103, 104, 105, 112, 123A, 123B, 306A, 501, 201 and 204 (manufactured by Tohchem Products Co.); Futargent F-100 and F150 (manufactured by Neos Co.).

Examples of the cationic surfactants include primary, secondary or tertiary aliphatic amines having a fluoroalkyl group, aliphatic quaternary ammonium salts such as perfluoroalkyl ($C_6$ to $C_{10}$)sulfoneamide propyltrimethylammonium salt, benzalkonium salt, benzetonium chloride, pyridinium salt, and imidazolinium salt. Specific examples of the commercially available products thereof are Surflon S-121 (manufactured by Asahi Glass Co.), Frorard FC-135 (manufactured by Sumitomo 3M Ltd.), Unidyne DS-202 (manufactured by Daikin Industries, Ltd.), Megaface F-150 and F-824 (manufactured by Dainippon Ink and Chemicals, Inc.), Ectop EF-132 (manufactured by Tohchem Products Co.), and Futargent F-300 (manufactured by Neos Co.).

It is also possible to use water-insoluble inorganic dispersants such as calcium phosphates, calcium carbonates, titanium oxides, colloidal silicas, and hydroxyl apatites.

In addition, polymeric protective colloids may be used to stabilize the dispersed droplets.

Examples of the polymeric protective colloids include acids such as acrylic acids, methacrylic acids, α-cyanoacrylic acids, α-cyanomethacrylic acids, itaconic acids, crotonic acids, fumaric acids, maleic acids, and maleic anhydrides; (meth)acryl monomers having a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl acrylate, 3-chloro-2-hydroxypropyl acrylate, 3-chloro-2-hydroxypropyl methacrylate, diethyleneglycol monoacrylate, diethyleneglycol monomethacrylate, glycerin monoacrylate, glycerin monomethacrylate, N-methylol acrylamido, and N-methylol methacrylamide; vinyl alcohols or esters with vinyl alcohols such as vinyl methyl ethers, vinyl ethyl ethers, and vinyl propyl ethers; or esters of vinyl alcohol and a compound having a carboxyl group such as vinyl acetates, vinyl propionates, and vinyl butyrates; amide compounds or methylol compounds thereof such as acryl amides, methacryl amidse, diacetone acrylic amide acids, or methylols thereof; chlorides such as acrylic chlorides, and methacrylic chloride; honopolymers or copolymers having a nitrogen atom or heterocyclic ring thereof such as vinyl pyridines, vinyl pyrrolidone, vinyl imidazole, and ethylene imine;

polyoxyethylenes such as polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylarylphenyl ester, and polyoxyethylene nonylphenyl ester, and celluloses such as methyl cellulose, hydroxyethyl cellulose, and hydroxypropyl cellulose.

When the dispersion stabilizer is used, calcium phosphate is dissolved by acids such as hydrochloric acid and then washed with water or decomposed by an enzyme to thereby remove calcium phosphate from fine particles.

When dispersants are used, they may be left to remain on surfaces of the toner particles, however, it is preferred that the dispersants be washed and removed after the elongation and/or cross-linking reaction from the perspective of charge property of the toner.

The reaction time for elongation and/or cross-linking is selected depending on reactivity in accordance with the combination of the structure of the isocyanate group contained in the isocyanate group-containing prepolymer (A) and amines (B), however, the reaction time is typically 10 minutes to 40 hours, and preferably 2 hours to 24 hours. The reaction temperature is typically 0° C. to 150° C., and preferably 40° C. to 98° C. Conventional catalysts may be used in accordance with the necessity, and specific examples thereof include dibutyltin laurate, and octyltin laurate.

Further, to lower the viscosity of the liquid with the toner composition contained therein, it is also possible to use a solvent capable of dissolving the urea-modified polyester and the isocyanate group-containing prepolymer (A).

It is preferred to use the solvent from the perspective that particle size distribution of the toner is sharpened. It is preferable that the solvent be a volatile organic solvent having a boiling point of less than 100° C. in view of easy removal from the solution or dispersion.

Examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methyl ethyl ketone, methyl isobutyl ketone, and each of these solvents may be used alone or in combination with two or more. Of these solvents, aromatic solvents such as toluene, xylene; and halogenated hydrocarbons such as methylene chloride, 1,2-dichloroethane, chloroform, carbon tetrachloride are particularly preferable. The usage amount of the solvent relative to 100 parts of the isocyanate group-containing prepolymer (A) is typically 0 parts to 300 parts, preferably 0 parts to 100 parts, and more preferably 25 parts to 70 parts. When the solvent is used, the solvent is heated under normal pressure or reduced pressure to be removed from the solution or dispersion after reaction of elongation and/or cross-linking.

When amines (B) are reacted as a cross-linker and/or elongation reactant with the modified polyester capable of reacting with an active hydrogen group-containing compound, the reaction time for the elongation and/or cross-linking is selected depending on reactivity in accordance with the combination of the structure of the isocyanate group contained in the isocyanate group-containing prepolymer (A) and amines (B), however, the reaction time is typically 10 minutes to 40 hours, and preferably 2 hours to 24 hours.

The reaction temperature is typically 0° C. to 150° C., and preferably 40° C. to 98° C.

Further, conventional catalysts may be used in accordance with the necessity, and examples thereof include dibutyltin laurate, and octyltin laurate.

To obtain a toner formed in a desired shape, for example, an aqueous solution (aqueous phase) to which a thickener and an activator or the like are added is mixed with the emulsified dispersion liquid (oil phase), and then it is possible to change the shape of the emulsified particles by applying a shearing force to the mixture solution using a shearing unit such as homomixer, and Ebara Milder and utilizing difference in viscosity between the oil phase and the aqueous phase.

The conditions in the above process can be controlled by optimizing the way of adjusting the shearing force of a shearing unit, for example, processing time, and the number of processed time, or the way of adjusting difference in viscosity between the oil phase and the aqueous phase, for example, density and temperature of the water-insoluble organic solvent in the oil phase, and thickener, activator in the aqueous phase, and the temperature thereof.

To remove the organic solvent from the obtained emulsified dispersion liquid, it is possible to employ a method in which the entire system is raised gradually so as to completely evaporate and remove the organic solvent in the droplets.

Alternatively, it is also possible to spray the emulsified dispersion in dry atmosphere and completely remove the water-insoluble organic solvent in the droplets to form toner fine particles to thereby evaporate and remove the aqueous dispersants at the same time.

For the dry atmosphere into which the emulsified dispersion liquid is sprayed, heated gases yielded by heating air, nitrogen gas, carbon dioxide gas, combustion gas, and the like, or various flows or streams heated at temperatures higher than the boiling point of a specific solvent having the highest boiling point among the solvents are typically used.

It is possible to obtain a satisfactory and desired quality of toner in a short time process using a spray dryer, a belt dryer, a rotary kiln, or the like. When particles size distribution of toner particles is wide, and the toner particles are washed and dried in a condition where the particle size distribution is held as it is, the toner particles can be classified into a desired particle size distribution, and the particle size distribution can be narrowed.

In the operation of classifying the toner particles, fine particles can be removed from the toner particles even in an aqueous solution by using a cyclone, a decanter, and centrifuge separator.

Of course, toner particles may be classified after the toner particles have been dried and yielded as powder, however, it is preferable to classify the toner particles in an aqueous solution in terms of efficiency.

The obtained unnecessary fine particles or coarse particles can be returned to the kneading process again to use them in formation of toner particles. In this case, the fine particles or coarse particles may be in wet conditions.

It is preferred to remove the used dispersants from the obtained dispersion liquid as much as possible, and the removal of dispersants is preferably performed in the operation of classification at the same time.

The obtained toner particles may be taken as toner base particles and used directly as a toner, however, it is possible to mix the dried toner base particles with various types particles such as releasing agent fine particles, charge controlling agent fine particles, fluidizer fine particles, and colorants fine particles or to immobilize and fuse the toner base particles by giving a mechanical impact force to the mixture to thereby prevent removal of the different types of particles from surfaces of the complex particles. Namely, in the present invention, the toner base particles are particles before external additives being added thereto, which are obtained by removing the organic solvent from the dispersion liquid in the aqueous medium, and washing and drying the organic solvent-removed dispersion liquid before adding external additives. However, when the toner base particles are subjected to a surface treatment using hereinafter described fluorine-containing compound, the toner base particles are particles which have been subjected to the surface treatment using the fluorine-containing compound but before external additives being added thereto.

Specifically, there are methods of applying a mechanical impact to the toner base particles, for example, a method in which an impact is applied by rotating a blade at high speed, and a method in which an impact is applied by introducing the mixed particles into a high-speed flow and accelerating the speed of the flow so as to make the particles impact with each other or so as to make the composite particles impact upon an impact board.

Examples of units employed in such a method are an angmill (manufactured by Hosokawa micron Corp.), a modified I-type mill (manufactured by Nippon Pneumatic Manufacturing Co., Ltd.) to decrease crushing air pressure, a hybridization system (manufactured by Nara machinery Co., Ltd.), a krypton system (manufactured by Kawasaki Heavy Industries, Ltd.), and an automatic mortar.

<Surface Treatment with Fluorine-Containing Compound>

In preferred aspects of the present invention, toner particles obtained through the above-mentioned processes are subsequently subjected to a surface treatment using a fluorine-containing compound serving as a charge controlling agent. The fluorine-containing compound used in the present invention is not particularly limited, and any of organic compounds and inorganic compounds can be used, provided that the compound comprises fluorine atoms. Among the fluorine-containing compounds, a compound represented by general formula (1) is more preferably used.

(1)

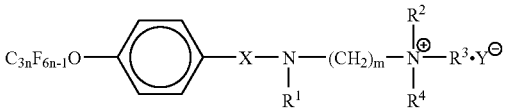

(In the general formula (1), X represents —$SO_2$— or —CO—, $R^1$, $R^2$, $R^3$, and $R^4$ independently represent one selected from the group consisting of a hydrogen atom, alkyl groups having 1 to 10 carbon atoms, and aryl groups, Y represents an iodine atom, a bromine atom, or a chlorine atom, and m and n respectively represent an integer of 1 to 10.)

For the charge controlling agent, it is preferable to use a metal-containing azo dye in combination with a fluorine-containing quaternary ammonium salt.

Typically used specific examples of compounds represented by General Formula (1) include fluorine-containing compounds (1) to (27) as shown below, and all of the compounds are whitish or light yellow in color. In addition, it is preferred that Y be an iodine.

(1)

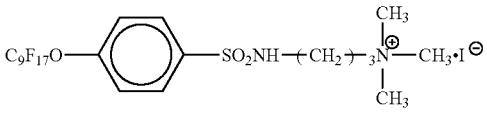

(2)

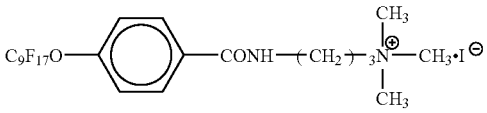

(3)

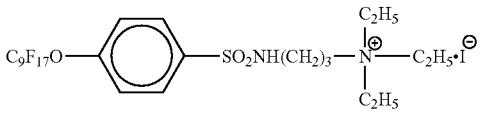

(4)

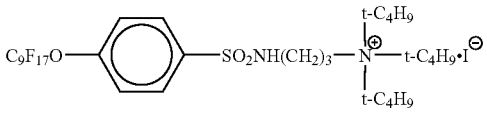

(5)

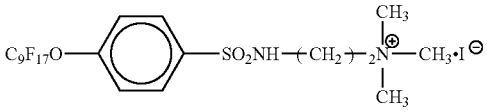

(6)

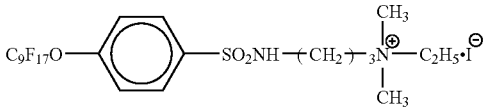

(7)

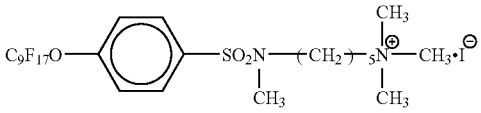

(8)

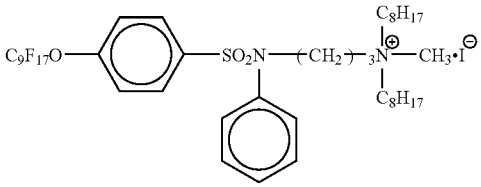

(9)

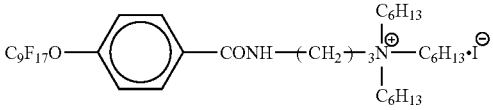

(10)

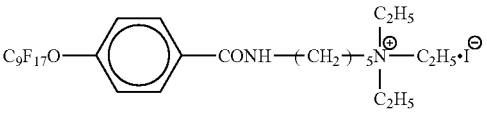

(11)

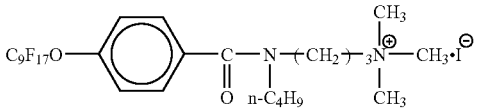

-continued (12)

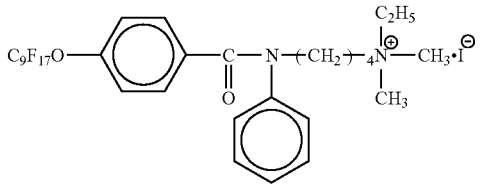

(13)

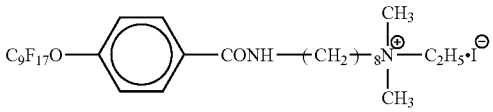

(14)

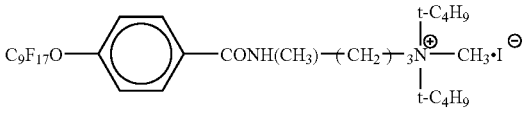

(15)

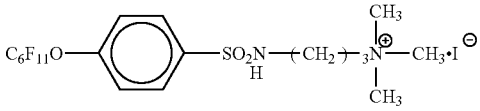

(16)

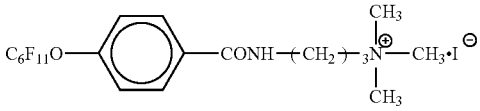

(17)

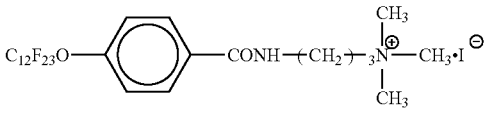

(18)

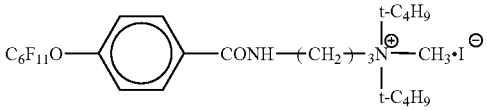

(19)

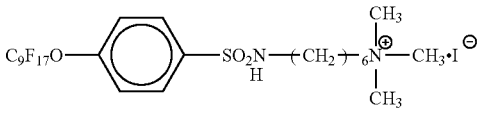

(20)

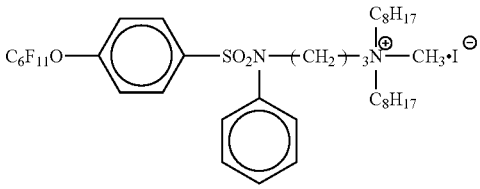

(21)

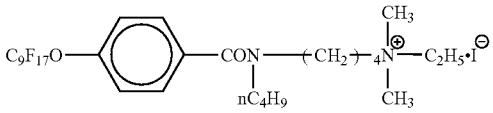

(22)

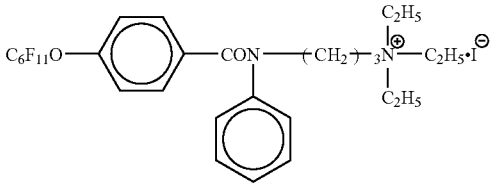

-continued (23)

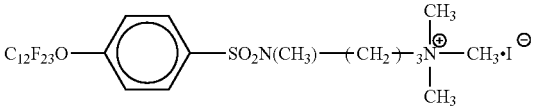

(24)

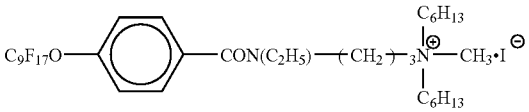

(25)

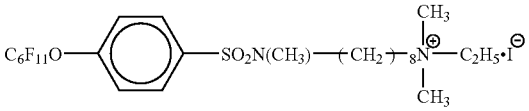

(26)

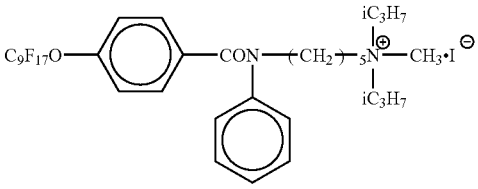

(27)

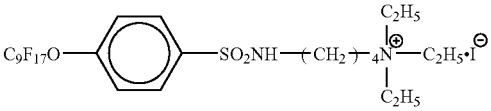

Among the above compounds, N,N,N,-trimethyl-[3-(4-perfluorononenyl oxybenzamide)propyl]ammonium=iodide is more preferably used in terms of capability of providing charges. In addition, mixtures of the compounds and other fluorine-containing compounds are more preferably used.

The fluorine-containing compound enables it possible to give a surface treatment to a toner such that the content of fluorine atoms depending on the fluorine-containing compound detected by XPS (x-ray photoelectron spectroscopy) is 2 atomic % to 30 atomic %, and preferably 4 atomic % to 15 atomic %. When the detected amount of the fluorine atoms is less than 2 atomic %, it is unfavorable because the effect of charge property cannot be obtained, and reduction in charge property is liable to occur not only in early stages but also with the lapse of time, which further causes background smear on copied images and toner scattering. On the other hand, when the detected amount of the fluorine-containing atoms is more than 30 atomic %, it is unfavorable because defective image density due to high charge state arises, and further defective fixing of the developer arises. In the x-ray photoelectron spectroscopy, it is possible to use the same x-ray photoelectron spectroscopy used for the measurement of inorganic fine particles on surfaces of the toner base particles.

For the method for making the fluorine-containing compound adhere on the toner, toner particles before inorganic fine particles being added as external additives are dispersed in an aqueous solvent with a fluorine-containing compound dispersed therein (water containing a surfactant is also preferably used) and fix the fluorine-containing compound on surfaces of the toner particles, and the solvent is removed and dried to thereby obtain the toner base particles, however, it is not limited to this method.

An array of experiments showed that the fluorine-containing compound can easily exert the effect of improving charge property of the toner by using the above-mentioned resin fine particles in a condition where the resin fine particles appropriately remain on the surface of the toner.

Specifically, the inventors of the present invention found that the effect of improving charge property of the toner can be obtained by subjecting the toner to a surface treatment with a fluorine material in a condition where the amount of resin fine particles remaining on the surfaces of the toner particles measured by a pyrolysis gas chromatographic mass spectrometer is 0.5% by mass to 5.0% by mass. The mechanism is not clearly found at the present stage, however, it is believed that a fluorine material has a property of easily adhering on resin fine particles, however, under a condition where resin fine particles scarcely reside on surfaces of toner particles as shown in the amount of residual resin fine particles being 0.5% by mass to 5% by mass, the fluorine material does not adhere on the surfaces of the toner and does not exert the effect of improving charge property of the toner.

This is because it is preferably that resin fine particles remain on the surface of the toner. On the other hand, the residual amount of the resin fine particles is more than 5.0% by mass, it may by a fixing inhibitor to low-temperature fixing property because lots of amount of the resin fine particles reside on the surface of the toner, and it is unfavorable as quality of toner, although the effect of charge property is remarkably exhibited.

<Shape of Toner, Etc.>

Next, circularity of toner particles, and particle circularity distribution will be described.

It is important that the toner of the present invention has a specific shape and a specific shape distribution. With a toner having an average circularity less than 0.90 and formed in an indefinite shape which is far from a spherical shape, it is impossible to obtain satisfactory transferring property and high-quality images without dust.

For the method of measuring shape of toner, an optical detection zone technique is properly used in which a suspension containing toner particles is passed through an imaging part detection zone disposed on a plate to optically detect the particle image of the toner by means of a CCD camera and analyze the shape of the toner.

It was laboratory-confirmed that a toner formed in a substantially spherical shape and has an average circularity being 0.900 to 0.990 is effective in forming a high-resolution image having an appropriate density and reproductivity. The average circularity is a value obtained by dividing a circumference equivalent to a circle having the same projected area to the toner particle shape by the length of circumference of the actual toner particle.

The average circularity of the toner is more preferably 0.95 to 0.990, and still more preferably, the average circularity of the toner is 0.960 to 0.985, and the amount of toner particles having a circularity less than 0.94 is 15% or less. In a toner which has been subjected to a surface treatment using a fluorine-containing compound, the average circularity is preferably 0.900 to 0.975, and more preferably, the average circularity is 0.950 to 0.970 and the amount of toner particles having a circularity less than 0.94 is 15% or less.

When the average circularity is more than 0.990, in a system with the blade cleaning employed therein, cleaning failures occur on a photoconductor and a transferring belt, causing smear on images. For example, in developing and transferring an image having a low-image area ratio, the amount of residual toner after transfer is little and cleaning failures hardly occur, however, when developing and transferring an image having a high-image area ratio such as a color photographic image, a toner of which an untransferred image is formed due to a paper feed failure may be a residual toner after transfer on a photoconductor. When such a residual toner after transfer accumulates on the photoconductor, the accumulated residual toner causes background smear on images.

In addition, the accumulated residual toner pollutes a charge roller which contact-charges a photoconductor, and the charge roller may not exhibit intrinsic chargeability. This value was measured by using the average circularity through the use of Flow-type particle image analyzer FPIA-2100 (manufactured by Sysmex Corp.). The specific measurement method will be described below.

With respect to the ratio Dv/Dn of the volume average particle diameter (Dv) to the number average particle diameter (Dn), it is preferred that the toner of the present invention preferably have a volume average particle diameter (Dv) of 2 μm to 7 μm (in a toner which have been subjected to a surface treatment using a fluorine-containing compound, 3 μm to 8 μm) and a ratio of Dv/Dn of the volume average particle diameter to the number average particle diameter being 1.25 or less, more preferably 1.10 to 1.25 from the perspective of any of heat resistant storage stability, low-temperature fixing property, and anti-hot-offset property. It is preferable from the following perspective. In particular, when such a toner is used in a full-color copier, it is excellent in glossiness of image, and when used in two-component developer, there is little variation in the toner particle diameter in the developer even when toner inflow/outflow is performed over a long period of time, and even with long-term agitation of the developer in the image developing unit, excellent and stable developing property can be obtained. Herein, the volume average particle diameter (Dv) is defined as $Dv=[\Sigma(nD^3)/\Sigma n]^{1/3}$ (In the equation, n represents the number of particles, and D represents a particle diameter).

In addition, when such a toner was used as a one-component developer, there was little valuation in the particle diameter of the toner, and toner filming to a developing roller and toner fusion to members such as a blade for making toner have a thin layer rarely occurred even when toner inflow/outflow was performed, and it was possible to obtain excellent and stable developing property and images even under long-term use (agitation) of the image developing unit.

Typically, it is said that the smaller in particle diameter of toner, the more advantageous for obtaining high-quality of image with high-resolution, however, on the contrary, it is disadvantageous to transferring property and cleaning ability.

When a toner has a volume average particle diameter smaller than the lower limit volume average particle diameter of the present invention and used in a two-component developer, the toner fuses on the surface of carrier over a long-period of agitation in an image developing unit, resulting in reduced chargeability of carrier, and when used as a one-component developer, toner filming to a developing roller and toner fusion to members such as a blade for making toner have a thin layer are liable to occur.

These phenomena also occur with a toner which has a content of fine-particles greater than the range defined in the present invention.

On the contrary, with a toner having a particle diameter greater than the upper limit particle diameter of the present invention, it is difficult to obtain high-quality of image with high-resolution, and the particle diameter of the toner may substantially vary when the toner inflow/outflow occurs in the developer.

It was clarified that same phenomenon occurred with a toner having a ratio Dv/Dn of the volume average particle diameter to the number average particle diameter of 1.25 or more. It was also clarified that when the ratio of the volume average particle diameter to the number average particle diameter was less than 1.05, charge property of the toner seemed to be sometimes insufficient, and cleaning ability could be degraded, although it is preferable from the perspective of stabilization of the toner behavior and uniformization of charged amount.

The ratio (Dv/Dn) of the volume average particle diameter to the number average particle diameter can be automatically measured with the volume average particle diameter (Dv) and the number average particle diameter measured by using a particle sizer with an aperture diameter of 100 μm, Coulter Counter TAII manufactured by Coulter Electronics Ltd.

<Carrier for Two-Component Developer>

When the toner of the present invention is used in a two-component developer, it is only necessary to mix the toner with magnetic carrier, and the mixture ratio of the toner relative to 100 parts by mass of the carrier in the developer is preferably 1 part by mass to 10 parts by mass, and more preferably 3 parts by mass to 9 parts by mass. For the magnetic carrier, it is possible to use conventional powders such as iron powders, ferrite powders, magnetite powders, and magnetic resin carriers each having a particle diameter of approx. 20 μm to 200 μm.

Examples of coating materials for the toner include amino resins such as urea-formaldehyde resins, melamine resins, benzoguanamine resins, urea resins, polyamide resins, and epoxy resins. It is also possible to use polyvinyl resins and polyvinylidene resins such as acrylic resins, polymethyl methacrylate resins, polyacrylonitrile resins, polyvinyl acetate resins, polyvinyl alcohol resins, polyvinyl butyral resins; polystyrene resins, and polystyrene resins such as styrene-acryl copolymer resins; halogenated olefin resins such as polyvinyl chlorides; polyester resins such as polyethylene terephthalate resins, and polybutylene terephthalate resins, polycarbonate resins, polyethylene resins, polyvinyl fluoride resins, polyvinylidene fluoride resins, polytrifluoro ethylene resins, polyhexafluoro-propylene resins; copolymers of vinylidene fluoride and an acryl monomer; fluoro-tar polymers such as tar polymers of tetrafluoro-ethylene, vinylidene fluoride and a non-fluorinated monomer; and silicone resins. In accordance with the necessity, conductive powder or the like may be included in the coating resins.

For the conductive powder, metal powders, carbon black, titanium oxides, tin oxides, and zinc oxides or the like can be used. These conductive powders preferably have an average particle diameter of 1 μm or less. When the average particle diameter of the conductive powder is greater than 1 μm, it is difficult to control electric resistivity.

In addition, the toner of the present invention can be used as a one-component magnetic toner without using carrier therein or non-magnetic toner.

<Image Forming Apparatus>

The toner of the present invention can be used for image forming through the use of an image forming apparatus which comprises an intermediate transfer member.

Hereinafter, one embodiment of the intermediate transfer member in a transferring system will be described.

FIG. 1 is a block diagram schematically showing a copier relating to this embodiment of the present invention. In the copier, photoconductor drum 110, hereinafter it may be referred to as photoconductor 110, serving as an image bearing member, is surrounded by charge roller 120 serving as the charging unit, exposing unit 130, cleaning unit 160 having a cleaning blade, charge-eliminating lamp 170 serving as the charge-eliminating unit, image developing unit 140, and intermediate transfer member 150 serving as an intermediate transfer member. The intermediate transfer member 150 is suspended by a plurality of suspension rollers 151 and configured to be driven in an endless form in the direction indicated by an arrow by action of a drive unit such as a motor (not shown).

A part of rollers 151 also serves as a transfer bias roller for applying a transfer bias to the intermediate transfer member 150. A given transfer bias voltage is applied to the transfer bias roller from a source (not shown). In addition, cleaning unit 190 having a cleaning blade for the intermediate transfer member 150 is also arranged in the copier.

Transfer roller 180 is also arranged so as to face the intermediate transfer member 150, and the transfer roller 180 serves as a transferring unit configured to transfer a developed image onto transferring sheet 101 serving as a final transferring member.

Corona charger 152 is disposed around the intermediate transfer member as a charging unit.

The image developing unit 140 comprises developing belt 141 serving as a developer carrier, black (hereinafter represented by K) developing unit 145K, yellow (hereinafter represented by Y) developing unit 145Y, magenta (hereinafter represented by M) developing unit 145M, and cyan (hereinafter represented by C) developing unit, all of which are disposed around the developing belt 141.

The developing belt 141 is spanned over a plurality of belt rollers and is configured to be driven in an endless form in the direction indicated by an arrow by action of a drive unit such as a motor (not shown) to move at a substantially same speed of the photoconductor 110 at a portion making contact with the photoconductor 110.

Since individual developing units stated above have the same configuration, the following paragraphs will explain only the black developing unit 145K, and for other developing units of 145Y, 145M, and 145C, in the figure, the parts corresponding to those of the black developing unit 145K will be represented by just assigning Y, M, or C following the reference numbers same as those of the black developing unit 145K, and the explanations for developing units of 145Y, 145M, and 145C will be omitted. The developing unit 145K comprises developer container 142K for housing a high-viscosity and high density liquid developer containing toner particles and carrier solution components, pumping roller 143Bk which is arranged such that the lower portion thereof is soaked in the liquid developer within the developer container 142K, and coating roller 144K configured to make the developer pumped from the pumping roller 143K a thin layer so as to be coated on the developing belt 141. The coating roller 144K has a conductivity, and a given bias is applied to the coating roller 144K from a source (not shown).

Figure 2:
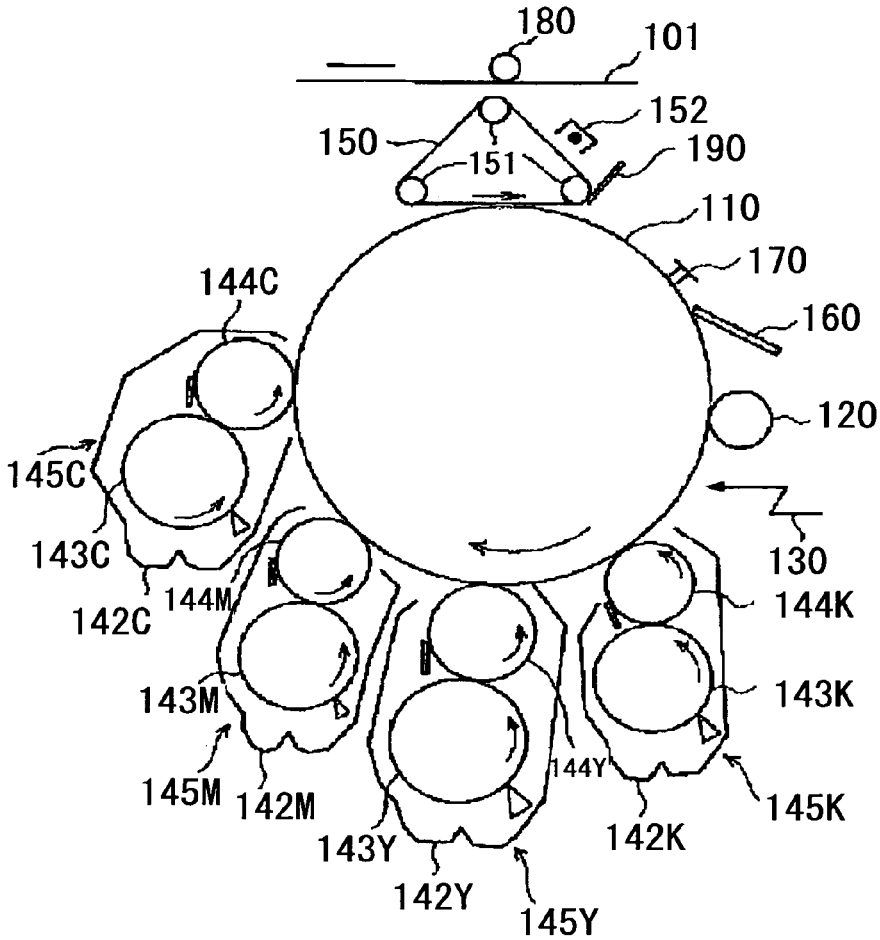
FIG. 2 is a block diagram schematically showing another example of the image forming apparatus of the present invention.

Besides the configuration shown in FIG. 1, a copier relating to this embodiment may have a configuration where each color developing units 145K, 145Y, 145M, and 145C are arranged around the photoconductor 110, as shown in FIG. 2.

Next, actions of the copier relating to this embodiment will be described.

In FIG. 1, the photoconductor 110 is rotated and driven to move in the direction indicated by the arrow while being uniformly charged by the charge roller 120, and a reflected light from the document is focused and projected through an optical system (not shown) by the exposing unit 130 to form a latent electrostatic image on the photoconductor 110. This latent electrostatic image is developed by the developing unit 140 and formed into a toner image as a developed image. The pumped thin layer of developer on the developing belt 141 peals off from the surface of the developing belt 141 in a state of a thin layer by making contact with the photoconductor in the developing area to move to the area where the latent electrostatic image has been formed on the photoconductor 110.

The toner image developed by the developing unit 140 is transferred onto the surface of the intermediate transfer member 150 (primary transfer) at a contact area between the toner image and the intermediate transfer member 150 (primary transfer area). When three colors or four colors are superimposed to transfer an image, this process is repeated for each of these color toners to form a color image on the intermediate transfer member 150.

The corona charger 152 is placed in a rotational direction of the intermediate transfer member 150 in order to provide charges to the superimposed toner image on the intermediate transfer member at a position that is downstream of the contact section of the photoconductor 110 and the intermediate transfer member 150, and that is upstream of the contact section of the intermediate transfer member 150 and the transferring sheet 101. Then, the corona charger 152 provides a true electric charge to the toner image with the polarity of which is the same as that of the toner particles that form the toner image, and gives a sufficient charge enough to enable an excellent transfer to the transferring sheet 101. After being charged by the corona charger 152, the toner image is transferred at once to the transferring sheet 101 which is carried in the direction indicated by the arrow from a sheet feeder (not shown) by a transfer bias of the transferring roller 180 (secondary transfer).

Thereafter, the transferring sheet 101 to which the toner image has been transferred is detached from the photoconductor 110 by a detaching apparatus (not shown). Then, the transferring sheet 101 is fixed by a fixing unit (not shown) and ejected from the detaching apparatus.

On the other hand, after the transfer, the cleaning unit 160 removes and retrieves untransferred toner particles from the photoconductor 110, and the charge elimination lamp 170 removes remaining charge from the photoconductor 110 to prepare for the subsequent charging.

The static friction coefficient of the intermediate transfer member is preferably 0.1 to 0.6, more preferably 0.3 to 0.5. The volume resistance of the intermediate transfer member is preferably several Ω·cm or more and $10^3$ Ω·cm or less. By controlling the volume resistance from several Ω·cm to $10^3$ Ω·cm, charging of the intermediate transfer member itself is prevented. It also prevents uneven transfer at secondary transfer because the charge provided by charge-providing unit rarely remains on the intermediate transfer member. In addition, it is easier to apply a transfer bias for the secondary transfer.

The materials for the intermediate transfer member are not particularly limited, and those known in the art may be used. Examples thereof are as follows.

(1) Materials with high Young's moduli (tension elasticity) used as a single layer belt, which include polycarbonates (PC), polyvinylidene fluoride (PVDF), polyalkylene terephthalate (PAT), blend materials of polycarbonates (PC) and polyalkylene terephthalate (PAT), and blend materials such as ethylene tetrafluoroethylene copolymer (ETFE) and polycarbonates (PC), ethylene tetrafluoroethylene copolymer (ETFE) and polyalkylene terephthalate (PAT), and polycarbonates (PC) and polyalkylene terephthalate (PAT); and thermosetting polyimides of carbon black dispersion. These single layer layers having high Young's moduli are small in their deformation against stress during image formation and are particularly advantageous in that mis-registration is not easily caused when forming a color image.

(2) A double or triple layer belt using the above-noted belt having high Young's modulus as a base layer with a surface layer or an intermediate layer added circumferentially around the base layer. The double or triple layer belt has a capability to prevent print defect of unclear center portion in a line image that is caused by the hardness of the single layer belt.

(3) A belt with a relatively low Young's modulus which incorporates a rubber or an elastomer. This belt has an advantage that there is almost no print defect of unclear center portion in a line image due to its softness. Additionally, by making the width of the belt wider than driving and tension rollers and thereby using the elasticity of the edge portions that extend over the rollers, it can prevent snaky move of the belt. Therefore, it can reduce cost without the need of ribs and a device to prevent the snaky move.

Conventionally, intermediate transfer belts have been adopting fluorine resins, polycarbonates, polyimides, and the like, however, in the recent years, elastic belts in which elastic members are used in all layers or a part thereof are used. There are the following issues on transfer of color images using a resin belt.

Color images are typically formed by four colors of color toners. In one color image, toner layers of layer 1 to layer 4 are formed. Toner layers are pressurized as they pass the primary transfer in which the toner layers are transferred from the photoconductor to the intermediate transfer belt and the secondary transfer in which the toner is transferred from the intermediate transfer belt to the sheet, which increases the flocculation force among toner particles. As the flocculation force increases, phenomena such as dropouts of letters and dropouts of edges of solid images are likely to occur. Since resin belts are too hard to be deformed by the toner layers, they tend to compress the toner layers and therefore dropout phenomena of letters are likely to occur.

Recently, the demands for printing full color images on various types of paper such as Japanese paper and paper having concavoconvex or irregularities intentionally formed thereon are increasing. However, with sheets of paper having low smoothness, gaps between the toner and the sheet are likely to be formed at the time of transferring and therefore miss-transfers easily occur. When the transfer pressure of secondary transfer section is raised in order to increase the contact, the flocculation force of the toner layers will be higher, resulting in dropouts of letters as described above.

Elastic belts are used for the following aim. Elastic belts deform according to the toner layers and the roughness of the sheet having low smoothness at the transfer section. In other words, since elastic belts deform according to local bumps and holes, an excellent contact is achieved without excessively increasing the transfer pressure against the toner layers so that it is possible to obtain transferred images having excellent uniformity without any dropout of letters even on sheets of paper having a low surface planality.

For the resin of the elastic belts, one or more can be selected from the group consisting of polycarbonates, fluorine resins (ETFE, PVDF), styrene resins (homopolymers and copolymers including styrene or substituted styrene) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymers (styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate copolymers (styrene-methyl methacrylate copolymer, styrene-ethyl methacrylate copolymer, styrene-phenyl methacrylate copolymer, and the like), styrene-α-chloromethyl acrylate copolymer, styrene-acrylonitrile acrylate copolymer, and the like, methyl methacrylate resin, butyl methacrylate resin, ethyl acrylate resin, butyl acrylate resin, modified acrylic resins (silicone-modified acrylic resin, vinyl chloride resin-modified acrylic resin, acrylic urethane resin, and the like), vinyl chloride resin, styrene-vinyl acetate copolymer, vinyl chloride-vinyl acetate copolymer, rosin-modified maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethylacrylate copolymer, xylene resin and polyvinylbutylal resin, polyamide resin, modified polyphenylene oxide resin, and the like. However, it is understood that the materials are not limited to those mentioned above.

For the rubber and elastomer of the elastic materials, one or more can be selected from the group including butyl rubber, fluorine rubber, acrylic rubber, ethylene propylene rubber (EPDM), acrylonitrilebutadiene rubber (NBR), acrylonitrile-butadiene-styrene natural rubber, isoprene rubber, styrene-butadiene rubber, butadiene rubber, ethylene-propylene rubber, ethylene-propylene terpolymer, chloroprene rubber, chlorosufonated polyethylene, chlorinated polyethylene, urethane rubber, syndiotactic 1,2-polybutadiene, epichlorohydrin rubber, silicone rubber, fluorine rubber, polysulfurized rubber, polynorbornen rubber, hydrogenated nitrile rubber, thermoplastic elastomers (such as polystyrene elastomers, polyolefin elastomers, polyvinyl chloride elastomers, polyurethane elastomers, polyamide elastomers, polyurea elastomers, polyester elastomers, and fluorine resin elastomers), and the like. However, it is understood that the materials are not limited to those mentioned above.

Electric conductive agents for resistance adjustment are not particularly limited, and examples thereof include carbon black, graphite, metal powders such as aluminum, nickel, and the like; and electric conductive metal oxides such as tin oxide, titanium oxide, antimony oxide, indium oxide, potassium titanate, antimony tin oxide (ATO), indium tin oxide (ITO), and the like. The metal oxides may be coated on non-conducting particulates such as barium sulfate, magnesium silicate, calcium carbonate, and the like. It is understood that the conductive agents are not limited to those mentioned above.

Materials of the surface layer are required to prevent contamination of the photoconductor by the elastic material and to reduce the surface friction of the transfer belt so that toner adhesion is lessened and the cleaning ability and secondary transfer property are increased. For example, one or more of polyurethane, polyester, epoxy resin, and the like are used, and powders or particles of a material that reduces surface energy and enhances lubrication such as fluorine resin, fluorine compound, carbon fluoride, titanium dioxide, silicon carbide, or the like can be dispersed and used. Alternatively, powders or particles of different sizes may be employed. In addition, it is possible to use a material such as fluorine rubber that is treated with heat so that a fluorine-rich layer is formed on the surface and the surface energy is reduced.

The method for producing the belt is not limited, and there are:

(a) centrifugal forming in which material is poured into a rotating cylindrical mold to form a belt, (b) spray application in which a liquid paint is sprayed to form a film, (c) dipping method in which a cylindrical mold is dipped into a solution of material and then pulled out, (d) injection mold method in which material is injected between inner and outer molds, and (e) a method in which a compound is applied onto a cylindrical mold and the compound is vulcanized and ground.

The method is not limited to those mentioned above, and typically, an elastic belt is produced in combination of plural methods.

Methods to prevent elongation of the elastic belt include using a core resin layer which is difficult to elongate on which a rubber layer is formed, incorporating a material that prevents elongation into the core layer, and the like, however, the methods are not particularly related with the production methods.

For materials that prevent elongation of a core layer, one or more can be selected from the group including, for example, natural fibers such as cotton, silk and the like; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, phenol fibers, and the like; inorganic fibers such as carbon fibers, glass fibers, boron fibers, and the like, metal fibers such as iron fibers, copper fibers, and the like, and materials in a form of a weave or thread can be used. It is understood naturally that the materials are not limited to those described above.

A thread may be one or more of filaments twisted together, and any ways of twisting and plying are accepted such as single twisting, multiple twisting, doubled yarn, and the like. Further, fibers of different materials selected from the above-described group may be spun together. The thread may be treated before use in such a way that it is electrically conductive.

On the other hand, the weave may be of any type including plain knitting, and the like. It is naturally possible to use a union weave to apply electric conductive treatment.

The production method of the core layer is not particularly limited. For example, there is a method in which a weave that is woven in a cylindrical shape is placed on a mold or the like and a coating layer is formed on top of it. Another method uses a cylindrical weave being dipped in a liquid rubber or the like so that on one side or on both sides of the core layer, coating layer(s) is formed. In another example, a thread is wound helically to a mold or the like in an arbitrary pitch, and then a coating layer is formed thereon.

When the thickness of the elastic layer is too thicker, the elongation and contraction of the surface becomes large and may cause a crack on the surface layer although it depends on the hardness of the elastic layer. Moreover, when the amount of elongation and contraction is large, the size of images are elongated and contracted. Therefore, it is not preferred (about 1 mm or more).

Next, the charging unit will be described.

Figure 7:
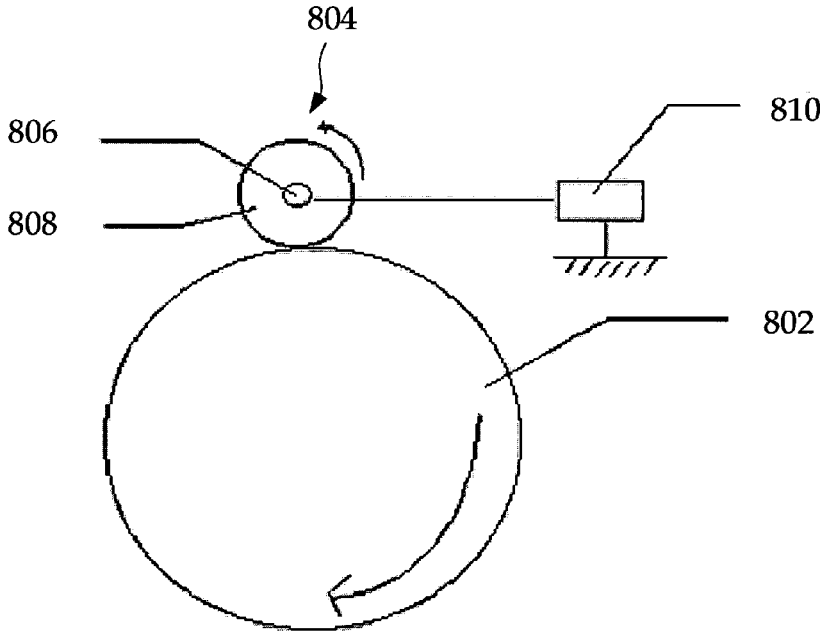
FIG. 7 is a block diagram schematically showing an example of the contact charging unit of the present invention.

FIG. 7 is a schematic diagram showing an example of the image-forming apparatus equipped with a contact charger of charging unit.

The photoconductor 802 to be charged as a latent electrostatic bearing member is rotated at a predetermined speed of process speed in the direction indicated by the arrow in the figure. The charging roller 804, which is brought into contact with the photoconductor, basically includes core rod 806 and conductive rubber layer 808 formed on the core rod 806 in a shape of a concentric circle. The both terminals of the core rod are supported with bearings (not shown) so that the charging roller 804 enables to rotate freely, and the charging roller is pressed to the photoconductor at a predetermined pressure by a pressurizing member (not shown). The charging roller 804 in this figure therefore rotates along with the rotation of the photoconductor. The charging roller 804 is generally formed with a diameter of 16 mm in which a core rod having a diameter of 9 mm is coated with a rubber layer having a moderate resistance of approximately 100,000 Ω·cm.

The core rod 806 of the charging roller 804 is electrically connected with power supply 810, and a predetermined bias is applied to the charging roller by the power supply 810, thereby, the surface of the photoconductor 802 is uniformly charged at a predetermined polarity and potential.

The configuration of the charging member may be properly selected depending on specifications of the image forming apparatus, for example, the configuration may be magnetic brush, fur brush, and the like in addition to roller.

The magnetic brush is typically constructed from a charging material of ferrite particles such as Zn—Cu ferrite, a non-magnetic conductive sleeve for the support, and a magnetic roll encased therein.

The fur blush is formed of a fur to which such a conductive material is applied as carbon, copper sulfide, metals, or metal oxides; the fur is wounded or adhered to the other metals or conductive materials to form a charger.

The charging unit used in the present invention may be a non-contacting unit rather than the contacting unit described above, preferably, the contact charging unit is preferable since the generation of ozone is relatively little.

In the present invention, an amorphous silicon photoconductor (hereinafter referring to as "a-Si photoconductor") may be employed which is produced by way of heating a conductive support from 50° C. to 400° C. and depositing on the conductive support a photoconductive layer of amorphous silicon through vacuum deposition, spattering, ion-plating, thermal CVD, optical CVD, plasma CVD, or the like.

Among these, a preferable method is plasma CVD in which raw material gas is decomposed by glow discharge of direct current, high frequency, or microwave, and then a-Si is deposited on the substrate to form an a-Si film.

The amorphous silicon photoconductor has a layer structure of as follow.

FIGS. 8A to 8D are schematic diagrams which explain the layer structure of the amorphous silicon photoconductor.

Figure 8A:
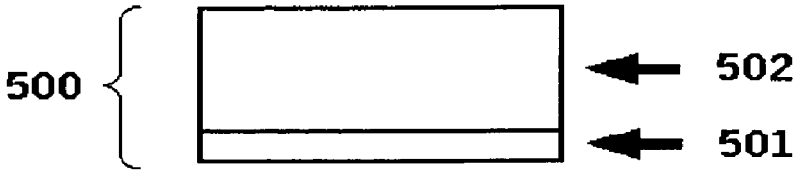
FIGS. 8A to 8D are schematic block diagrams each illustrating a laminar structure of the photoconductor of the present invention.

In FIG. 8A, electrophotographic photoconductor 500 has substrate 501 and photoconductive layer 502 on the substrate 501. The photoconductive layer 502 is formed of a-Si:H, X, and exhibits photoconductivity.

Figure 8B:
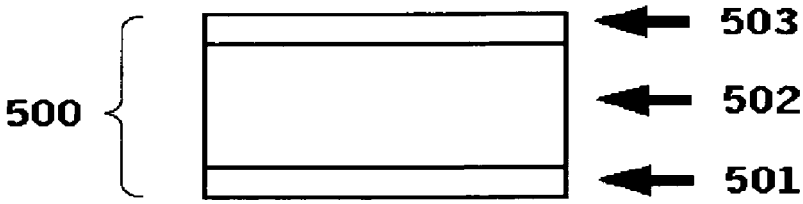

In FIG. 8B, electrophotographic photoconductor 500 comprises substrate 501, and photoconductive layer 502 which comprises a-Si:H, X and amorphous silicon surface layer 503 formed on the substrate 501.

Figure 8C:
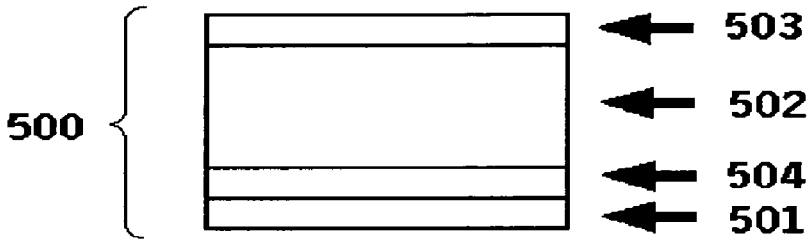

In FIG. 8C, electrophotographic photoconductor 500 comprises substrate 501, and photoconductive layer 502 formed of a-Si:H, X, and having photoconductivity, amorphous silicon surface layer 503 and amorphous silicon charge injection inhibiting layer 504 formed on the substrate 501.

Figure 8D:
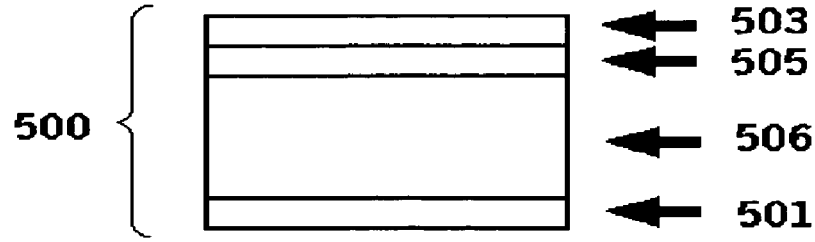

In FIG. 8D, electrophotographic photoconductor 500 comprises substrate 501, and photoconductive layer 502 disposed on the substrate 501. The photoconductive layer 502 comprises charge generating layer 505 formed of a-Si:H, X and charge transporting layer 506. The electrophotographic photoconductor 500 further comprises amorphous silicon surface layer 503 on the photoconductive layer 502.

The substrate of the photoconductor may be conductive or electrically isolating. Examples of the conductive substrate include metals such as Al, Cr, Mo, Au, In, Nb, Te, V, Ti, Pt, Pd, Fe, and alloys thereof such as stainless. Also, it is also possible to use an insolating substrate such as a film or sheet of synthetic resin, for example, polyesters, polyethylenes, polycarbonates, cellulose acetates, polypropylenes, polyvinyl chlorides, polystyrenes, polyamides; or sheet, glass, ceramic, in which at least a surface facing to a photoconductive layer is treated to yield conductivity.

The shape of the substrate may be cylindrical, plate, or endless belt, which has a smooth or irregular surface. The thickness thereof can be adjusted so as to form a predetermined photoconductor. In the case that flexibility is required to the photoconductor, the substrate can be as thinner as possible, provided that the substrate is efficiently functioning as a substrate. The thickness of the substrate is typically 10 μm or more from the perspective of production, handling, mechanical strength, and the like.

In the photoconductor used in the present invention, it is effective to dispose a charge injection inhibiting layer, which inhibits a charge injection from a conductive substrate, between the conductive substrate and the photoconductive layer (see FIG. 8C).

The charge injection inhibiting layer has a polarity dependency. Namely, when charging of single polarity is applied to a free surface of the photoconductor, the charge injection inhibiting layer functions so as to inhibit a charge injection from the conductive substrate to the photoconductive layer, and when charging of opposite polarity, namely charging from the side of substrate, is applied, the charge injection inhibiting layer does not function. In order to attain such function, the charge injection inhibiting layer has relatively a lot of atoms which control polar conductivity, compared with the photoconductive layer.

The thickness of the charge injection inhibiting layer is preferably 0.1 μm to 5 μm, more preferably 0.3 μm to 4 μm, and still more preferably 0.5 μm to 3 μm from the perspective of capability of obtaining desirable electrophotographic properties and cost efficiency.

The photoconductive layer is disposed on or above an undercoat layer in accordance with the necessity. The thickness of the photoconductive layer is not particularly limited, provided that desirable electrophotographic properties and cost efficiency can be obtained. The thickness thereof is preferably about 1 μm to 100 μm, more preferably 20 μm to 50 μm, and still more preferably 23 μm to 45 μm.

The charge transporting layer is, in the case where the photoconductive layer is divided by its functions, a layer which mainly functions to transport charge. The charge transporting layer comprises a silicon atom, a carbon atom, and a fluoride atom as its essential component. When needed, the charge transporting layer further comprises a hydrogen atom and an oxygen atom so that the charge transporting layer is formed of a-SiC (H,F,O). Such a charge transporting layer exhibits desirable photoconductivity, especially charge holding property, charge generating property, and charge transporting property. It is particularly preferable that the charge transporting layer comprises an oxygen atom.

The thickness of the charge transporting layer is suitably adjusted so as to obtain desirable electrophotographic properties and cost efficiency. The thickness thereof is preferably 5 μm to 50 μm, more preferably 10 μm to 40 μm, and still more preferably 20 μm to 30 μm.

The charge generating layer is, in the case where the photoconductive layer is divided by its functions, a layer which mainly functions to generate charge. The charge generating layer comprises a silicon atom as an essential component and does not substantially comprise a carbon atom. When needed, the charge generating layer further contains a hydrogen atom so that the charge generating layer is formed of a-Si:H. Such a charge generating layer exhibits desirable photoconductivity, especially charge generating property and charge transporting property.

The thickness of the charge generating layer is suitably adjusted so as to obtain desirable electrophotographic properties and cost efficiency. The thickness thereof is preferably 0.5 μm to 15 μm, more preferably 1 μm to 10 μm, and still more preferably 1 μm to 5 μm.

The amorphous silicon photoconductor used in the present invention may further comprise a surface layer disposed on the photoconductive layer which is formed on the substrate as mentioned above. It is preferred to contain an amorphous silicon surface layer. The surface layer has a free surface so that desirable properties such as moisture resistance, repetitively-usable properties, electric pressure tightness, environmental usability, and wear resistance.

The thickness of the surface layer is typically 0.01 μm to 3 μm, preferably 0.05 μm to 2 μm, and still more preferably 0.1 μm to 1 μm. When the thickness thereof is less than 0.01 μm, the surface layer is worn out during usage of the photoconductor. When the thickness thereof is more than 3 μm, electrophotographic property is impaired such as an increase of residual charge.

Such amorphous silicon photoconductors exhibit higher surface hardness, have high sensitivity with light with long wavelength such as semiconductor laser light of 770 nm to 800 nm, are resistant to degradation caused by repetitive use and are therefore used as electrophotographic photoconductors, for example, in high-speed copiers and laser beam printers (LBP).

Figure 9:
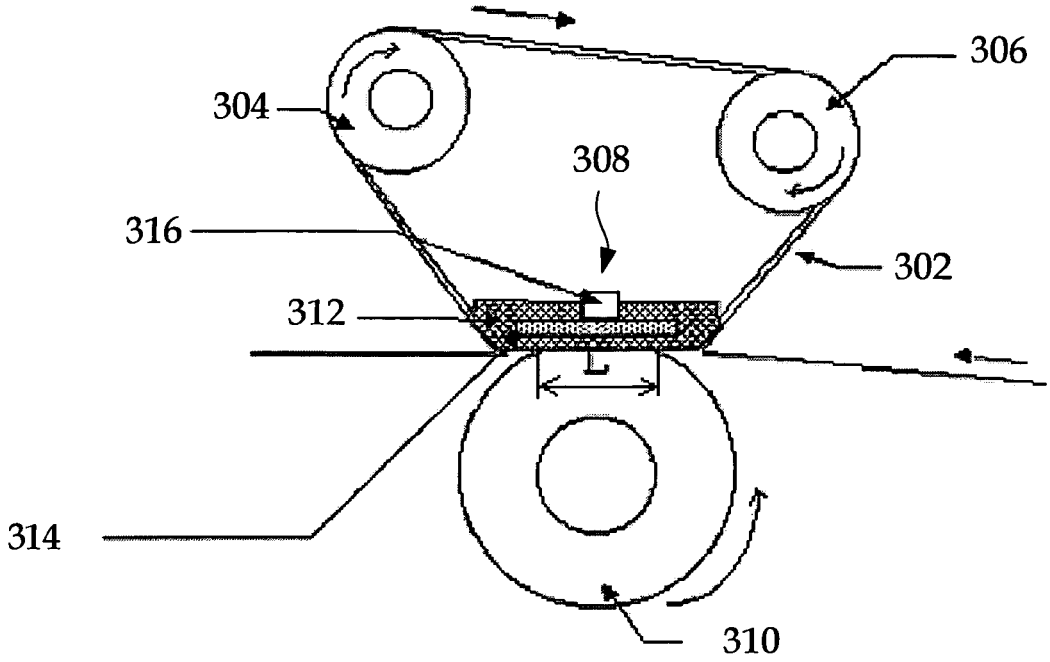
FIG. 9 is a block diagram schematically showing an example of the fixing units of the present invention.

With reference to FIG. 9, the fixing unit is a SURF (surface rapid fusing) fixing unit in which fixing is carried out by rotating a fixing film.

Specifically, the fixing film 302 is a heat-resistant film in a form of an endless belt, and the fixing film is spanned around driving roller 304 which is a supportive rotator of the fixing film, driven roller 306, and heater 308 disposed so as to be fixed to and supported by a heater support which is disposed at the downside between the driving roller 304 and the driven roller 306.

The driven roller 306 serves also as a tension roller of fixing film 302. The fixing film 302 is driven and thereby rotates in a clockwise rotating direction as shown in the figure by the driving roller 304. This rotating speed is controlled so to travel at the same speed as a transferring member in a nip region L in which the pressurizing roller 310 and the fixing film 302 come in contact with each other.

The pressurizing roller 310 has a rubber elastic layer having an excellent releasing property, such as silicone rubber. The pressurizing roller 310 rotates in a counterclockwise direction so as to adjust a contact pressure at 4 kg to 10 kg with respect to the fixing nip region L.

The fixing film 302 preferably has excellent heat resistance, releasing property and wearing resistance. The thickness thereof is typically 100 μm or less, and preferably 40 μm or less. Examples of the fixing film are single or multi layered film of heat resistant resins such as polyimide, poly(ether imide), PES (poly(ether sulfide)), and PFA (tetrafluoroethylene-perfluoroalkyl vinyl ether copolymer). Specific examples thereof may be a film having a thickness of 20 μm in which a releasing coat layer of 10 μm thickness, formed of electroconducting agent-added fluoride resin such as PTFE (polytetrafluoroethylene resin), PFA, or an elastic layer such as fluorocarbon rubber or silicone rubber is disposed at least on the side in contact with an image.

In FIG. 9, the heater 308 in this embodiment comprises flat substrate 312 and fixing heater 314. The flat substrate 312 is formed of a material having high thermal conductivity and high electric resistance such as alumina. On the surface of the flat substrate 312 where the fixing film 302 is in contact with, fixing heater 314 formed of a resistant heating element is disposed so that the longer side of the fixing heater lies along the traveling direction of the fixing film.

Such fixing heater 308 is, for example, screen printed with electric resistant material such as Ag/Pd or $Ta_2N$ in liner stripe or band stripe by means of screen printing or the like.

Moreover, two electrodes (not shown) are disposed at both ends of fixing heater 308 so that the resistant heating element generates a heat by energizing between the electrodes. Further, on a side of the flat substrate 312 opposite to the fixing heater 314, a fixing temperature sensor 316 formed of thermistor is disposed.

Thermal information of the flat substrate is detected by the fixing temperature sensor 316 and is sent to a controller so that quantity of electricity applied to the fixing heater is controlled, thus the heating member is controlled at a predetermined temperature.

The fixing unit used in the present invention is not limited to the SURF (surface rapid fusing) fixing unit, however, the SURF fixing unit is preferred in that image forming apparatuses can be provided with a fixing unit having higher efficiency and shorter warm-up.

In a developing unit in the present invention, a power supply applies vibration bias voltage as developing bias, in which voltage direct current and alternating voltage are superpositioned, to a developing sleeve during developing. The potential of background part and the potential of image part are positioned between maximum value and minimum value of the vibration bias potential.

This forms an alternating field in which directions alternately change at developing region. A toner and a carrier are intensively vibrated in this alternating field, so that the toner overshoots the electrostatic force of constraint from the developing sleeve and the carrier, and leaps to the photoconductor. The toner is then attached to the photoconductor relative to a latent electrostatic image thereon.

The difference between maximum value and minimum value of the vibration bias voltage (peak range voltage) is preferably 0.5 kV to 5 kV, and the frequency is preferably 1 kHz to 10 kHz.

The waveform of the vibration bias voltage may be a rectangle wave, a sine wave, or a triangle wave. The voltage direct current of the vibration bias voltage is in the range of the potential at the background and the potential at the image as mentioned above, and is preferably set closer to the potential at the background from the perspective of inhibiting a toner adhesion on the background.

When the waveform of the vibration bias voltage is a rectangle wave, it is preferred that a duty ratio be 50% or less. Here, the duty ratio is a ratio of time when the toner leaps to the photoconductor during a cycle of the vibration bias. In this way, the difference between the peak time value when the toner leaps the photoconductor and the time average value of bias can be larger. Consequently, the movement of the toner is further activated thus the toner accurately adheres to the potential distribution of the latent electrostatic image and rough deposits and an image resolution can be improved.

Moreover, the difference between the time peak value when the carrier, which has an opposite polarity of current to the toner, leaps to the photoconductor and the time average value of bias can be small. Consequently the movement of the carrier can be restrained and the possibility of the carrier deposition on the background is largely reduced.

Preferably, the bias is applied to the developing unit in order to produce highly fine and precise images with less roughness, however, the configuration is not limited to the above mentioned.

Figure 10:
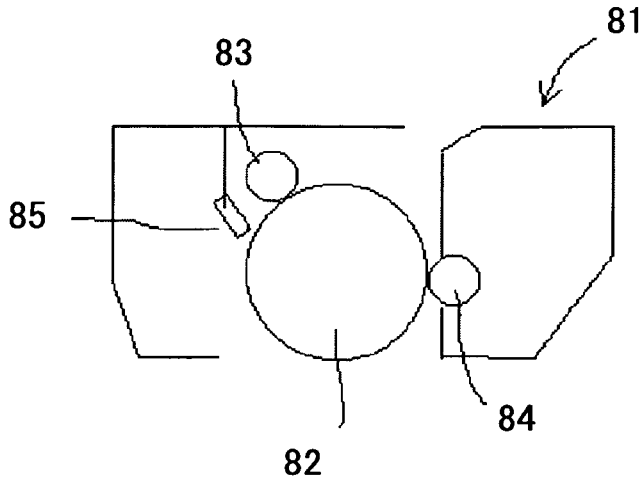
FIG. 10 is a block diagram schematically showing an example of the image forming apparatus which comprises the process cartridge of the present invention.

FIG. 10 shows a schematic structure of an image forming apparatus equipped with a process cartridge.

In FIG. 10, the reference number 81 represents the entire system of the process cartridge, and the process cartridge 81 comprises photoconductor 82, charging unit 83, and cleaning unit 85.

In the present invention, a plurality of elements among the elements from the above-noted the photoconductor 82, the charging unit 83, the developing unit 84, and the cleaning unit 85 are integrally composed as a process cartridge, and the process cartridge is detachably mounted to a main body of an image forming apparatus such as copiers and printers.

In the image forming apparatus which loads a process cartridge which is structured to house the toner for electrophotography of the present invention, the photoconductor is rotated and driven at a predetermined rotating speed.

In the course of the rotation, the photoconductor is uniformly charged by a predetermined positive or negative potential by means of the charging unit and then subjected to an image-exposing light from an image-exposing unit such as a slit exposer and a laser beam scanning exposer to thereby sequentially form a latent electrostatic image on the surface of the photoconductor. The formed latent electrostatic image is developed into a toner image by the developing unit, and the developed toner image is sequentially transferred onto a transferring material which is fed from the sheet feeder to between the photoconductor and the transferring unit in synchronized with the rotation of the photoconductor.

The transferring material subjected to the image trans is isolated from the surface of the photoconductor then introduced into the image fixing unit to be fixed to thereby printed out as a copy outside the image forming apparatus.

A residual toner remaining on the surface of the photoconductor after image transfer is removed by the cleaning unit, and the surface of the photoconductor is then charge-eliminated so as to be repetitively used for image formation.

The present invention may also be applied to a color-image forming apparatus of a tandem system.

An embodiment of such a color-image forming apparatus of the tandem system will be described below.

Figure 3:
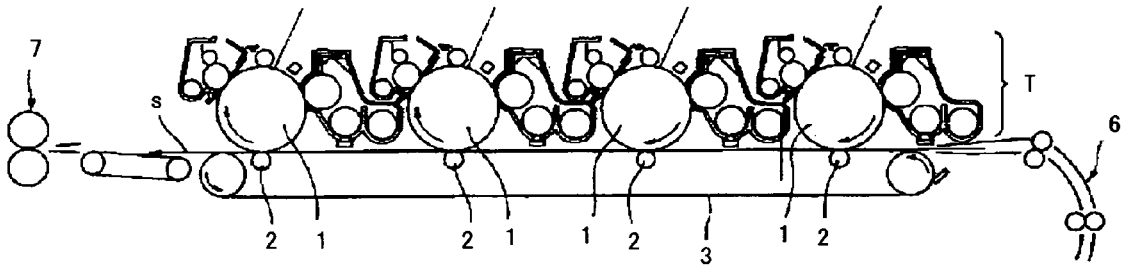
FIG. 3 is a block diagram schematically showing still another example of the image forming apparatus of the present invention.
Figure 4:
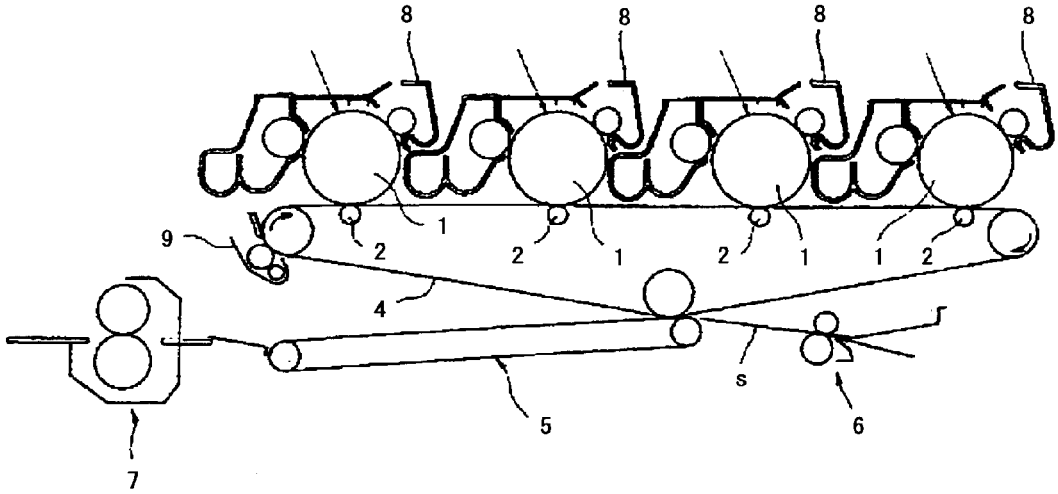
FIG. 4 is a block diagram schematically showing still further another example of the image forming apparatus of the present invention.

Such tandem electrophotographic apparatus are roughly classified as a direct transfer system and an indirect transfer system. In the direct transfer system as shown in FIG. 3, a transferring unit 2 transfers images on individual photoconductors 1 sequentially to a sheet "s" transported by a sheet conveyor belt 3. In the indirect transfer system as shown in FIG. 4, a primary transferring unit 2 sequentially transfers images on individual photoconductors 1 to an intermediate transferring member 4, and a secondary transferring unit 5 transfers the resulting images on the intermediate transferring member 4 to the sheet "s" in a block. The secondary transferring unit 5 is formed in a transfer conveyor belt, however, it may be in the form of a roller.

The direct transfer system must comprise a sheet feeder 6 upstream to the sequentially arrayed photoconductors 1 of the tandem image forming apparatus T and an fixing unit 7 downstream thereof. This is disadvantageous because the system inevitably increases in its size in a sheet transporting direction.

On the contrary, in the indirect transfer system, the secondary transfer mechanism can be relatively freely arranged, and the sheet feeder 6 and the fixing unit 7 can be arranged above and/or below the tandem image forming apparatus T. The apparatus of the indirect transfer system is advantageous in that it can therefore be downsized.

In the direct transfer system, the fixing unit 7 should be arranged in the vicinity of the tandem image forming apparatus T to prevent upsizing of the apparatus in a sheet transporting direction. There are disadvantages in that the sheet "s" cannot sufficiently bend in such a small space between the fixing unit 7 and the tandem image forming apparatus T, accordingly, image formation upstream to the fixing unit 7 is affected by an impact, specifically in a thick sheet, formed when the tip of the sheet "s" enters the fixing unit 7 and by the difference between the transporting speed of the sheet when it passes through the fixing unit 7 and the transporting speed of the sheet by the transfer conveyor belt.

On the contrary, in the indirect transfer system, the sheet "s" can sufficiently bend in a space between the fixing unit 7 and the tandem image forming apparatus T. Thus, the fixing unit 7 does not significantly affect the image formation.

Based on the reasons stated above, in recent years, particularly, the attention has become drawn from an apparatus which employs indirect transfer technique.

This type of color electrophotographic apparatus, as shown in FIG. 4, photoconductor cleaning unit 8 removes a residual toner remaining on photoconductor 1 after a primary transfer to clean the surface of the photoconductor 1 and prepare for subsequent image forming, and intermediate transferring member cleaning unit 9 removes a residual toner remaining on intermediate transfer member 4 after a secondary transfer to clean the surface of the intermediate transfer member 4 and prepare for the subsequent image forming.

With reference to the figures, an embodiment of the present invention will be described.

Figure 5:
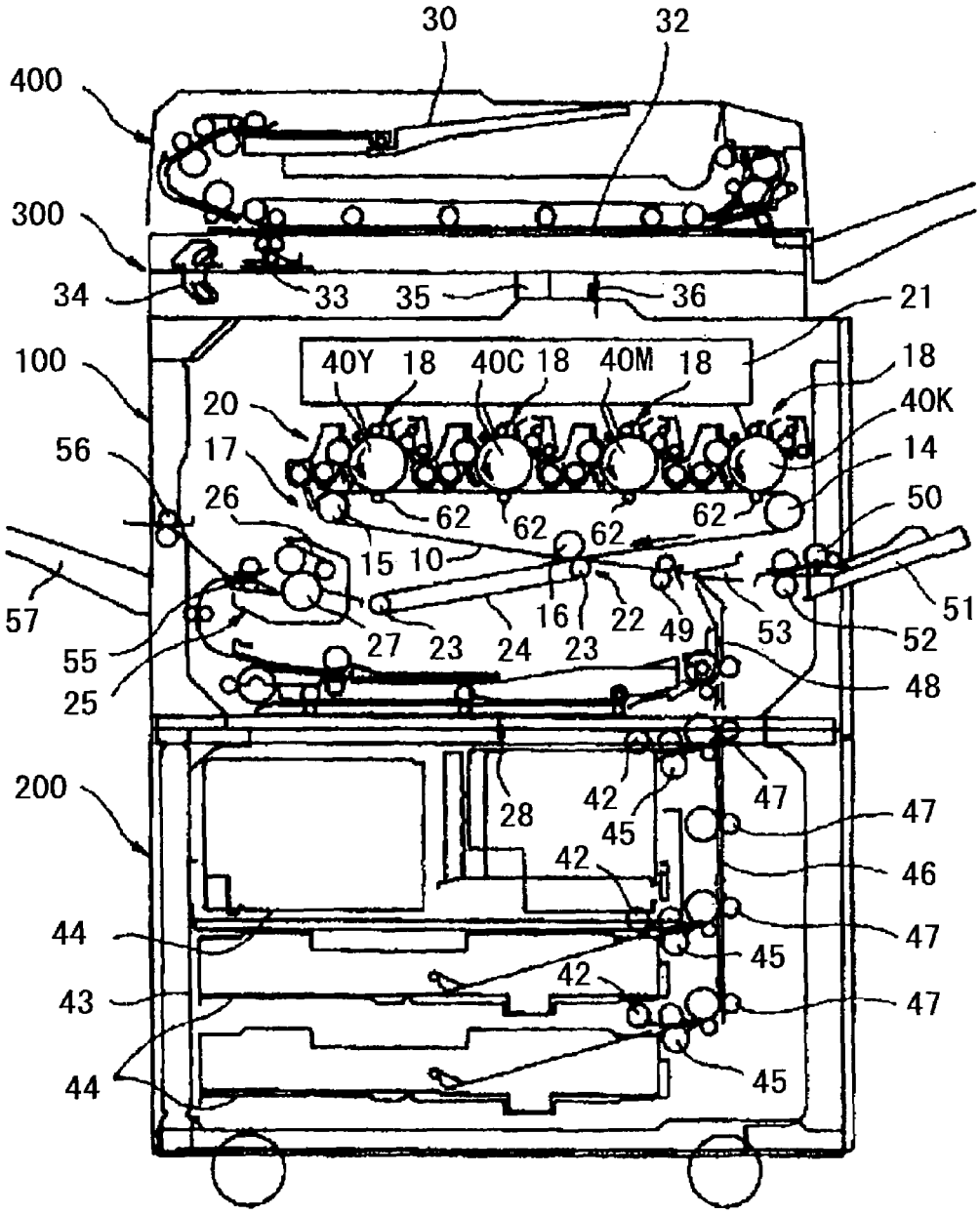
FIG. 5 is a block diagram schematically showing still further another example of the image forming apparatus of the present invention.

In FIG. 5, copier main body 100 comprises sheet feeder table 200, scanner 300 which is mounted on the copier main body 100, and automatic document feeder (ADF) 400 arranged on the scanner 300. Intermediate transferring member 10 formed in an endless belt is arranged at the center of the copier main body 100.

As shown in an illustrated example in FIG. 5, the intermediate transferring member 10 is spanned over three support rollers 14, 15, and 16 and is capable of rotating and moving in a clockwise direction in the figure.

In the illustrated example, on the left side of the second support roller 15 of the three support rollers, intermediate transferring member cleaning unit 17 is arranged, which is capable of removing a residual toner remaining on the intermediate transfer member 10 after image transfer.

Above the intermediate transfer 10 spanned between the first and second support rollers 14 and 15, yellow, cyan, magenta, and black image-forming units 18 are arrayed in parallel in a moving direction of the intermediate transferring member 10 to thereby constitute a tandem image forming apparatus 20.

As shown in FIG. 5, the apparatus further includes exposing unit 21 above the tandem image forming apparatus 20 and secondary transferring unit 22 below the intermediate transfer 10.

In the illustrated example, secondary transferring belt 24 being formed in an endless belt is spanned over between the two rollers 23 to constitute the secondary transferring unit 22, and the secondary transferring unit 22 is arranged so as to be pressed against the third support roller 16 through the intermediate transfer member 10 to transfer the image on the intermediate transfer member 10 onto a sheet.

Next to the secondary transferring unit 22, fixing unit which fixes a transferred image on a sheet is arranged. The fixing unit is constituted such that press pressurizing roller 27 is pressed against fixing belt 26 which is formed in an endless belt.

The secondary transferring unit 22 is also capable of transporting a sheet after image transfer to the fixing unit 25. Naturally, a transfer roller or a non-contact charger can be used as the secondary transferring unit 22. In this case, it is difficult that the secondary transferring unit 22 has the capability of transporting the sheet.

The apparatus shown in FIG. 5 also includes a sheet reverser 28 below the secondary transferring unit 22 and the fixing unit 25 in parallel with the tandem image forming apparatus 20. The sheet reverser 28 is capable of reversing the sheet so as to form images on both sides of the sheet.

A copy is made using the color electrophotographic apparatus in the following manner. Initially, a document is placed on a document platen 30 of the automatic document feeder 400. Alternatively, the automatic document feeder 400 is opened, the document is placed on a contact glass 32 of the scanner 300, and the automatic document feeder 400 is closed to press the document.

When pressing on a start switch (not shown), the document, if any, placed on the automatic document feeder 400 is transported onto the contact glass 32. When the document is initially placed on the contact glass 32, the scanner 300 is immediately driven to operate first carriage 33 and second carriage 34. Light is applied from a light source to the document, and reflected light from the document is further reflected toward the second carriage 34 at the first carriage 33. The reflected light is further reflected by a mirror of the second carriage 34 and passes through image-forming lens 35 into a read sensor 36 to thereby read the document.

When pressing on the start switch (not shown), a drive motor (not shown) rotates and drives one of the support rollers 14, 15 and 16 to thereby allow the residual two support rollers to rotate following the rotation of the one support roller to thereby rotatably convey the intermediate transferring member 10.

Simultaneously, the individual image forming units 18 respectively rotate their photoconductors 40 to thereby form black, yellow, magenta, and cyan monochrome images on the photoconductors 40, respectively. With the conveying intermediate transferring member 10, the monochrome images are sequentially transferred to form a composite color image on the intermediate transfer 10.

Separately, when pressing on the start switch (not shown), one of feeder rollers 42 of the feeder table 200 is selectively rotated, sheets are ejected from one of multiple feeder cassettes 44 in a paper bank 43 and are separated in a separation roller 45 one by one into a feeder path 46, are transported by a transport roller 47 into a feeder path 48 in the copier main body 100 and are bumped against a resist roller 49.

Alternatively, pressing on the start switch rotates a feeder roller 50 to eject sheets on a manual bypass tray 51, the sheets are separated one by one on a separation roller 52 into a manual bypass feeder path 53 and are bumped against the resist roller 49.

The resist roller 49 is rotated synchronously with the movement of the composite color image on the intermediate transferring member 10 to transport the sheet into between the intermediate transferring member 10 and the secondary transferring unit 22, and the composite color image is transferred onto the sheet by action of the secondary transferring unit 22 to thereby record a color image.

The sheet bearing the transferred image is transported by the secondary transferring unit 22 into the fixing unit 25, is applied with heat and pressure in the fixing unit 25 to fix the transferred image, changes its direction by action of switch blade 55, is ejected by an ejecting roller 56 and is stacked on output tray 57.

Alternatively, the sheet changes its direction by action of the switch blade 55 into the sheet reverser 28, turns therein, is transported again to the transfer position, followed by image formation on the back surface of the sheet. The sheet bearing images on both sides thereof is ejected through the ejecting roller 56 onto the output tray 57.

Separately, the intermediate transfer cleaning unit 17 removes a residual toner on the intermediate transferring member 10 after image transfer for another image forming procedure by the tandem image forming apparatus 20.

Herein, the resist roller 49 is typically grounded, however, it is also acceptable to apply a bias thereto for the removal of paper dust of sheet.

Figure 6:
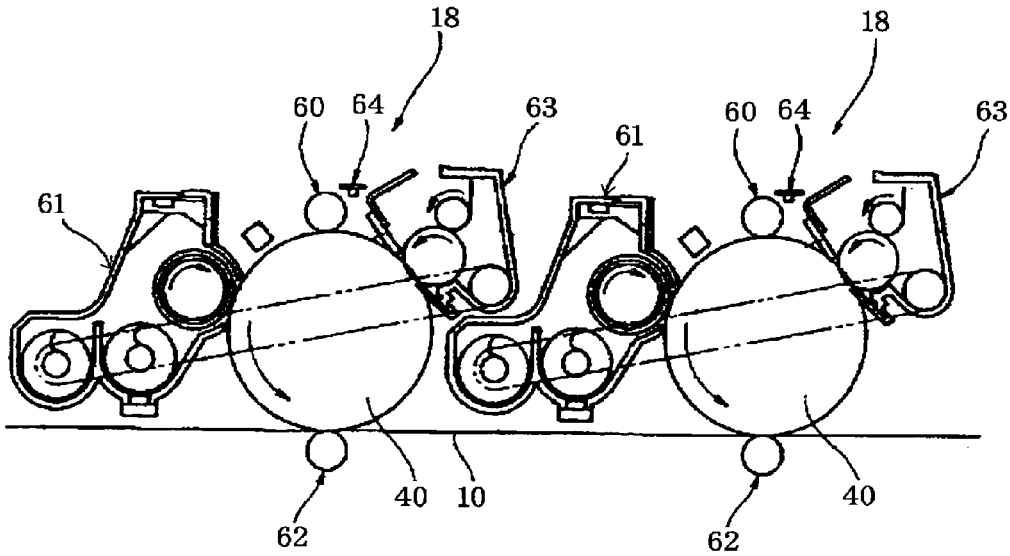
FIG. 6 is a block diagram schematically showing still further another example of the image forming apparatus of the present invention.

In the tandem image forming apparatus as described above, individual image forming units 18, for example, as shown in FIG. 6, specifically comprises charging unit 60, developing unit 61, primary transferring unit 62, photoconductor cleaning unit 63, and charge eliminating unit 64 around photoconductor 40.

Hereafter, the present invention will be described in detail referring to specific examples, however, the present invention is not limited to the disclosed examples. It should be noted that the units represented by "part", "parts", and "%" below are construed on the basis of "mass", namely, as "part by mass", "parts by mass", or "% by mass", unless otherwise noted.

EXAMPLE A (Evaluation of Two-Component Developer)

When images formed with a two-component developer were evaluated, as shown below, by using a ferrite carrier coated by a silicone resin having an average thickness of 0.5 μm thereby having an average particle diameter of 35 μm, 7 parts by mass of each color toner were used relative to 100 parts by mass of the carrier and uniformly mixed using a tabular mixer in which a container was rolling such that the contents therein could be stirred such that the contents were charged to thereby prepare a developer.

(Production of Carrier)

| Core material | |
|---|---|
| Mn ferrite particles (mass average particle diameter: 35 μm) | 5,000 parts |
| **Coat material** | |
| Toluene | 450 parts |
| Silicone resin SR2400 (manufactured by TORAY DOW CORNING CO., LTD.) | 450 parts |
| Aminosilane SH6020 (manufactured by TORAY DOW CORNING CO., LTD.) | 10 parts |
| Carbon black | 10 parts |

The coat materials stated above were dispersed with a stirrer for 10 minutes to prepare a coating solution. The coating solution and the core material were poured into a coating device equipped with a rotatable bottom plate and stirring fans within a flowing bottom while forming swirling flow to coat the coating solution on the core material and then calcined at 250° C. for 2 hours using an electric furnace to thereby obtain the carrier.

(Evaluation System)

The obtained toners were evaluated by using evaluation system A and evaluation system B. The evaluation system A was remodeled from a full-color laser printer, IPSiO 8000 (manufactured by Ricoh Co., Ltd.) in which developing units for four colors sequentially develop each of color toners on one belt-photoconductor, and the developed images are sequentially transferred to an intermediate transfer member, and then four color images are transferred onto a sheet paper or the like in block. The full-color laser printer, IPSiO 8000, was remodeled by mounting a contact charger, an amorphous silicon photoconductor, and a SURF (surface rapid fusing) fixing unit thereon such that an oscillating bias voltage with an alternating-current electricity being overlapped with a direct-current electricity was applied to the full-color laser printer and further adding the above-mentioned photoconductor, the charging unit, the developing units, and a cleaning unit so as to be integrally composed as a process cartridge. For the evaluation system B, the evaluation system A was further remodeled so that the SURF fixing unit used in the evaluation system A was changed to an oil-less SURF fixing unit. It is noted that in Example A, the same developer was placed in the four-color developing units, respectively.

(Evaluation Items)

In the following evaluation items, after outputting 10,000 sheets of a 7% image-area ratio chart, evaluations detailed below were carried out.

(1) Embedded External Additives

The toner was stored at 40° C. with a 80% humidity for 1 week and stirred in the developing units in the evaluation system A for 1 hour, and then the surface of the toner was observed as to the conditions of embedded external additives using a FE-SEM (field emission scanning electron microscope S-4200, manufactured by Hitachi, Ltd.). In this evaluation item, the smaller the amount of embedded external additives was, the more excellent the toner was. The results of the embedded external additives were ranked in order of excellence as A, B, C, and D.

(2) Cleaning Ability

Using the evaluation system A, after outputting 100 sheets, a toner after transfer remaining on the photoconductor which had gone through a cleaning step was transferred onto a white paper sheet using a scotch tape (manufactured by Sumitomo 3M Ltd.) to measure the reflection density using a reflection densitometer (Macbeth reflection densitometer RD514). A toner which had a difference in reflection density from that of the blank portion of the paper being less than 0.005 was evaluated as A, a toner which had a difference thereof being 0.005 to 0.010 was evaluated as B, a toner which had a difference thereof being 0.011 to 0.02 was evaluated as C, and a toner which had a difference thereof being more than 0.02 was evaluated as D.

(3) Image Density

Using the evaluation system A, after outputting 150,000 sheets of a 50% image-area ratio chart in monochrome mode, the solid image was output on a sheet (paper 6000, manufactured by Ricoh, Co., Ltd.), and then the image density of the toners were measured by using a spectrodensitometer (manufactured by X-Rite Inc.). In the measurement, image densities of four color images were individually measured, and then the average of the image densities was calculated. When the value was less than 1.2, it was ranked as D. When the value was 1.2 or more and less than 1.4, it was ranked as C. When the value was 1.4 or more and less than 1.8, it was ranked as B. When the value was 1.8 or more and less than 2.2, it was ranked as A.

(4) Image Graininess and Image Sharpness

Using the evaluation system B, a photographic image was output in monochrome mode, and the graininess level and the sharpness level of the photographic image were visually evaluated. The results of image graininess and image sharpness were ranked in order of excellence as A, B, C, and D. The image ranked as A was equivalent to those of offset printing. The image ranked as B was slightly inferior to those of offset printing. The image ranked as C was considerably inferior to those of offset printing, and the image ranked as D was poor in graininess and sharpness and was equivalent to those of conventional electrophotographic images.

(5) Background Smear

Using the evaluation system A, after outputting 30,000 sheets of a 50% image-area ratio chart in monochrome mode, a blank image was stopped during developing, and the developer remaining on the photoconductor after the developing was transferred onto a white paper sheet with a tape, and the difference in image density from that of a tape with no developer transferred thereto was measured using Spectro Densitometer 938 (manufactured by X-Rite Inc.). In this evaluation item, the lesser the difference in image density was, the more excellent the level of background smear was. The results of background smear were ranked in order of excellence as A, B, C, and D.

(6) Thin Spots in Printed Letters

Using the evaluation system A, after outputting 30,000 sheets of a 50% image-area ratio chart in monochrome mode, the image of letter portion was output to an OHP sheet (Type DX, manufactured by Ricoh Co., Ltd.) with a condition of four color toners superimposed thereon, and then the toner-untransferred frequency that the inner portions of a linear image had not been printed in the letter portion was compared with gradual samples of thin spots. The toner ranked as 1 was poor in the evaluation of thin spots in printed letters, and the toner ranked as 5 was excellent. When the toner was ranked as 1 or 2, it was evaluated as D. When the toner was ranked as 3, it was evaluated as C. When the toner was ranked as 4, it was evaluated as B, and when the toner was ranked as 5, it was evaluated as A.

(7) Toner Flowability

On a powder tester (PT-N, manufactured by Hosokawa Micron Ltd.), a 22 μm mesh, a 45 μm mesh, and a 75 μm mesh were placed and attached in this order, 2 g of the toner base particles were placed on the 75 μm mesh which was placed at the top. Vibrations of 1 mm were vertically given to the 75 μm mesh for 10 seconds. Flowability of the toner base particles (flocculation degree) was calculated from the residual amount of toner on each of these meshes.

Flocculation degree (%)=(5×(residual amount of toner on the 75 μm mesh (g))+3×(residual amount of toner on the 45 μm mesh (g))+(residual amount of toner on the 22 μm mesh (g))×10

The toner having a flocculation degree of 8% or less was evaluated as A. The toner having an flocculation degree of 8% to 16% was evaluated as B. The toner having an flocculation degree of 16% to 25% was evaluated as C, and the toner having an flocculation degree of 25% or more was evaluated as D.

(8) Fixing Property

Using the evaluation system A, a solid image was printed on transferring sheets of regular paper and heavy paper (duplicator printing paper 6200 and NBS <135>, respectively manufactured by Ricoh Co., Ltd.) with a toner adhesion amount of 0.85 mg/cm$^2$±0.1 mg/cm$^2$ and then evaluated as to fixing property. The evaluation of fixing was tested while varying the temperature of the fixing belt, and the upper limit fixing temperature at which no hot-offset had occurred was taken as the upper limit fixing temperature. The lower limit fixing temperature was measured using heavy paper. A fixing roll temperature at which the residual ratio of the image density after patting the surface of the obtained fixed image with a pat had been 70% or more was taken as the lower limit fixing temperature. A toner having an upper limit fixing temperature of 190° C. or more was evaluated as A. A toner having an upper limit fixing temperature of 190° C. to 180° C., it was evaluated as B. A toner having an upper limit fixing temperature of 180° C. to 170° C., it was evaluated as C. A toner having an upper limit fixing temperature of 170° C. or less, it was evaluated as D. In addition, a toner having a lower limit fixing temperature of 135° C. or less, it was evaluated as A. A toner having a lower limit fixing temperature of 135° C. to 145° C., it was evaluated as B. A toner having a lower limit fixing temperature of 145° C. to 155° C., it was evaluated as C. A toner having a lower limit fixing temperature of 155° C. or more, it was evaluated as D.

EXAMPLE A-1

The following paragraphs explain the detailed method of producing a toner in due order from (1) to (12), the toner is a toner which comprises one or more inorganic fine particles and is produced by dissolving or dispersing a toner composition which includes a binder resin containing a modified polyester resin capable of reacting with a compound having an active hydrogen group, colorants, and a releasing agent in an organic solvent, further dispersing the toner composition solution or the toner composition dispersion liquid in an aqueous solvent containing resin fine particles to be subjected to an elongation and/or a cross-linking reaction, removing the organic solvent from the obtained dispersion liquid, and washing and drying the dispersion liquid.

(1) Production Example of Inorganic Fine Particles

An initial core material solution $SiCl_4$ was injected to a burner for forming the core of inorganic fine particles with an Ar gas as a carrier gas at a volume flow rate of 300 SCCM (standard volume flow rate per minute (cc)) by using a liquid material feeding apparatus to feed a $SiCl_4$ vapor of a volume flow rate of 250 SCCM together with a $H_2$ gas of a volume flow rate of 20 SCCM (standard volume flow rate per minute (cc)) and an $O_2$ gas of 20 SLM in the burner to flame hydrolyze and fuse them together to thereby obtain $SiO_2$ fine particles. The fine particles were matured till they had a given primary particle diameter, and the obtained fine particles were hydrophobized with hexamethyldisilasan to thereby obtain [inorganic fine particles 1] having an average fine particle diameter of 5 nm.

(2) Synthesis of Organic Fine Particle Emulsion

To a reaction vessel equipped with a stirrer and a thermometer, 683 parts of water, 11 parts of sodium salt of the sulfuric acid ester of methacrylic acid ethylene oxide adduct (ELEMINOL RS-30, manufactured by Sanyo Chemical Industries, Ltd.), 83 parts of styrene, 83 parts of methacrylic acid, 110 parts of butyl acrylate, and 1 part of ammonium persulphate were poured and stirred at 400 rpm for 15 minutes to obtain a white emulsion. The white emulsion was heated, the temperature in the system was raised to 75° C., and the reaction was performed for 5 hours. Next, 30 parts of an aqueous solution of 1% ammonium persulphate was further added, and the reaction mixture was matured at 75° C. for 5 hours to obtain an aqueous dispersion liquid of a vinyl resin (copolymer of styrene-methacrylic acid-butyl acrylate-sodium salt of the sulfuric acid ester of methacrylic acid ethylene oxide adduct) [particulate emulsion 1]. The volume average particle diameter of the [particulate emulsion 1] measured by LA-920 was 105 nm. After drying a part of [particulate emulsion 1] and isolating the resin, the glass transition temperature (Tg) of the resin was 59° C. and the mass average molecular mass was 150,000.

(3) Preparation of Aqueous Phase

To 990 parts of water, 80 parts of [particulate emulsion 1], 37 parts of a 48.5% aqueous solution of sodium dodecyl diphenylether disulfonic acid (ELEMINOL MON-7, manufactured by Sanyo Chemical Industries, Ltd.) and 90 parts of ethyl acetate were mixed and stirred together to obtain a milky liquid. This was taken as [aqueous phase 1].

(4) Synthesis of Low-Molecular Polyester

In a reaction vessel equipped with a condenser tube, a stirrer, and a nitrogen inlet tube, 229 parts of bisphenol A ethylene oxide dimolar adduct, 529 parts of bisphenol A propylene oxide trimolar adduct, 208 parts of terephthalic acid, 46 parts of adipic acid and 2 parts of dibutyl tin oxide were poured, and the reaction was performed under normal pressure at 230° C. for 8 hours, and the reaction was further performed under a reduced pressure of 10 mmHg to 15 mmHg for 5 hours, then 44 parts of anhydrous trimellitic acid was added to the reaction vessel, and the reaction was performed at 180° C. under normal pressure for 2 hours to obtain [low molecular weight polyester 1]. [Low molecular weight polyester 1] had a number average molecular mass of 2,500, a mass average molecular mass of 6,700, a glass transition temperature (Tg) of 43° C. and an acid value of 25.

(5) Synthesis of Intermediate Polyester

In a reaction vessel equipped with a condenser tube, a stirrer, and a nitrogen inlet tube, 682 parts of bisphenol A ethylene oxide dimolar adduct, 81 parts of bisphenol A propylene oxide dimolar adduct, 283 parts of terephthalic acid, 22 parts of anhydrous trimellitic acid and 2 parts of dibutyl tin oxide were poured, and the reaction was performed under normal pressure at 230° C. for 8 hours, and then the reaction was further performed under a reduced pressure of 10 mmHg to 15 mmHg for 5 hours to obtain

[intermediate polyester 1]. [Intermediate polyester 1] had a number average molecular mass of 2,100, a mass average molecular mass of 9,500, a glass transition temperature (Tg) of 55° C., an acid value of 0.5, and a hydroxyl value of 51.

(6) Synthesis of Modified Polyester Resin (Prepolymer 1) Capable of Reacting with a Compound Having at Least an Active Hydrogen Group In a reaction vessel equipped with a condenser, a stirrer, and a nitrogen inlet tube, 410 parts of the [intermediate polyester 1], 89 parts of isophorondiisocyanate, and 500 parts of ethyl acetate were poured, and the reaction was performed at 100° C. for 5 hours to obtain [prepolymer 1]. [Prepolymer 1] had a free isocyanate content of 1.53% by mass.

(7) Synthesis of Ketimine

Into a reaction vessel equipped with a stirrer and a thermometer, 170 parts of isophorone diamine and 75 parts of methyl ethyl ketone were poured, and the reaction was performed at 50° C. for 5 hours to obtain [ketimine compound 1]. The amine value of [ketimine compound 1] was 418.

(8) Synthesis of Masterbatch

To 1,200 parts of water, 40 parts of carbon black (Regal 400R, manufactured by Cabot Corp.), 60 parts of polyester resin (RS801, manufactured by Sanyo Chemical Industries, Ltd.), and further 30 parts of water were added and mixed in HENSCHEL MIXER (manufactured by MITSUI MINING CO., LTD.), then the mixture was kneaded at 150° C. for 30 minutes using two rollers, extrusion cooled and crushed with a pulverizer to obtain [masterbatch 1].

(9) Preparation of Toner Composition Containing Oil Phase, i.e. Inorganic Fine Particles Into a vessel equipped with a stirrer and a thermometer, 400 parts of the [low molecular weight polyester 1], 110 parts of carnauba wax, and 947 parts of ethyl acetate were poured, and the temperature was raised to 80° C. with stirring, maintained at 80° C. for 5 hours and cooled to 30° C. in 1 hour. Next, 500 parts of [masterbatch 1] and 500 parts of ethyl acetate were poured into the vessel, and mixed for 1 hour to obtain [initial material solution 1].

To a vessel, 1,324 parts of [initial material solution 1] were transferred, and the wax was dispersed three times using a bead mill (Ultra Visco Mill, manufactured by AIMEX CO., LTD.) under the conditions of liquid feed rate of 1 kg/hr, disc circumferential speed of 6 m/s, and 0.5 mm zirconia beads packed to 80% by volume. Next, 1,324 parts of 65% ethyl acetate solution of [low molecular weight polyester 1] and 1.7 parts of the [inorganic fine particles 1] were added to the vessel and dispersed once using the bead mill under the above-noted conditions to obtain [pigment-wax dispersion liquid 1]. The solids concentration of [pigment-wax dispersion liquid 1] (130° C. for 30 minutes) was 50%.

(10) Emulsification

In a vessel, 648 parts of [pigment-wax dispersion liquid 1], 154 parts of [prepolymer 1], and 8.5 parts of [ketimine compound 1] were poured and mixed at 5,000 rpm for 1 minute by a TK homomixer (manufactured by TOKUSHU KIKA KOGYO CO., LTD.), then 1,200 parts of [aqueous phase 1] were added to the vessel and mixed in the TK homomixer at a rotation speed of 10,000 rpm for 20 minutes to obtain [emulsion slurry 1].

Namely, the [pigment-wax dispersion liquid 1], the [prepolymer 1], and the [ketimine compound 1] were dispersed in an aqueous medium containing resin fine particles as well as subjected to an elongation and/or a cross-linking reaction.

(11) Removal of Solvent

[Emulsion slurry 1] was poured in a vessel equipped with a stirrer and a thermometer, then the solvent was removed at 30° C. for 8 hours, and the product was matured at 45° C. for 4 hours to obtain [dispersion slurry 1].

(12) Rinsing and Drying

After filtering 100 parts of [dispersion slurry 1] under reduced pressure, the following treatments were carried out.

(1) 100 parts of ion exchange water were added to the filter cake and mixed in a TK homomixer (rotation speed 12,000 rpm for 10 minutes) and filtered.

(2) 100 parts of 10% sodium hydroxide solution were added to the filter cake of (1) and mixed in the TK homomixer (rotation speed 12,000 rpm for 30 minutes) and filtered.

(3) 100 parts of 10% hydrochloric acid were added to the filter cake of (2) and mixed in the TK homomixer (rotation speed 12,000 rpm for 10 minutes) and filtered.

(4) 300 parts of ion exchange water were added to the filter cake of (3) and mixed in the TK homomixer (rotation speed 12,000 rpm for 10 minutes), and filtered twice to obtain [filter cake 1].

[Filter cake 1] was dried in a circulating air dryer at 45° C. for 48 hours and then sieved through a sieve of 75 μm mesh to obtain [toner base particles 1].

(13) Preparation of Toner with External Additives Adhered on the Surface Thereon In HENSCHEL MIXER, 100 parts by mass of the toner base particles and 1.0 part by mass of hydrophobic silica (HDK H2000, manufactured by Clariant Japan K.K.) were mixed and then passed through a sieve of 38 μm mesh to remove the agglomerate to thereby obtain [toner 1]. Table 1 shows the volume average particle diameter, the ratio Dv/Dn, and the circularity of the obtained [toner 1].

Using a tabular mixer with a container rolling such that the contents therein can be stirred, 7 parts by mass of the thus obtained [toner 1] and 100 parts by mass of carrier were uniformly mixed and charged to thereby prepare a developer.

With respect to the obtained toners or the developers, Table 2 show the evaluation results as to the above-mentioned eight evaluation items through the use of the individual image-evaluation systems.

EXAMPLE A-2

[Toner 2] was obtained in the same manner as Example A-1 except that the amount of [particulate emulsion 1] was changed to 65 parts in the preparation of the aqueous phase, and the amount of [inorganic fine particles 1] was changed to 34 parts in the preparation of the oil phase. Table 2 shows the evaluation results of the obtained toner through the use of the individual image-evaluation systems.

EXAMPLE A-3

[Toner 3] was obtained in the same manner as Example A-1 except that the amount of [particulate emulsion 1] was changed to 120 parts in the preparation of the aqueous phase, and the amount of [inorganic fine particles 1] was changed to 4,421 parts in the preparation of the oil phase. Table 2 shows the evaluation results of the obtained toner through the use of the individual image-evaluation systems.

EXAMPLE A-4

[Toner 4] was obtained in the same manner as Example A-1 except that [inorganic fine particles 1] in the preparation of the oil phase was changed to 177 parts of a hydrophobic silica having an average primary particle diameter of 10 nm (HDK H2000, manufactured by Clariant Japan K.K.). Table 2 shows the evaluation results of the obtained toner through the use of the individual image-evaluation systems.

EXAMPLE A-5

[Inorganic fine particles 2] having an average primary particle diameter of 180 nm were prepared in the same manner as the production example of inorganic fine particles used in Example A-1, and [toner 5] was obtained in the same manner as Example A-1 except that 177 parts of [inorganic fine particles 2] was used in the preparation of the oil phase. Table 2 shows the evaluation results of the obtained toner through the use of the individual image-evaluation systems.

EXAMPLE A-6

[Toner 6] was obtained in the same manner as Example A-1 except that in the preparation of the oil phase [inorganic fine particles 1] was changed to 118 parts of a hydrophobic silica having an average primary particle diameter of 10 nm (HDK H2000, manufactured by Clariant Japan K.K.) and 59 parts of a hydrophobic titanium oxide having an average primary particle diameter of 15 nm (MT-150AFM, manufactured by Teika K.K.). Table 2 shows the evaluation results of the obtained toner through the use of the individual image-evaluation systems.

EXAMPLE A-7

[Toner 7] was obtained in the same manner as Example A-1 except that the amount of [particulate emulsion 1] was changed to 95 parts in the preparation of the aqueous phase, [inorganic fine particles 1] in the preparation of the oil phase was changed to 176 parts of a hydrophobic silica having an average primary particle diameter of 10 nm (HDK H2000, manufactured by Clariant Japan K.K.), and the amount of [ketimine compound] was changed to 7.5 parts in the emulsification. Table 2 shows the evaluation results of the obtained toner through the use of the individual image-evaluation systems.

EXAMPLE A-8

[Toner 8] was obtained in the same manner as Example A-1 except that the amount of [particulate emulsion 1] was changed to 95 parts in the preparation of the aqueous phase, [inorganic fine particles 1] in the preparation of the oil phase was changed to 176 parts of a hydrophobic silica having an average primary particle diameter of 10 nm (HDK H2000, manufactured by Clariant Japan K.K.), the amount of [ketimine compound] in the emulsification was changed to 6.6 parts, and the number of rotation of the homomixer at the time of mixing [aqueous phase 1] was changed to 13,000 rpm. Table 2 shows the evaluation results of the obtained toner through the use of the individual image-evaluation systems.

Comparative Example A-1

[Toner 9] was obtained in the same manner as Example A-1 except that in the preparation of the oil phase [inorganic fine particles 1] was not added, the amount of [ketimine compound] was changed to 6.6 parts in the emulsification, and the number of rotation of the homomixer at the time of mixing [aqueous phase 1] was changed to 13,000 rpm.

TABLE 1

| | | Presence or Absence of inorganic fine particles | Amount of inorganic fine particles (% by mass) analyzed by Fluorescent x-ray spectroscopy | Primary particle diameter (nm) of Inorganic fine particles (Silica) | Primary particle diameter (nm) of Inorganic fine particles (Titanium Oxide) | XPS analytical value (atomic %) | Toner particle diameter (μm) | Toner Dv/Dn | Circularity |
|---|---|---|---|---|---|---|---|---|---|
| Ex. A-1 | Toner 1 | With | 0.05 | 5 | — | 0.04 | 7.2 | 1.28 | 0.94 |
| Ex. A-2 | Toner 2 | With | 1.05 | 5 | — | 0.86 | 8.5 | 1.30 | 0.92 |
| Ex. A-3 | Toner 3 | With | 48.86 | 5 | — | 14.25 | 1.8 | 1.17 | 0.92 |
| Ex. A-4 | Toner 4 | With | 4.93 | 10 | — | 4.75 | 7.2 | 1.30 | 0.94 |
| Ex. A-5 | Toner 5 | With | 3.25 | 180 | — | 4.83 | 7.5 | 1.27 | 0.94 |
| Ex. A-6 | Toner 6 | With | 5.02 | 10 | 15 | 4.91 | 7.4 | 1.27 | 0.93 |
| Ex. A-7 | Toner 7 | With | 4.94 | 10 | 15 | 5.01 | 5.2 | 1.15 | 0.94 |
| Ex. A-8 | Toner 8 | With | 4.86 | 10 | 15 | 4.99 | 4.8 | 1.13 | 0.98 |
| Compara. Ex. A-1 | Toner 9 | Without | 0.00 | — | — | 0.00 | 5.2 | 1.13 | 0.98 |

TABLE 2

| | Embedded External Additives | Cleaning-ability | Image Density | Image Graininess/ Sharpness | Background Smear | Thin spots in printed letters | Toner Flowability | Fixing Property: Lower limit fixing temperature | Fixing Property: Upper limit fixing temperature |
|---|---|---|---|---|---|---|---|---|---|
| Ex. A-1 | C | B | B | C | B | B | B | B | B |
| Ex. A-2 | B | A | B | B | B | B | A | B | B |
| Ex. A-3 | A | A | B | B | B | B | A | B | B |
| Ex. A-4 | A | A | A | B | B | B | A | B | B |

TABLE 2-continued

| | Embedded External Additives | Cleaning-ability | Image Density | Image Graininess/ Sharpness | Background Smear | Thin spots in printed letters | Toner Flowability | Fixing Property Lower limit fixing temperature | Fixing Property Upper limit fixing temperature |
|---|---|---|---|---|---|---|---|---|---|
| Ex. A-5 | A | A | A | C | B | C | B | C | A |
| Ex. A-6 | A | A | A | B | A | A | A | B | B |
| Ex. A-7 | A | A | A | A | A | A | A | B | B |
| Ex. A-8 | A | A | A | A | A | A | A | B | B |
| Compara. Ex. A-1 | D | C | B | B | D | C | D | B | B |

As is clear from the detained and specific explanations stated above, according to the present invention, it is possible to provide a developer which has a sharp charge amount distribution, enables forming high-quality images without used external additives being embedded into the toner and without substantially smearing a charging unit, a developing unit, a photoconductor, and an intermediate transfer member by the developer even after being stored in high-temperature and high-humidity environment, and is capable of exhibiting an appropriate image density and extremely little background smear even when repeatedly used for a number of sheets of paper for a long period of time, and it is also possible to provide an image developing unit for electrophotography using the developer. This is enabled by using the toner produced by dissolving or dispersing a toner composition which includes a binder resin containing a modified polyester resin capable of reacting with a compound having an active hydrogen group, colorants, and a releasing agent in an organic solvent, further dispersing the toner composition solution or the toner composition dispersion liquid in an aqueous solvent containing resin fine particles to be subjected to an elongation and/or a cross-linking reaction, removing the organic solvent from the obtained dispersion liquid, washing and drying the dispersion liquid. It is also possible to provide a developer which is excellent in flowability and capable of forming reproductive and steady images to any transferring media without image blur, dust, and transferring omissions as well as to provide an image developing unit for electrophotography. Further, it is possible to provide a toner capable of responding to a low-temperature fixing system while keeping excellent cleaning ability and anti-offset property without smearing fixing units and images. When the toner is loaded to a process cartridge, similarly, excellent effects are exhibited. In addition, it is possible to provide an image forming apparatus in which a charging unit capable of reducing occurrence of ozone, a photoconductor having a high surface hardness and exhibiting high sensitivity to light at long wavelengths such as a semiconductor laser (770 nm to 800 nm) without exhibiting substantial deterioration caused by repetitive use, and a fixing unit which is capable of effectively shortening the warm-up time.

EXAMPLE B

EXAMPLE B-1

Hereinafter, a toner for electrophotography which is an preferred embodiment of the present invention will be described in due order, the toner for electrophotography is produced by removing the organic solvent from the dispersion liquid, and further subjecting the particles to a surface treatment using a fluorine-containing compound to thereby obtain toner base particles of the toner.

Production Example of Inorganic Fine Particles

An initial core material solution $SiCl_4$ was injected to a burner for forming the core of inorganic fine particles with an Ar gas as a carrier gas at a volume flow rate of 300 SCCM (standard volume flow rate per minute (cc)) by using a liquid material feeding apparatus to feed a $SiCl_4$ vapor of a volume flow rate of 250 SCCM together with a $H_2$ gas of a volume flow rate of 20 SCCM (standard volume flow rate per minute (cc)) and an $O_2$ gas of 20 SLM in the burner to flame hydrolyze and fuse them together to thereby obtain $SiO_2$ fine particles. The fine particles were matured till they had a given primary particle diameter, and the obtained fine particles were hydrophobized with hexamethyldisilasan to thereby obtain [inorganic fine particles 1] having an average fine particle diameter of 5 nm.

Synthesis of Organic Fine Particle Emulsion

To a reaction vessel equipped with a stirrer and a thermometer, 683 parts of water, 11 parts of sodium salt of the sulfuric acid ester of methacrylic acid ethylene oxide adduct (ELEMINOL RS-30, manufactured by Sanyo Chemical Industries, Ltd.), 80 parts of styrene, 83 parts of methacrylic acid, 110 parts of butyl acrylate, 12 parts of butyl thioglycollate, and 1 part of ammonium persulphate were poured and stirred at 400 rpm for 15 minutes to obtain a white emulsion. The white emulsion was heated, the temperature in the system was raised to 75° C. and the reaction was performed for 5 hours. Next, 30 parts of an aqueous solution of 1% ammonium persulphate was further added to the reaction vessel, and the reaction mixture was matured at 75° C. for 5 hours to obtain an aqueous dispersion liquid of a vinyl resin (copolymer of styrene-methacrylic acid-butyl acrylate-sodium salt of the sulfuric acid ester of methacrylic acid ethylene oxide adduct). This aqueous solution was taken as [particulate emulsion 1]. The volume average particle diameter of the [particulate emulsion 1] measured by a laser diffraction particle size distribution analyzer (LA-920, manufactured by SHIMADZU Corp.) was 120 nm. After drying a part of [particulate emulsion 1] and isolating the resin, the glass transition temperature (Tg) of the resin was 42° C. and the mass average molecular mass was 30,000.

Preparation of Aqueous Phase

To 990 parts of water, 65 parts of [particulate emulsion 1], 37 parts of a 48.5% aqueous solution of sodium dodecyl diphenylether disulfonic acid (ELEMINOL MON-7, manufactured by Sanyo Chemical Industries, Ltd.) and 90 parts of ethyl acetate were mixed and stirred together to obtain a milky liquid. This was taken as [aqueous phase 1].

Synthesis of Low-Molecular Polyester

In a reaction vessel equipped with a condenser tube, a stirrer, and a nitrogen inlet tube, 229 parts of bisphenol A ethylene oxide dimolar adduct, 529 parts of bisphenol A propylene oxide trimolar adduct, 208 parts of terephthalic acid, 46 parts of adipic acid and 2 parts of dibutyl tin oxide were poured, and the reaction was performed under normal pressure at 230° C. for 8 hours, and the reaction was further performed under a reduced pressure of 10 mmHg to 15 mmHg for 5 hours, then 44 parts of anhydrous trimellitic acid was added to the reaction vessel, and the reaction was performed at 180° C. under normal pressure for 2 hours to obtain [low molecular weight polyester 1]. [Low molecular weight polyester 1] had a number average molecular mass of 2,500, a mass average molecular mass of 6,700, a glass transition temperature (Tg) of 43° C. and an acid value of 25.

Synthesis of Intermediate Polyester

In a reaction vessel equipped with a condenser tube, a stirrer, and a nitrogen inlet tube, 682 parts of bisphenol A ethylene oxide dimolar adduct, 81 parts of bisphenol A propylene oxide dimolar adduct, 283 parts of terephthalic acid, 22 parts of anhydrous trimellitic acid and 2 parts of dibutyl tin oxide were poured, and the reaction was performed under normal pressure at 230° C. for 8 hours, and then the reaction was further performed under a reduced pressure of 10 mmHg to 15 mmHg for 5 hours to obtain [Intermediate polyester 1]. [Intermediate polyester 1] had a number average molecular mass of 2,100, a mass average molecular mass of 9,500, a glass transition temperature (Tg) of 55° C., an acid value of 0.5 and a hydroxyl value of 51.

Synthesis of Modified Polyester Resin (Prepolymer 1) Capable of Reacting with a Compound Having at Least an Active Hydrogen Group In a reaction vessel equipped with a condenser, a stirrer, and a nitrogen inlet tube, 410 parts of [intermediate polyester 1], 89 parts of isophorondiisocyanate, and 500 parts of ethyl acetate were poured, and the reaction was performed at 100° C. for 5 hours to obtain [prepolymer 1]. [Prepolymer 1] had a free isocyanate content of 1.53% by mass.

Synthesis of Ketimine

Into a reaction vessel equipped with a stirrer and a thermometer, 170 parts of isophorone diamine and 75 parts of methyl ethyl ketone were poured, and the reaction was performed at 50° C. for 5 hours to obtain [ketimine compound 1]. The amine value of [ketimine compound 1] was 418.

Synthesis of Masterbatch

To 1,200 parts of water, 40 parts of carbon black (Regal 400R, manufactured by Cabot Corp.), 60 parts of polyester resin (RS801, manufactured by Sanyo Chemical Industries, Ltd.), and further 30 parts of water were added and mixed in HENSCHEL MIXER (manufactured by MITSUI MINING CO., LTD.), then the mixture was kneaded at 150° C. for 30 minutes using two rollers, extrusion cooled and crushed with a pulverizer to obtain [masterbatch 1].

Preparation of Toner Composition Containing Oil Phase, i.e. Inorganic Fine Particles Into a vessel equipped with a stirrer and thermometer, 400 parts of [low molecular weight polyester 1], 110 parts of carnauba wax, and 947 parts of ethyl acetate were poured, and the temperature was raised to 80° C. with stirring, maintained at 80° C. for 5 hours, and then cooled to 30° C. in 1 hour. Next, 500 parts of [masterbatch 1] and 500 parts of ethyl acetate were poured into the vessel, and mixed for 1 hour to obtain [initial material solution 1].

To a vessel, 1,324 parts of [initial material solution 1] were transferred, and the wax were dispersed three times using a bead mill (Ultra Visco Mill, manufactured by AIMEX CO., LTD.) under the conditions of liquid feed rate 1 kg/hr, disc circumferential speed of 6 m/s, and 0.5 mm zirconia beads packed to 80% by volume. Next, 1,324 parts of a 65% ethyl acetate solution of [low molecular weight polyester 1] and 34 parts of [inorganic fine particles 1] were added and dispersed once by the bead mill under the above-noted conditions to obtain [pigment-wax dispersion liquid 1]. The solids concentration of [pigment-wax dispersion liquid 1] (130° C. for 30 minutes) was 50%.

Emulsification

In a vessel, 648 parts of [pigment-wax dispersion liquid 1], 154 parts of [prepolymer 1], and 8.5 parts of [ketimine compound 1] were poured and mixed at 5,000 rpm for 1 minute by a TK homomixer (manufactured by TOKUSHU KIKA KOGYO CO., LTD.), then 1,200 parts of [aqueous phase 1] were added to the vessel and mixed in the TK homomixer at a rotation speed of 10,000 rpm for 20 minutes to obtain [emulsion slurry 1].

Namely, [pigment-wax dispersion liquid 1], [prepolymer 1], and [ketimine compound 1] were dispersed in an aqueous medium containing resin fine particles as well as subjected to an elongation and/or a cross-linking reaction.

Removal of Solvent

[Emulsion slurry 1] was poured in a vessel equipped with a stirrer and a thermometer, then the solvent was removed at 30° C. for 8 hours and the product was matured at 45° C. for 4 hours to obtain [dispersion slurry 1].

Rinsing, Drying, and Fluorination

After filtering 100 parts of [dispersion slurry 1] under reduced pressure, the following treatments were carried out.

(1) 100 parts of ion exchange water were added to the filter cake and mixed in a TK homomixer (rotation speed 12,000 rpm for 10 minutes) and filtered.

(2) 100 parts of 10% sodium hydroxide solution were added to the filter cake of (1) and mixed in the TK homomixer (rotation speed 12,000 rpm for 30 minutes) and filtered.

(3) 100 parts of 10% hydrochloric acid were added to the filter cake of (2) and mixed in the TK homomixer (rotation speed 12,000 rpm for 10 minutes) and filtered.

(4) 300 parts of ion exchange water were added to the filter cake of (3) and mixed in the TK homomixer (rotation speed 12,000 rpm for 10 minutes), and filtered twice to obtain a cake. This was taken as [filter cake 1].

[Filter cake 1] was dried in a circulating air dryer at 45° C. for 48 hours.

Thereafter, to 90 parts of water, 15 parts of [filter cake 1] were added, and then 0.0005 parts of a fluorine compound (compound 2 as shown in the examples) were dispersed therein to thereby make the fluorine compound (2) adhere on the surfaces of the toner particles. Then the toner particles were dried in the circulating air dryer at 45° C. for 48 hours, and then sieved through a sieve of 75 μm mesh to obtain [toner base particles 1].

Addition of External Additives

To 100 parts of the obtained [toner base particles 1], 0.7 parts of hydrophobic silica and 0.3 parts of hydrophobic titanium oxide were mixed as external additives in HENSCHEL MIXER to obtain a toner. This was taken as [toner 1]. Table 3 shows various physical values of the [toner 1].

Preparation of Developer

A two-component developer containing 95% by mass of copper-zinc ferrite carrier having an average particle diameter of 40 μm coated with 5% by mass of [toner base particles 1] and a silicone resin thereon was prepared. Using the developer and a printer, imagio Neo, manufactured by Ricoh Co., Ltd. capable of printing 45 sheets of A4 size paper per minute, an image was consecutively printed to evaluate the results with the following evaluation method. Table 4 shows the evaluation results.

EXAMPLE B-2

[Toner 2] was obtained in the same manner as Example B-1 except that the amount of [particulate emulsion 1] was changed to 120 parts in the preparation of the aqueous phase, and the amount of [inorganic fine particles 1] was changed to 4,421 parts in the preparation of the oil phase.

EXAMPLE B-3

[Inorganic fine particles 2] having an average primary particle diameter of 180 nm was prepared in the same manner as the production example of inorganic fine particles used in Example B-1, and [toner 3] was obtained in the same manner as Example B-1 except that the amount of [inorganic fine particles 2] was changed to 177 parts in the preparation of the oil phase.

EXAMPLE B-4

[Toner 4] was produced in the same manner as Example B-1 except that in the preparation of the oil phase [inorganic fine particles 1] was changed to 118 parts of a hydrophobic silica having an average primary particle diameter of 10 nm (HDK H2000, manufactured by Clariant Japan K.K.) and 59 parts of a hydrophobic titanium oxide having an average primary particle diameter of 15 nm (MT-150AFM, manufactured by Teika K.K.).

EXAMPLE B-5

Synthesis of Organic Fine Particle Emulsion

To a reaction vessel equipped with a stirrer and a thermometer, 683 parts of water, 11 parts of sodium salt of the sulfuric acid ester of methacrylic acid ethylene oxide adduct (ELEMINOL RS-30, manufactured by Sanyo Chemical Industries, Ltd.), 68 parts of styrene, 93 parts of methacrylic acid, 115 parts of butyl acrylate, and 1 part of ammonium persulphate were poured, and stirred at 400 rpm for 15 minutes to obtain a white emulsion. The white emulsion was heated, the temperature in the system was raised to 75° C. and the reaction was performed for 5 hours. Next, 30 parts of an aqueous solution of 1% ammonium persulphate were added, and the reaction mixture was matured at 75° C. for 5 hours to obtain an aqueous dispersion liquid of a vinyl resin (copolymer of styrene-methacrylic acid-butyl acrylate-sodium salt of the sulfuric acid ester of methacrylic acid ethylene oxide adduct) [particulate emulsion 2]. The volume average particle diameter of [particulate emulsion 2] measured by a laser diffraction particle size distribution analyzer (LA-920, manufactured by SHIMADZU Corp.) was 90 nm. After drying a part of [particulate emulsion 2] and isolating the resin, the glass transition temperature (Tg) of the resin was 56° C. and the mass average molecular mass was 150,000.

Preparation of [Toner 5]

[Filter cake 2] was obtained in the same manner as Example B-1 except that [particulate emulsion 2] was used instead of [particulate emulsion 1] used in Example B-1. Thereafter, 15 parts of [filter cake 2] was added to 90 parts of water, and 0.002 parts of a fluorine-containing compound (the above-noted compound as sample 2) were dispersed therein to make the fluorine-containing compound (2) adhere on surfaces of the toner particles, and then dried in the circulating air dryer at 45° C. for 48 hours and then sieved through a sieve of 75 μm mesh to obtain toner base particles. The same external additives used in Example B-1 were added to the toner base particles to thereby obtain [toner 5].

EXAMPLE B-6

[Toner 6] was obtained in the same manner as Example B-5 except that the amount of [particulate dispersion 2] was changed to 120 parts in the preparation of the aqueous phase, and the amount of [inorganic fine particles 1] was changed to 4,421 parts in the preparation of the oil phase.

EXAMPLE B-7

[Inorganic fine particles 2] having an average primary particle diameter of 180 nm were produced in the same manner as the production example of inorganic fine particles used in Example B-5, and then [toner 7] was obtained in the same manner as Example B-5 except that 177 parts of [inorganic fine particles 2] were used in the preparation of the oil phase.

EXAMPLE B-8

[Toner 8] was obtained in the same manner as Example B-5 except that [inorganic fine particles 1] in the preparation of the oil phase in Example B-5 was changed to 118 parts of a hydrophobic silica having an average primary particle diameter of 10 nm (HDK H2000, manufactured by Clariant Japan K.K.) and 59 parts of a hydrophobic titanium oxide having an average primary particle diameter of 15 nm (MT-150AFM, manufactured by Teika K.K.).

Comparative Example B-1

[Toner 12] was obtained in the same manner as Example B-1 except that [inorganic fine particles 1] was not added in the preparation of the oil phase, the amount of [ketimine compound] was changed to 6.6 parts in the emulsification, and the number of rotation of the homomixer was changed to 13,000 rpm at the time of mixing [aqueous phase 1].

Comparative Example B-2

To 709 g of ion exchange water, 451 g of an aqueous solution of 0.1M-$Na_3PO_4$ was poured and heated at 60° C. and then stirred at 12,000 rpm using a TK homomixer. To the mixture solution, 68 g of an aqueous solution of 1.0M-$CaCl_2$ was gradually added to thereby obtain an aqueous medium containing $Ca_3(PO_4)_2$. In a TK homomixer, 170 g of styrene, 30 g of 2-ethylhexyl acrylate, 10 g of Regal 400R, 60 g of paraffin wax (s.p. 70° C.), 5 g of di-tert-butyl salicylic acid metal compound, and 10 g of copolymer of styrene-methacrylic acid (Mw 50,000, acid value of 20 mgKOH/g) were poured and then heated and mixed at 12,000 rpm so as to be uniformly dissolved and dispersed. Next, a polymerization initiator, 10 g of 2,2'-azobis (2,4-dimethyl-valeronitril) was dispersed in the mixture to thereby prepare a polymerizable monomer. The polymerizable monomer system was poured in the aqueous medium, stirred using a TK homomixer at 10,000 rpm for 20 minutes in $N_2$ atmosphere at a temperature of 60° C. to thereby granulate the polymerizable monomer system. Thereafter, the polymerizable monomer system was reacted at 60° C. for 3 hours while being stirred by a paddle stirring blade, and then the reaction was performed with the liquid temperature at 80° C. for 10 hours.

Without using an organic solvent phase, the polymerizable monomer system was cooled upon completion of the polymerization reaction, hydrochloric acid was added thereto, calcium phosphate was further dispersed in the polymerizable monomer system, and then filtered, washed, and dried to thereby obtain [toner 13].

[Evaluation Method]

(Evaluation Items)

(1) Measurement of Volume Average Particle Diameter and the Ratio of (Dv/Dn)

The particle diameter of toner was measured using a particle size measurement apparatus, Coulter Counter TA-II, manufactured by Coulter Electronics Ltd. with an aperture diameter of 100 μm. The volume average particle diameter and the number average particle diameter were obtained by the particle size measurement apparatus. The ratio Dv/Dn was automatically calculated with the values.

(2) Average Circularity

The average circularity was measured by using a flow particle image analyzer (FPIA-2100; manufactured by SYSMEX Corp.). Specifically, in a vessel, to 100 ml to 150 ml of water in which impure solids were preliminarily removed, a surfactant as a dispersing agent, preferably, 0.1 ml to 0.5 ml of alkylbenzenesulfonate was added, and further 0.1 g to 0.5 g of the measurement sample was added. The suspension with the sample dispersed therein was dispersed for approx. 1 minute to 3 minutes by an ultrasonic dispersion apparatus so as to the concentration of the dispersion liquid was 3,000 pieces/μl to 10,000 pieces/μl. The average circularity of toner was obtained by measuring the toner shape and the toner particle distribution through the use of the apparatus.

(3) Measurement of the Fluorine Content in Toner Base Particles and the Content of Inorganic Fine Particles Residing on Surfaces of Toner Base Particles The fluorine content in toner base particles and the content of inorganic fine particles residing on the surfaces of the toner base particles were measured by the following method. Herein, the area from several nanometers from the surface of the toner was measured. The x-ray photoelectron spectroscopy was used for the measurements. The measurement method, the type of x-ray photoelectron spectrometer, and conditions are not particularly limited, provided that the same result can be obtained, however, the following conditions are preferably used.

Apparatus: x-ray photoelectron spectrometer 1600S, manufactured by Philips Electronics N.V.

X-ray source: MgKα (400 W)

Analyzed area: 0.8×2.0 mm

Pretreatment: A sample was placed into an aluminum tray to measure the surface after smoothing the surface of the sample Calculation of surface atomic density: Relative sensitivity coefficients provided by Philips Electronics N.V. were used.

The results of the measurements were represented by atomic %.

When two or more types of inorganic fine particles were used, the total of densities of the elements originating in respective inorganic fine particles were measured and taken as the analyzed value.

(4) Measurement of Inorganic Fine Particles Content in Toner Base Particles

The content of inorganic fine particles in toner base particles was measured by the following method. An analytical curve was preliminarily prepared by the fluorescent x-ray spectroscopy through the use of the toner base particles of which the content of the inorganic fine particles had been clarified. By using the analytical curve, the content of the inorganic fine particles in the toner base particles was calculated. The measurement was enabled using a fluorescent x-ray spectrometer ZSX-100E (manufactured by RIGAKU Corporation). When two or more types of inorganic fine particles were used, the total of the analyzed values of the content of respective types of the inorganic fine particles were measured as the content of inorganic fine particles in the toner base particles.

(5) Measurement Method of Resin Fine Particles Content

The toner was initially pyrolytically decomposed, a styrene monomer derived from resin fine particles of a styrene-acryl copolymer was used as a label, and then the amount of the styrene monomer in the pyrolytically decomposed product was measured. Based on the measurement result, the content of resin fine particles residing in the toner was calculated and obtained. Using resin fine particles of a styrene-acryl copolymer of which the composition had been known as a label component, individual model toners of which the composition thereof had been respectively known were used so that the mass ratio of the styrene-acryl resin fine particles relative to toner base particles was 0.01% by mass, 0.10% by mass, 1.00% by mass, 3.00% by mass, and 10.0% by mass, and the individual model toners were pyrolytically decomposed under the condition of 590° C. for 12 seconds, the pyrolytically decomposed products were analyzed with the following conditions. Then, the peak area of the styrene monomer for the individual model toners was respectively obtained.

Analyzing apparatus: Pyrolysis gas chromatography mass-spectrometer

Main body of apparatus: QR-5000, manufactured by SHIMADZU Corp.

Attached pyrolytic furnace: JHP-3S, manufactured by Japan Analytical Industry Co., Ltd.

Pyrolysis temperature: 590° C. for 12 seconds

Column: DB-1 L=30 m, I.D=0.25 mm, and Film=0.25 μm

Column temperature: 40° C. (kept for 2 minutes) to (raised 10° C./m) 300° C.

Vaporizing chamber temperature: 300° C.

(6) Charged Amount

Into a metal-made reclosable cylindrical container, weighed 6 g of developer was placed, and a gas was blown into the container to obtain the charged amount. The toner concentration was adjusted to 4.5% by mass to 5.5% by mass.

(7) Embedded External Additives

The toner was stored at 40° C. with a 80% humidity for 1 week and stirred in the developing unit in the evaluation system A for 1 hour, and then the surface of the toner was observed as to the conditions of embedded external additives using a FE-SEM (field emission scanning electron microscope S-4200, manufactured by Hitachi, Ltd.). The smaller the amount of embedded external additives was, the more excellent the toner was. The results of the embedded external additives were ranked in order of excellence as A, B, C, and D.

(8) Cleaning Ability

Using the evaluation system A, after outputting 100 sheets, a residual toner after transfer remaining on the photoconductor which had gone through a cleaning step was transferred to a white paper sheet using a scotch tape (manufactured by Sumitomo 3M Limited) to measure the reflection density by a reflection densitometer (Macbeth reflection densitometer RD514). A toner which had a difference in reflection density from that of the blank portion of the paper being less than 0.005 was evaluated as A, a toner which had a difference thereof being 0.005 to 0.010 was evaluated as B, a toner which had a difference thereof being 0.011 to 0.02 was evaluated as C, and a toner which had a difference thereof being more than 0.02 was evaluated as D.

(9) Image Density

Using the evaluation system A, after outputting 150,000 sheets of a 50% image-area ratio chart in monochrome mode, the solid image was output on a sheet (paper 6000, manufactured by Ricoh, Co., Ltd.), and then the image density of the toners were measured by using a spectrodensitometer (manufactured by X-Rite Inc.). In the measurement, image densities of four color images were individually measured, and then the average of the image densities was calculated. When the value was less than 1.2, it was ranked as D. When the value was 1.2 or more and less than 1.4, it was ranked as C. When the value was 1.4 or more and less than 1.8, it was ranked as B. When the value was 1.8 or more and less than 2.2, it was ranked as A.

(10) Image Graininess and Sharpness

Image Graininess and Image Sharpness

Using the evaluation system B, a photographic image was output in monochrome mode, and the graininess level and the sharpness level of the photographic image were visually evaluated. The results of image graininess and image sharpness were ranked in order of excellence as A, B, C, and D. The image ranked as A was equivalent to those of offset printing. The image ranked as B was slightly inferior to those of offset printing. The image ranked as C was considerably inferior to those of offset printing, and the image ranked as D was poor in graininess and sharpness and was equivalent to those of conventional electrophotographic images.

(11) Background Smear

Using the evaluation system A, after outputting 30,000 sheets of a 50% image-area ratio chart in monochrome mode, a blank image was stopped during developing, and the developer remaining on the photoconductor after the developing was transferred onto a white paper sheet with a tape, and the difference in image density from that of a tape with no developer transferred thereto was measured using Spectro Densitometer 938 (manufactured by X-Rite Inc.). In this evaluation item, the lesser the difference in image density was, the more excellent the level of background smear was. The results of background smear were ranked in order of excellence as A, B, C, and D.

(12) Thin Spots in Printed Letters

Using the evaluation system A, after outputting 30,000 sheets of a 50% image-area ratio chart in monochrome mode, the image of letter portion was output to an OHP sheet (Type DX, manufactured by Ricoh Co., Ltd.) with a condition of four color toners superimposed thereon, and then the toner-untransferred frequency that the inner portions of a linear image had not been printed in the letter portion was compared with gradual samples of thin spots. The toner ranked as 1 was poor in the evaluation of thin spots in printed letters, and the toner ranked as 5 was excellent. When the toner was ranked as 1 or 2, it was evaluated as D. When the toner was ranked as 3, it was evaluated as C. When the toner was ranked as 4, it was evaluated as B, and when the toner was ranked as 5, it was evaluated as A.

(13) Toner Flowability

On a powder tester (PT-N, manufactured by Hosokawa Micron Ltd.), a 22 μm mesh, a 45 μm mesh, and a 75 μm mesh were placed and attached in this order, 2 g of the toner base particles were placed on the 75 μm mesh which was placed at the top. Vibrations of 1 mm were vertically given to the 75 μm mesh for 10 seconds. Flowability of the toner base particles (flocculation degree) was calculated from the residual amount of toner on each of these meshes.

Flocculation degree (%)=(5×(residual amount of toner on the 75 μm mesh (g))+3×(residual amount of toner on the 45 μm mesh (g))+(residual amount of toner on the 22 μm mesh (g))×10

The toner having a flocculation degree of 8% or less was evaluated as A. The toner having an flocculation degree of 8% to 16% was evaluated as B. The toner having an flocculation degree of 16% to 25% was evaluated as C, and the toner having an flocculation degree of 25% or more was evaluated as D.

(14) Fixing Property

Using the evaluation system A, a solid image was printed on transferring sheets of regular paper and heavy paper (duplicator printing paper 6200 and NBS <135>, respectively manufactured by Ricoh Co., Ltd.) with a toner adhesion amount of 0.85 $mg/cm^2 \pm 0.1$ $mg/cm^2$ and then evaluated as to fixing property. The evaluation of fixing was tested while varying the temperature of the fixing belt, and the upper limit fixing temperature at which no hot-offset had occurred was taken as the upper limit fixing temperature. The lower limit fixing temperature was measured using heavy paper. A fixing roll temperature at which the residual ratio of the image density after patting the surface of the obtained fixed image with a pat had been 70% or more was taken as the lower limit fixing temperature. A toner having an upper limit fixing temperature of 190° C. or more was evaluated as A. A toner having an upper limit fixing temperature of 190° C. to 180° C., it was evaluated as B. A toner having an upper limit fixing temperature of 180° C. to 170° C., it was evaluated as C. A toner having an upper limit fixing temperature of 170° C. or less, it was evaluated as D. In addition, a toner having a lower limit fixing temperature of 135° C. or less, it was evaluated as A. A toner having a lower limit fixing temperature of 135° C. to 145° C., it was evaluated as B. A toner having a lower limit fixing temperature of 145° C. to 155° C., it was evaluated as C. A toner having a lower limit fixing temperature of 155° C. or more, it was evaluated as D.

TABLE 3

| | | Residual value of resin fine particles (% by mass) | Content of fluorine (atomic %) | Inorganic fine particles content on surface analyzed by XPS (atomic %) | Amount of inorganic fine particles (% by mass) analyzed by Fluorescent x-ray spectroscopy | Primary particle diameter (nm) of Inorganic fine particles (Silica) | Primary particle diameter (nm) of Inorganic fine particles (Titanium Oxide) | Volume average particle diameter Dv (μm) | Number average particle diameter Dv (μm) | Toner Dv/Dn | Circularity |
|---|---|---|---|---|---|---|---|---|---|---|---|
| Ex. B-1 | Toner 1 | 0.50 | 2.2 | 0.86 | 1.05 | 5 | — | 5.98 | 5.70 | 1.05 | 0.94 |
| Ex. B-2 | Toner 2 | 0.50 | 2.1 | 14.25 | 48.86 | 5 | — | 5.61 | 4.96 | 1.13 | 0.94 |
| Ex. B-3 | Toner 3 | 0.50 | 2.3 | 4.91 | 5.01 | 180 | — | 5.82 | 5.29 | 1.10 | 0.92 |
| Ex. B-4 | Toner 4 | 0.51 | 2.2 | 3.25 | 48.86 | 10 | 15 | 5.09 | 4.24 | 1.20 | 0.94 |
| Ex. B-5 | Toner 5 | 4.0 | 7.6 | 0.85 | 1.04 | 5 | — | 5.11 | 4.56 | 1.12 | 0.92 |
| Ex. B-6 | Toner 6 | 4.2 | 7.7 | 14.29 | 48.90 | 5 | — | 4.80 | 4.36 | 1.10 | 0.94 |
| Ex. B-7 | Toner 7 | 3.9 | 7.7 | 4.76 | 4.94 | 180 | — | 6.79 | 5.66 | 1.20 | 0.94 |
| Ex. B-8 | Toner 8 | 4.1 | 7.6 | 3.27 | 4.85 | 10 | 15 | 6.61 | 5.16 | 1.28 | 0.92 |
| Compara. Ex. B-1 | Toner 12 | 0.49 | 2.3 | 0.00 | 0.00 | — | — | 4.82 | 4.38 | 1.10 | 0.96 |
| Compara. Ex. B-2 | Toner 13 | — | 0.8 | 0.00 | 0.00 | — | — | 4.45 | 3.87 | 1.15 | 0.89 |

TABLE 4

| | Charge Property (−μC/g) | | Embedded | | | Image | | Thin spots in | | Fixing Property | |
|---|---|---|---|---|---|---|---|---|---|---|---|
| | Start | 50,000 sheets | External Additives | Cleaning-ability | Image Density | Graininess/ Sharpness | Background Smear | printed letters | Toner Flowability | Lower limit fixing temperature | Upper limit fixing temperature |
| Ex. B-1 | 33.5 | 27.9 | B | A | A | A | B | B | A | B | B |
| Ex. B-2 | 30.8 | 27.5 | A | A | A | B | B | B | A | B | B |
| Ex. B-3 | 28.5 | 24.3 | A | B | B | C | B | C | B | C | A |
| Ex. B-4 | 31.3 | 20.2 | A | A | A | A | B | A | A | B | B |
| Ex. B-5 | 35.5 | 30.8 | B | A | B | B | B | B | A | B | B |
| Ex. B-6 | 34.8 | 29.8 | A | A | B | B | B | B | A | B | B |
| Ex. B-7 | 30.2 | 26.7 | A | B | C | C | B | C | B | C | A |
| Ex. B-8 | 36.8 | 25.5 | A | A | B | B | B | A | A | B | B |
| Compara. Ex. B-1 | 33.5 | — | D | C | B | B | C | B | D | B | B |
| Compara. Ex. B-2 | 23.5 | — | D | C | B | B | D | B | D | A | D |

With respect to the toners obtained in Comparative Examples B-1 to B-2, it was impossible to consecutively print an image to 50,000 sheets due to worsened toner scattering caused by failures of charge property, therefore, the evaluation of these toners was suspended.

According to the present invention, it is possible to provide a developer which has a sharp charge amount distribution, enables forming high-quality images without the used external additives being embedded into the toner and substantially smearing a charging unit, a developing unit, a photoconductor, and an intermediate transfer member by the developer even after storing the toner in high-temperature and high-humidity environment, and exhibiting an appropriate image density and extremely little background smear even when repeatedly used for a number of sheets of paper for a long period of time as well as to provide an electrophotographic image developing unit for electrophotography using the developer. This is enabled by using the toner produced by dissolving or dispersing a toner composition which includes a binder resin containing a modified polyester resin capable of reacting with a compound having an active hydrogen group, colorants, and a releasing agent in an organic solvent, further dispersing the toner composition solution or the toner composition dispersion liquid in an aqueous solvent containing resin fine particles to be subjected to an elongation and/or a cross-linking reaction, removing the organic solvent from the obtained dispersion liquid, washing and drying the dispersion liquid. It is also possible to provide a developer which is excellent in flowability and capable of forming reproductive and steady images to any transferring media without image blur, dust, and transferring omissions as well as to provide an electrophotographic image developing unit. Further, it is possible to provide a toner capable of responding to a low-temperature fixing system while keeping excellent cleaning ability and anti-offset property without smearing fixing units and images. When the toner is loaded to a process cartridge, similarly, excellent effects are exhibited. In addition, it is possible to provide an image forming apparatus in which a charger capable of reducing occurrence of ozone, a photoconductor having a high hardness and exhibiting high sensitivity to light at long wavelengths such as a semiconductor laser (770 nm to 800 nm) without exhibiting substantial deterioration caused by being repeatedly used, and a fixing unit which is efficient and capable of shortening the warm-up time.

What is claimed is:

1. A toner for electrophotography produced by:

dissolving and/or dispersing at least a modified polyester resin capable of reacting with an active hydrogen group-containing compound and colorants in an organic solvent, further dispersing the solution or the dispersion liquid in an aqueous medium to subject the modified polyester resin capable of reacting with the active hydrogen-containing compound to an elongation and/or a cross-linking reaction, and removing the organic solvent from the obtained dispersion liquid to thereby obtain toner base particles which comprises one or more inorganic fine particles contained therein.

2. The toner for electrophotography according to claim 1, wherein the solution or the dispersion liquid is dispersed in the presence of a releasing agent in the aqueous medium which comprises resin fine particles.

3. The toner for electrophotography according to claim 1, wherein the solution or the dispersion liquid comprises the one or more inorganic fine particles.

4. The toner for electrophotography according to claim 1, wherein the one or more inorganic fine particles are added to the aqueous medium.

5. The toner for electrophotography according to claim 1, wherein the total amount of the inorganic fine particles obtained by fluorescent x-ray spectroscopy to the toner base particles is 0.1% by mass to 50% by mass.

6. The toner for electrophotography according to claim 1, wherein the element concentration derived from the inorganic fine particles on the surfaces of the toner base particles obtained by x-ray photoelectron spectroscopy is 0.1 atomic % to 15 atomic %.

7. The toner for electrophotography according to claim 1, wherein the average particle diameter of the primary particles of the inorganic fine particles is 5 nm to 200 nm.

8. The toner for electrophotography according to claim 1, wherein the inorganic fine particles comprises a silicon element-containing compound and a metallic element-containing compound.

9. The toner for electrophotography according to claim 8, wherein the inorganic fine particles comprises the silicon element-containing compound and a titanium element-containing compound.

10. The toner for electrophotography according to claim 1, wherein the inorganic fine particles comprises a silica and/or a titanium oxide.

11. The toner for electrophotography according to claim 1, wherein the dielectric constant of the inorganic fine particles is 0.2 to 7.5.

12. The toner for electrophotography according to claim 1, wherein the volume average particle diameter Dv of the toner particles is 2 μm to 7 μm, and the ratio Dv/Dn of the volume average particle diameter Dv to the number average particle diameter Dn is 1.25 or less.

13. The toner for electrophotography according to claim 1, wherein the average circularity of the toner particles is 0.950 to 0.990 being formed in a substantially spherical shape.

14. The toner for electrophotography according to claim 1, wherein the toner base particles are obtained by removing the organic solvent from the obtained dispersion liquid and further subjecting the dispersion liquid to a surface treatment using a fluorine-containing compound.

15. The toner for electrophotography according to claim 14, wherein the content of fluorine atoms derived from the fluorine-containing compound in the toner base particles obtained by x-ray photoelectron spectroscopy is 2 atomic % to 30 atomic %.

16. The toner for electrophotography according to claim 15, wherein the total amount of the inorganic fine particles in the toner base particles obtained by fluorescent x-ray spectroscopy to the toner base particles is 0.1% by mass to 50% by mass.

17. The toner for electrophotography according to claim 15, wherein the element concentration derived from the inorganic fine particles on the surfaces of the toner base particles obtained by x-ray photoelectron spectroscopy is 0.1 atomic % to 15 atomic %.

18. The toner for electrophotography according to claim 14, wherein the fluorine-containing compound is represented by the following general formula (1):

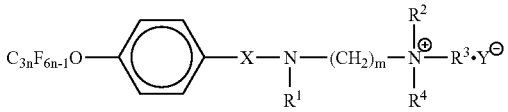

(1)

where X represents —$SO_2$— or —CO—, $R^1$, $R^2$, $R^3$, and $R^4$ independently represent one selected from the group consisting of a hydrogen atom, alkyl groups having 1 to 10 carbon atoms, and aryl groups, Y represents an iodine atom, a bromine atom, or a chlorine atom, and m and n respectively represent an integer of 1 to 10.

19. The toner for electrophotography according to claim 14, wherein the content of the resin fine particles to the toner is 0.5% by mass to 5.0% by mass.

20. The toner for electrophotography according to claim 14, wherein the mass average molecular mass of the resin fine particles is 9,000 to 200,000.

21. The toner for electrophotography according to claim 14, wherein the glass transition temperature Tg of the resin fine particles is 40° C. to 100° C.

22. The toner for electrophotography according to claim 14, wherein the resin fine particles comprise one selected from vinyl resins, polyurethane resins, epoxy resins, and polyester resins or in combination with two or more thereof.

23. The toner for electrophotography according to claim 14, wherein the average particle diameter of the resin fine particles is 5 nm to 500 nm.

24. The toner for electrophotography according to claim 14, wherein the volume average particle diameter of the toner particles is 3 μm to 8 μm.

25. The toner for electrophotography according to claim 14, wherein the ratio Dv/Dn of the volume average particle diameter Dv to the number average particle diameter of the toner particles is 1.25 or less.

26. The toner for electrophotography according to claim 14, wherein the average circularity of the toner particles is 0.900 to 0.980.

27. The toner for electrophotography according to claim 1, wherein a non-reactive polyester is dispersed together with the modified polyester resin capable of reacting with the active hydrogen group-containing compound in the organic solvent, and the mass ratio of the functional group-containing polyester resin to the non-reactive polyester is 5/95 to 75/25.

28. A two-component developer comprising:

a toner for electrophotography, and a carrier comprising magnetic particles, wherein the toner for electrophotography was produced by dissolving and/or dispersing at least a modified polyester resin capable of reacting with an active hydrogen group-containing compound and colorants in an organic solvent, further dispersing the solution or the dispersion liquid in an aqueous medium to subject the modified polyester resin capable of reacting with the active hydrogen-containing compound to an elongation and/or a cross-linking reaction, and removing the organic solvent from the obtained dispersion liquid to thereby obtain toner base particles which comprises one or more inorganic fine particles contained therein.

29. An image forming apparatus comprising:

a latent electrostatic image bearing member, a charging unit configured to charge the latent electrostatic image bearing member, a developing unit configured to develop a latent electrostatic image on the electrostatic image bearing member using a developer to thereby form a toner image, and a transferring unit configured to electrostatically transfer the toner image on a transferring material by making the transferring unit contact with the surface of the latent electrostatic image bearing member through the transferring material, wherein the developer comprises a carrier which comprises magnetic particles and a toner for electrophotography, and the toner for electrophotography is produced by dissolving and/or dispersing at least a modified polyester resin capable of reacting with an active hydrogen group-containing compound and colorants in an organic solvent, further dispersing the solution or the dispersion liquid in an aqueous medium to subject the modified polyester resin capable of reacting with the active hydrogen-containing compound to an elongation and/or a cross-linking reaction, and removing the organic solvent from the obtained dispersion liquid to thereby obtain toner base particles which comprises one or more inorganic fine particles contained therein.

30. The image forming apparatus according to claim 29, further comprising a charging unit by which the charge member is contacted with the latent electrostatic image bearing member so as to apply a voltage to the charge member.

31. The image forming apparatus according to claim 29, wherein the electrostatic image bearing member is an amorphous silicon electrostatic image bearing member.

32. The image forming apparatus according to claim 29, further comprising a fixing unit which comprises a heater having a heating element, a film making contact with the heater, and a pressurizing member brought into pressure contact with the heater through the film, in which a recording material with an unfixed image formed thereon is passed through between the film and the pressurizing member to thereby heat and fix the image.

33. The image forming apparatus according to claim 29, wherein the developing unit comprises an electric field applying unit configured to apply an alternate electric field to the latent electrostatic image bearing member.

34. A process cartridge comprising:

a latent electrostatic image bearing member, and one or more units selected from a charging unit configured to charge the latent electrostatic image bearing member, a developing unit configured to develop a latent electrostatic image on the latent electrostatic image bearing member using a developer loaded on the developing unit to form a toner image, and a cleaning unit configured to remove a residual toner on the surface of the latent electrostatic image bearing member after transferring, and are integrally supported so as to be detachably mounted on an image forming apparatus, wherein the toner is produced by dissolving and/or dispersing at least a modified polyester resin capable of reacting with an active hydrogen group-containing compound and colorants in an organic solvent, further dispersing the solution or the dispersion liquid in an aqueous medium to subject the modified polyester resin capable of reacting with the active hydrogen-containing compound to an elongation and/or a cross-linking reaction, and removing the organic solvent from the obtained dispersion liquid to thereby obtain toner base particles which comprises one or more inorganic fine particles contained therein.

* * * * *